US010876816B2

(12) United States Patent
Campbell

(10) Patent No.: US 10,876,816 B2
(45) Date of Patent: Dec. 29, 2020

(54) CAMERA SIGHT DEVICES AND REAR VIEWING CAMERA SMART PHONE MOUNT FOR A FIREARM

(71) Applicant: Robert Marshall Campbell, Miami, FL (US)

(72) Inventor: Robert Marshall Campbell, Miami, FL (US)

(73) Assignee: HOOKSHOTTACTICAL, LLC, Miami, FL (US)

( * ) Notice: Subject to any disclaimer, the term of this patent is extended or adjusted under 35 U.S.C. 154(b) by 0 days.

(21) Appl. No.: 15/912,271

(22) Filed: Mar. 5, 2018

(65) Prior Publication Data

US 2019/0128641 A1 May 2, 2019

Related U.S. Application Data

(63) Continuation-in-part of application No. 15/353,706, filed on Nov. 16, 2016.

(60) Provisional application No. 62/467,197, filed on Mar. 5, 2017, provisional application No. 62/386,055, filed on Nov. 16, 2015.

(51) Int. Cl.
*F41G 1/30* (2006.01)
*F41G 11/00* (2006.01)

(52) U.S. Cl.
CPC ..... *F41G 1/30* (2013.01); *F41G 11/003* (2013.01)

(58) Field of Classification Search
CPC ..... F41G 1/30; F41G 11/003
USPC ..... 42/113, 124
See application file for complete search history.

(56) References Cited

U.S. PATENT DOCUMENTS

| | | | | |
|---|---|---|---|---|
| 2,780,130 | A * | 2/1957 | Mauer | G03B 13/02 356/251 |
| 3,709,124 | A | 1/1973 | Hunt | |
| 3,911,451 | A | 10/1975 | Vockenhuber | |
| 5,020,262 | A | 6/1991 | Pena | |
| 5,200,827 | A | 4/1993 | Hanson et al. | |
| 5,615,854 | A * | 4/1997 | Nomura | F16M 11/10 248/205.3 |

(Continued)

OTHER PUBLICATIONS

"New Rail Mounts from Caldwell" by Recoil Staff; Nov. 13, 2015 https://www.recoilweb.com/new-rail-mounts-from-caldwell-76729.html (Year: 2015).*

*Primary Examiner* — Samir Abdosh
(74) *Attorney, Agent, or Firm* — Javier Sobrado; A. Robert Weaver; Nicole Fundora

(57) ABSTRACT

Reflex type sights for firearms engineered to possess advanced tactical abilities as well as various accessories including rotatable smart device mounts that provide the user with the abilities to view target image in the screen of the smart device from any position user could position himself in relation to firearm, as well as, other accessories that provide abilities such as rotatable camera sights that provide the user with their target image at a full 360 degree radius as well, that lock back into their perfectly sighted-in position when locked back into their parallel position to weapon's rail, as well as other accessories providing additional tactical abilities, such as becoming integral to other accessories that include additional cameras and viewing screens that provide the user with a surveilled image, behind the user at the same time. This, as well as, other types of reflex type camera sights with multiple secondary abilities and advanced sighting abilities.

18 Claims, 33 Drawing Sheets

(56) References Cited

U.S. PATENT DOCUMENTS 6,539,661 B2 4/2003 Hope
7,180,587 B1 2/2007 Matijczyk
7,255,035 B2 8/2007 Mowers
7,640,691 B2 * 1/2010 Karcher ..... F41G 1/40 359/399
7,891,131 B2 2/2011 Holmberg
7,911,690 B2 3/2011 Chapman
8,046,950 B2 11/2011 Holmberg
8,091,265 B1 1/2012 Teetzel et al.
8,093,992 B2 1/2012 Jancic et al.
8,297,173 B1 10/2012 Teetzel et al.
8,336,776 B2 12/2012 Horvath et al.
8,978,539 B2 3/2015 Teetzel et al.
9,010,002 B2 4/2015 Popa-Simil
9,335,536 B2 * 5/2016 Russ ..... F41G 1/38
9,568,282 B1 * 2/2017 Schorman ..... F16M 13/02
9,702,661 B2 7/2017 Kremer et al.
10,162,168 B2 * 12/2018 Teetzel ..... G02B 23/18
2005/0179799 A1 8/2005 Umanskiy et al.
2005/0241210 A1 * 11/2005 Karcher ..... F41G 1/40 42/119
2005/0252063 A1 11/2005 Flannigan
2007/0157502 A1 * 7/2007 Holmberg ..... F41G 11/003 42/124
2007/0157503 A1 * 7/2007 Holmberg ..... F41G 11/003 42/124
2009/0255163 A1 * 10/2009 Holmberg ..... F41G 1/473 42/124
2010/0302282 A1 12/2010 Dobbie et al.
2011/0035984 A1 2/2011 Liu
2012/0097741 A1 4/2012 Karcher
2013/0008072 A1 * 1/2013 Chung ..... F41G 1/16 42/113
2013/0344461 A1 12/2013 Tello
2015/0040409 A1 2/2015 Morrison
2015/0300786 A1 * 10/2015 Downing ..... H04W 84/12 235/404
2016/0047626 A1 2/2016 Kremer et al.
2016/0246047 A1 * 8/2016 Russ ..... F41G 1/38
2016/0316128 A1 10/2016 Teich et al.
2016/0377383 A1 * 12/2016 Downing ..... F41G 11/003 42/111
2017/0010073 A1 * 1/2017 Downing ..... F41C 27/00
2018/0245880 A1 * 8/2018 Campbell ..... F41G 1/473
2018/0347948 A1 * 12/2018 VanCamp ..... F41G 1/30
2019/0128641 A1 * 5/2019 Campbell ..... F41G 1/30
2019/0178605 A1 * 6/2019 Evans ..... F41B 5/1492
2019/0186516 A1 * 6/2019 Chen ..... F16C 11/103
2019/0301833 A1 * 10/2019 Campbell ..... F41G 1/36

* cited by examiner

FIG-1-A
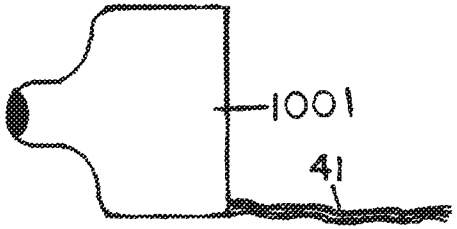
FIG-1-B
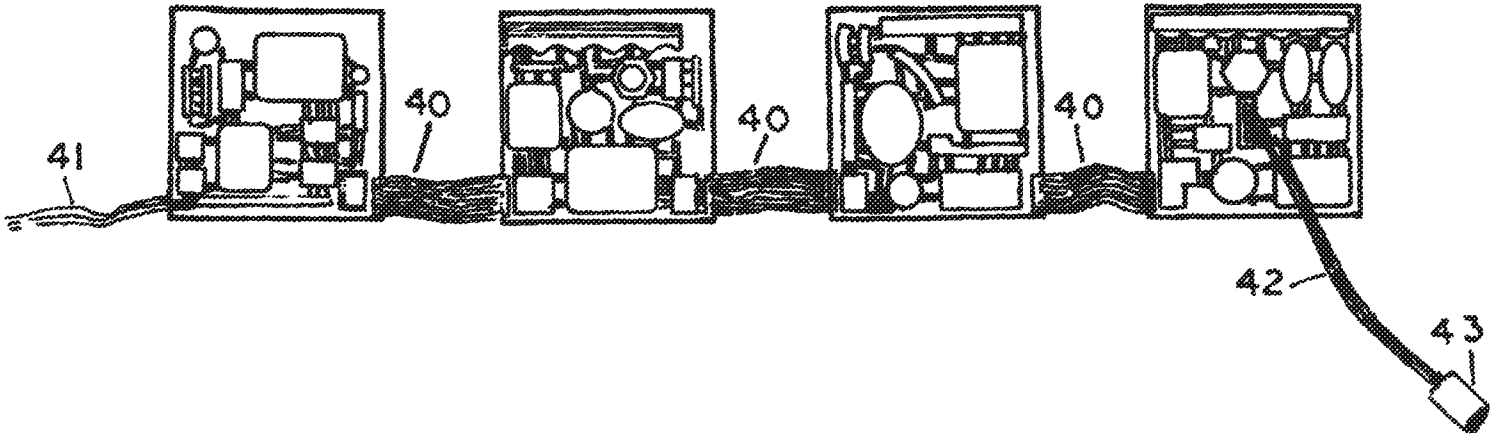

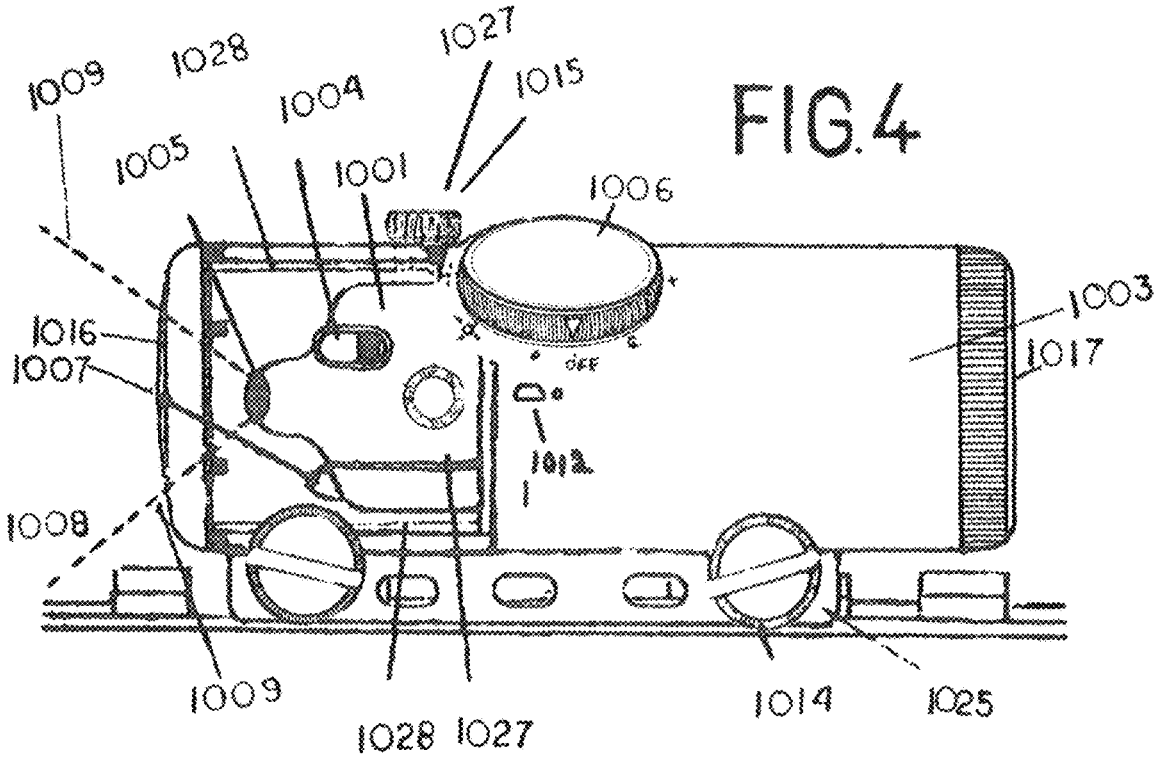
FIG. 4
FIG. 5
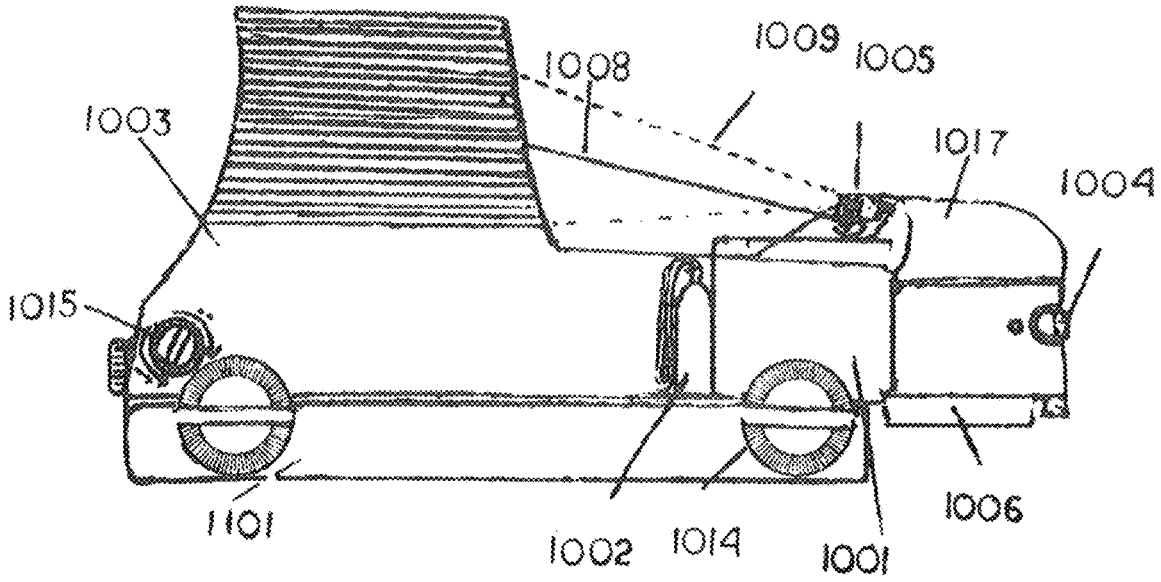

5500

5501
5501

5507
5519
5508
5517
5502
5517
5502
5510
5510
5503
5503

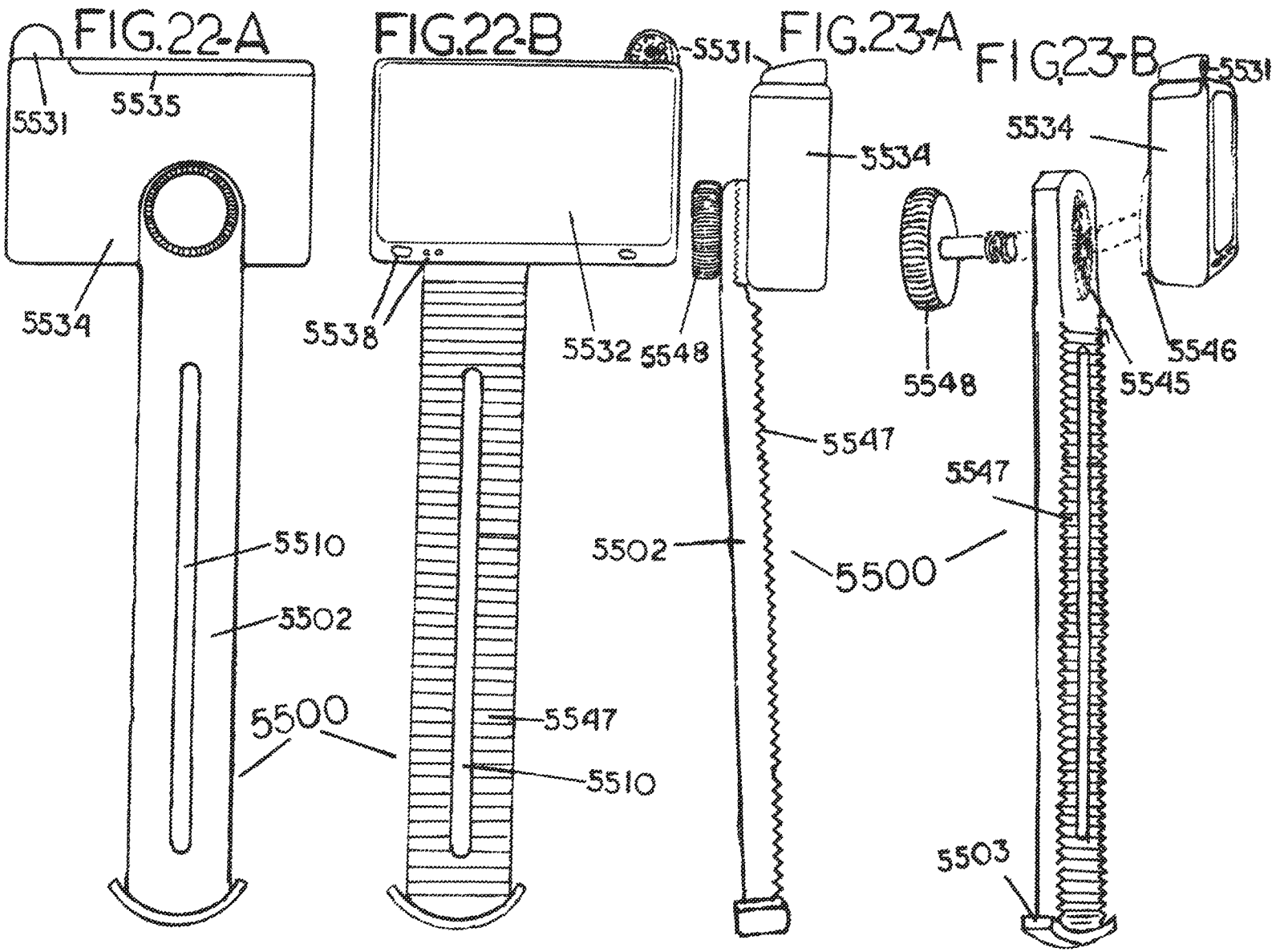
FIG.23-B
5531
5546
5545
5534
5547
5500
5503
FIG.23-A
5534
5548
5547
5500
5531
5548
5502
FIG.22-B
5532
5547
5510
5538
FIG.22-A
5510
5502
5500
5535
5531
5534

5158
5156
5154
51
5508
5783
5152
5166
5150
5140
5767
5746
27
5748
5000

5502
5507
51
27

5524
5507
5502
5768-A
5150
5166
5771
5748
5774
5767
5769

5776
5000
5770
5772
5781-A
5771
5746
5781-B
5768-B 5740
5752
5740A
5748
5769
5766 B
5768 B
5781A
5774
5780
5776
5781 A
5770
5775
5771
5771
5781
5000
5768 A
5748

5774
5770
5777
5778
5779
5781 B 5782
5772
5771
5746
5777
5748

5766
5152
5157
5746
5781-B
5000
5768A 5767
5768
5773
5779
5158
5154
51
5752

5140
5152
5524
5500
5140
5000

5140
5534
5500

2000
4015
4050
4002
4018
OFF
4012
4007
4014
4009
4003
4015
4004
4003
4000
75
4013
4012

CAMERA SIGHT DEVICES AND REAR VIEWING CAMERA SMART PHONE MOUNT FOR A FIREARM

CLAIM OF PRIORITY

This application is a continuation-in-part of U.S. Non Provisional Patent application Ser. No. 15/353,706 filed Nov. 16, 2016 entitled, CAMERA SIGHT DEVICE FOR A WEAPON. This application is also related to and claims benefit to U.S. Provisional Patent Application No. 62/467,197 filed Mar. 5, 2017 entitled CAMERA SIGHT DEVICES AND REAR VIEWING CAMERA SMART PHONE MOUNT FOR A FIREARM.

FIELD OF INVENTION

The present inventions generally relate to the field of firearm accessories. Firearm accessories consist of a wide range of devices that attach to and enhance the performance of, or simply work in conjunction with a firearm, all of which are produced to enhance the abilities of the firearm in one way or another. These accessories consist of things like various types of sights, scopes, night vision, laser sights, range finders, etc. as well as things like regular or infra-red high-powered lights, tripods, various types of mounting rail systems, etc. This invention would fall more into the sight category, but more particularly, this device is a new type of reflex or red dot type of camera sight and smartphone or smart device mount all of which are mountable to a firearms rail mounts and that all work together as integral parts or components of a camera sight system that works in various combinations to best provide services and best fulfil the needs for the multiple types of firearms, as well their many applications. These reflex or red dot type of camera sights were primarily devised and engineered to provide the user with the ability to surveil an area at a full radius of 360 degrees while maintaining full accurate use of the firearm at the same time, all from a position where his entire body remains behind protective cover, to alert the user of advancing hostile combatants, to locate snipers, or other developing enemy scenarios, but basically to provide our combat soldiers with the ability to remain totally behind protective cover while performing some of their least to their most dangerous tasks required of them, that unfortunately result in very large percentage of American casualties

BACKGROUND OF THE INVENTION

It is well appreciated in the art of weaponry and particularly rifles and hand guns. There have been numerous attempts to develop more efficient firearm accessories that provide a soldier with a level of safety and control in theaters of combat where gun fire must be exchanged to the preservation of the soldier's life, in that first responders, soldiers, and law enforcement personnel often encounter hostile combatants, violent actors, or offenders who carry pistols, rifles, or other weapons. In military scenarios, battles and other military operations often occur in urban theaters of combat requiring armed forces to patrol and engage in battle in towns and cities, with personnel on patrol in theaters of combat, and if under fire from the enemy, must regularly take cover behind obstacles such as buildings, vehicles, trees, homes, etc. with the remedy to these scenarios being extremely dangerous, that rarely end well. The problem is that with the friendly combatants' entire body being behind protective cover, a clear lineal view to locate the point of fire, or be able to locate or accurately engage advancing hostile enemy combatants, when it's the only option to the soldier's survival, cannot be accomplished without looking over or around these fortified structures, exposing himself as a target while doing so. This, or to even change positions or to transverse from one location to another, the soldier must peek around corners of buildings or other objects to access the dangers in the path he must take, exposing himself as a target while doing so. Known statistics establish that a large percentage of American casualties occur on the battlefield while doing so, especially in theaters of urban combat which has presented all new dangers and challenges for today's soldiers. The ability to see and to be made aware of these dangers is vitally important to their very survival.

This application is for a continuation in part on a patent application named CAMERA SIGHT DEVICE FOR A WEAPON, being a patent application for an invention that consists of various types of tactical red dot, or reflex types of camera sights and tactical camera sight accessories, primarily developed for our military and law enforcement, provides a solution to that very problem. This solution, consists of several devices that all work in conjunction with each other as integral components of this camera sight system. This camera sight system has many different component options and variations, as well as many different accessory options, all of which broaden and enhance this invention's range of application, versatility, adaptability and range of use. All of these various types of camera sights and their accessories compressing this tactical reflex camera sight system, were all initially devised and engineered to work in various combinations, to best equip the various types of firearms availed, to not only our military's ground forces, but to all types of firearms. This, in that all of these tactical camera sights and their accessories are engineered to mount to and work in conjunction with, any and all of the various types of firearms employed by all branches of this nation's military, including special forces, as well as the secret service, and equipment employed by special law enforcement such as S.W.A.T. This camera sight system, and all of its components working in their various combinations and applications, provide an all new level of safety, and safety providing abilities to the personnel of this nation that have to put their lives on the line daily, to maintain the safety and freedoms that all of those in this nation enjoy but far too often take for granted. All components of this tactical reflex camera sight system have been primarily devised, and engineered to equip this nation's defenses, with a device that best accomplishes their specific needs and that would best exploit this tactical camera sight system's abilities to provide our troops with the highest level of control and safety possible. For instance, these camera sight systems optionally employ numerous types of these camera sights, as well as numerous specially engineered components and accessories that work in conjunction with each other in a variety of combinations to provide our armed forces with variations of these camera sight systems, that provide the highest degree of safety and control in their various applications, along with other optional camera sight component options, that additionally enhance this camera sight's safety providing abilities. In fact, the many variations of these camera sights, as well their many accessories and component options, have been devised and engineered over the last three years of this camera sight system's development, as the applicant's efforts have continually pressed forward to supply our armed forces with a system that provides our troops with the highest level of safety and control possible.

These various types of camera sights, as well as many camera sight accessories and their optional components described in their original patent application, as well as this continuation in part, jointly make up the various camera sight systems that all work in conjunction with each other in various combinations, creating many different variations of these camera sight systems, with some working in different modes, with some lending themselves best working in conjunction with one type of fire arm or another, or best in one particular application or another. But these various types of camera sights and their accessories that make up these tactical camera sight systems in all of their various designs and modes of operation have been primarily engineered to complete the same primary tasks. This task being, to provide the user with a new level of safety and control, that the applicant has been assured, possesses the ability to prevent a very large percentage of American casualties and save a great number of our troop's lives, which has been the driving force in the inventor's development of these tactical reflex or red dot type camera sights, and their various accessories that work in conjunction with each other to expand and enhance their overall range of application and safety providing abilities.

Additional new material documented in this continuation in part consists of modifications done to the rotatable camera sight mount that is rotatable and locks into various desired angles of 360 degrees to surveil areas from a safe, secured position and that solidly locks perfectly back into its perfectly sighted-in position when desired.

It is well appreciated in the art of weaponry and particularly rifles and hand guns. There have been numerous attempts to develop more efficient, accurate firearm sights and user-friendly sight systems. In general, firearm sights and sight accessories have long been established for mounting on rifles and pistols. Such accessories include red dot sights, high powered lights, night vision, scopes, laser sights, and the like. All of the aforementioned firearm sights and accessories aid in locating and pinpointing a target, however, the aforementioned prior art offers no solution to the soldier to very effectively surveil an entire area from a safe, secured position, while maintaining the full use of any of the various types of firearms. In other words, in order to accurately locate, or engage a target, when under fire, the user of the firearm must then become exposed as a target in order to do so, which presents a severe problem to the preservation of the soldier's life, in that, first responders, soldiers, and law enforcement personnel often encounter hostile combatants, violent actors, or offenders who carry pistols, rifles, or other weapons. In military scenarios, battles and other military operations often occur in urban theaters of combat, requiring armed forces to patrol and engage in battle in towns and cities, with personnel on patrol in theaters of combat, and if under fire from the enemy, must regularly take cover behind obstacles such as buildings, vehicles, trees, homes, etc. with the remedy to these scenarios being extremely dangerous, that rarely end well. The problem is that with the friendly combatants' entire body being behind protective cover, a clear lineal view to locate the point of fire, or be able to locate or accurately engage advancing hostile enemy combatants, when it is the only option to the soldier's survival, cannot be accomplished without looking over or around these fortified structures, exposing himself as a target while doing so. This, or to even change positions or to transverse from one location to another, the soldier must peek around corners of buildings or other objects to access the dangers in the path he must take, exposing himself as a target while doing so. Known statistics establish that a large percentage of American casualties occur on the battlefield while doing so, especially in theaters of urban combat, which has presented all new dangers and challenges for today's soldiers. The ability to see, and to be made aware of, these dangers is vitally important to their very survival.

Currently available solutions to these problems, and in the prior art, that actually accomplish the task of supplying a soldier with the ability to effectively both locate and engage a target, without becoming a target, have all exhibited problems or deficiencies of one sort or another, that prove evident in many ways, in that most of which are simply very limited or lacking in the range of protection or use that they offer the user. Most of which consist of multiple bulky electronic devices that not only take up space, but also add additional weight to a soldier's existing heavy load. Most of these current solutions even create problems unto themselves by engineering them in a way that these devices are exclusive either to themselves, and are manufactured as an integral part of a particular firearm, or exclusive to one type of firearm. These current solutions also only function as a complete unit with all their components being dependent on each other to remain in working order.

Another problem with the present solutions to this problem is also in their exclusivity with combinations of very expensive and exclusive components, with either only one or a very limited range of applications. This not only limits their versatility and range of application, but also creates additional problems of dependability in that all of these components are dependent on each other to work as a functioning unit. These aforementioned solutions, even with all of their complexity, are all found to be severally lacking in their range of versatility, adaptability, range of use and most importantly, the range of protection that they actually offer the user.

Current available solutions to this problem found in the prior art that actually accomplish the task of supplying a soldier with the ability to effectively both surveil an area while maintaining the accurate use of a firearm, totally from behind protective cover, without exposing any part of the user's body to incoming fire while doing so, are very few, with most engineered to complete either one function or the other; to either be used for surveillance purposes or their primary function being just to accurately engage the enemy from a safer position, rarely with any of them doing either well, with only one known device that that performs both of these tasks with any degree of efficiency. This being the Israeli Corner Shot which consists of a pistol mounted on the forward portion of a ratcheting bendable stock. This firearm also has a video camera with a super imposed reticle that is wired to a 2½ inch monitor with an LED screen that is simply put into service by locking the sight screen into its non-rotatable 90 degree viewing position in relation to the rifle stock, viewable at lower portion of the left side of the firearm stock, that the camera supplies its target image to the user from. The ratcheting bendable forward portion of this firearm, that the pistol and camera with its superimposed reticle is mounted to, is pivot-ably connected to the stock portion and swings, and is lockable to either side of the firearm, to surveille the area for potential dangers. This, as well as to engage same if deemed necessary. This tactile firearm, I am sure, saved a great many of our troops, as well as our ally's troops' lives, since its inception, but even this tactical firearm in spite of its successes, along with all of the rest of the prior art for that matter, still suffers from a great many deficiencies as well, that proves evident in many ways. That additional forethought and a wider conceptional vision of the overall needs, along with greater effort was put forth, along with innovative engineering, directed towards the development of a device with a greater range of application, versatility, cost effectiveness, and adaptability as well, to provide a greater range of services and abilities that would actually fulfill the overall needs of our armed forces, which holds true in all of the prior art, resulting in restrictions in the level of safety, control, and protection providing abilities that they actually provide to our troops. For instance, the Israeli corner shot being an entire firearm with all its components being exclusive to itself, and with its firepower limited to the fire power, range, and accuracy being limited to only what a pistol can provide. For this reason and others, this firearm is also seen and used by the military, only as a secondary or specialty firearm and not to take the place of a soldier's primary firearm, meaning that this entire firearm would have to be carried into battle along with the rest of the soldier's equipment, not only adding an additional eight and a half pounds to the soldier's existing heavy load, but also getting in the way when not in use. But because of these things, also limiting the soldier's range of mobility, and abilities, and thus hindering the soldier's effectiveness in the use the rest of the equipment availed to him, hindering him in the performance of other duties required of him. This firearm is also limited in the positions that a soldier must place himself to the effective use of the firearm due to the location and non-position-ability of the target screen, which can present a problem in some of the more restrictive places a soldier would have to position himself to remain out of the line of fire, while maintaining full effective use of the firearm's tactical abilities. This tactical firearm, as well as other prior art, provides no abilities to the user to maintain a visual of the area behind the user to provide advanced warnings of things, like developing enemy scenario's, or advancing hostile combatants or other dangers approaching from the rear.

The prior art's severe lack of versatility, in its lack of ability to be adapted to the many different types of firearms availed to our armed forces, such as the numerous types of rifles, whether standard issue or the various types of specialty and automatic rifles and pistols to even R.P.G.s and grenade launchers, that would greatly benefit from and are in desperate need of these abilities, the prior art has failed to supply.

These current solutions' exclusivity to themselves create other problems as well, with some of these solutions, including things like electronic components that are all mounted to and become an integral portion of a rail mounting system of one sort or another, that receive their power from, as well as all of their wired electronic communication between their components from, rendering these systems or devices not only exclusive to themselves, which not only limit versatility and range of application, but also create additional problems of dependability, in that all of their components are dependent on each other to work as a functioning unit. Meaning that all that it takes to render these prior solutions as useless is for one of these components to stop working, due to something as simple a short, or lost connection in the mounting system because of contaminants or even just from water intrusion, to render their whole system as useless.

Other very high-tech scopes that possess highly advanced computerized sighting systems that are not engineered as tactical sights but still possess very limited tactical abilities of this nature, can suffer from these same dependability problems, in that in all of their very high-tech complexity, the failure of one of their vast number of very high tech and exclusive components or connections would render the whole device as in operative. This, along with their extremely high cost.

Furthermore, not only are these other current solutions very expensive because of their expensive and exclusive, that not only limits their versatility, portability, and range of application, but also creates additional problems of dependability, with all of these components being dependent on each other to work as a functioning unit, which even adds additional expense of the cost of repair, service, and maintenance of these systems, quite often making them unaffordable for most small entities such has militias, microstates, police departments, or even our own military for that matter, when the number of these other current solutions needed to properly supply our troops are considered, and the price of doing so.

Much of the prior art is also found to be severely lacking in their overall technical abilities. That forethought and innovative engineering directed towards something simple as the incorporation of a common smart device which may have been a better choice, as an electronic and technology source if possibly applicable to their solution, which would enable them with a vast number of other extremely useful abilities, as well as their range of use and most importantly, the range of safety providing abilities, that they could have possibly offered the user. Of course, no degree of electronic sophistication can make up for a lack of vision, innovation, forethought and creative engineering. But the added abilities of a very high-tech computer, which a smart device actually is, can radically expand other electronic devices' abilities, if applicable to their solution, and initially engineered to integrate into their solution.

All of the prior art exhibits problems or deficiencies of one sort or another, with all not only found lacking in their range of versatility, applicability and portability but also in their range safety providing services, that they actually provide to the user.

Another serious advantage that the applicants tactical red dot or reflex camera sights and their accessories that comprise this camera sight system has over the prior art would be in the radically advanced abilities provided by the new type of red dot or reflex type of camera sight invented by the applicant, that provides far superior sighting abilities than any other reflex type sight previously devised or any other type of sight for that matter, tactical or nontactical. This, not only due to these reflex camera sights special abilities, which are significant, but in that of their vast range of versatility, adaptability, and overall range of abilities that no other type of sight has been able to accomplish before now, more of which being discovered on a regular basis. Especially as these new reflex type of camera sights, as well as their accessories progress in their further development as the applicant, continuously presses forward, both in that of innovative engineering as well as to take advantage of any new technology to ever improve and further expand and enhance these tactical camera sights abilities, to provide the maximum degree of safety providing abilities to those that put their lives on the line daily to preserve the safety and freedoms of the rest of those in this nation, far too often take for granted. This, the applicant being only too aware of being a Vietnam veteran himself, and experiencing the loss of many of his friends during that conflict.

The range of abilities provided by these tactical reflex camera sights, are almost endless, but the added benefits and abilities that a smart device provides these reflex camera sights, is significant, not only in all of the abilities and services that a computer provides for these sights, such as of the abilities that sighting apps. provide, there are being far too many to list, but also, in added abilities in communication, recording, G.P.S. and others, but the greatest ability that these smart devices provide to these reflex or red dot camera sights both tactical and nontactical is in their sight screen itself, being not only many times larger, with the target reticle always being perfectly centered in the screen of the smart device, this, but also in the mode that these red dot or reflex camera sights receive their image. This with their camera's lens mounted in a close enough proximity to the forward viewing window, inside these camera sights that is provided by the camera sight, of a wide view of the area, with the target reticle always remaining perfectly centered in the screen, so that all that the user needs to do to aim the firearm, is to simply center the target in the smart device screen behind the reticle. This, in turn, provides the user with extremely fast, accurate, and easy target acquisition, of which is of great benefit.

But it's the full scope of these camera sights, this, along with the added ability of the rear viewing camera, that becomes an integral component of the rotatable smart device mount. This, providing the user with a full view of his surroundings to be made aware of the potential dangers there in, along with the very fast and easy target acquisition, is a very significant advantage over the conventional red dot or reflex type sights that our armed forces are provided with now. This, in that the method of use for these sights entails the user to first locate the target by looking through a sight window that ranges between 1" to 1⅜" inches in diameter to locate the target in the very narrow field of view that these conventional reflex or red dot type sights provide, then find the reticle and line it up with the target, which is not only inefficient, but requires time when time is absolutely critical to the users survival.

These reflex type camera sights abilities have been even much further expanded and enhanced since their first functioning prototype was developed, almost three years ago, with several additional types of these reflex type camera sights that radically surpass the abilities of their originally engineered type, with even another presently being developed that will significantly surpass the abilities of its predecessors.

Although even the applicants first engineered type of these reflex camera sights, in their simplest design, seriously outperformed the prior art in tactical abilities. In that, these much less complex but still highly functional tactical reflex camera sights can be easily manufactured with readily available components, in sizes smaller, the diameter a quarter and approximately 2 inches long, with an extended run time, and that still possess infrared or night viewing abilities, that can still be employed on almost any type of firearm whether rifle or pistol availed to our armed forces or law enforcement, and be sighted in and mounted totally out of the way of any of the other target viewing devices or other firearm accessories, mounted on the top or bottom of the firearm; but this smaller, more simplistic camera sight also lends itself well when mounted on primarily the bottom mounting rails of pistols, remaining easily holster-able, with its target image being viewed either on the screen of a hand held smart phone or by means of computer glasses or computer watch such as google eye or I watch.

This along with the added tactical abilities that the various camera type options that are employable in these tactical camera sights, provide them with abilities such as resolution ratings of 5-× and greater. These tactical camera sights are engineered in a way that the camera is positionally mounted in the camera sight housing that positions the camera lens in a close enough position behind the reflected reticle, reflected off of the center of the inside surface of the front viewing window, to attain a wide field of view through the front viewing window. This provides the user with the ability to not only view an entire area of potential danger, to not only locate the point of fire while under attack, but to also surveil the entire area of potential danger for things like advancing hostile combatants, or other developing enemy scenarios, from a smart device screen with the target reticle always remaining perfectly centered in the screen of the smart device, providing the soldier with extremely fast and easy target acquisition.

These new types of tactical red dot or type of tactical reflex camera sights tactical and safety providing abilities are additionally multiplied and expanded in their range of versatility, applicability and range of function, when used in conjunction with the various tactical camera sight accessories engineered to work in conjunction with these various types of tactical camera sights the two different types of rotatable smart device mounts, with one being mountable to the side mounting rail of the firearm which allow the soldier that provides the user with the abilities devised to provide the user with an optional clear lineal view down the center of the upper portion of the firearm, and engineered to be used in conjunction with the types of these tactical red dot type of reflex camera sights that function in two modes, both as a tactical reflex red dot or camera sight or optionally as a conventional reflex or sight, as well as for the soldier to easily view other equipment mounted on the mounting rails of the firearm such as range finders scopes etc., as well as a smart device mount that mounts on the top mounting rail of the firearm. Both of these smart device mounts are horizontally rotatable and lockable into a plurality of viewing angles to a full radius of 360 degrees, with the side mountable smart devise mount is additionally vertically rotatable and lockable into a plurality of angular positions as well. This provides the soldier with the ability to maintain a clear view of the smart device screen from any position the soldier could place himself in relation to the firearm. This smart device mount is additionally equipped with an original rear viewing camera that is positionally adjustable on its own height and angle adjustable armature that enables this rear viewing camera to be positionally adjusted to acquire and to maintain this rear viewing camera in its best vantage point both to the rear viewing camera as well as to the soldier of the aria behind him as well at all times at all times. so in other words this smart device with its rear viewing camera provides the soldier with a view of his entire surroundings for approaching dangers at all times.

Another camera sight accessory that adds tremendous tactical and safety providing abilities to this camera sight system is a sight adjustable and rotatable camera sight mount that is also rotatable and locks into a plurality of positions to a full radios of 360 degrees that intern provides the soldier with the ability to simply extend the muzzle of the firearm where this rotatable camera sight would be mounted out past the edge of a building around or over the edge of an armored vehicle, berm trench, tree, or other where the soldier has taken cover. Which enables the soldier with the ability to surveil and maintain a visual of the entire area of potential danger even while under heavy incoming fire, to locate the point of fire as well as to maintain a visual for other impending dangers such as advancing hostile combatants or other developing enemy scenarios. Then if deemed necessary to the survival of the soldier and others in his group to engage same by simply by locking the rotatable camera sight back into its sighted in position and engaging same, from any position the user would have to position himself in relation to the firearm. This while maintaining a visual of the area, and the target in the smart device screen. All while remaining totally behind protective cover and maintaining a visual of his entire area and out of the line of fire while doing so. This being only one of the several ways that these tactical camera sights and their various accessories are used in their various combinations and applications to achieve the same results.

By far, the largest problem and deficiencies of the prior art would not only in their lack of tactical and safety providing, abilities that they actually provide to our armed forces but primarily due to their severe lack of versatility, and adaptability, to the many different types of firearms employed by our armed forces and law enforcement where their desperately needed. This is why the applicant has directed all of his efforts in the development of all of these various types of camera sights as well as the many different types of camera sight accessories that even further enhance these red dot or type of reflex camera sights overall range of application and abilities. All of these various types of camera sights and their accessories work to gather in various combinations to best fulfill the needs and to best complete the task, of providing the upmost level of safety, and tactical providing abilities, to any and all of the various types of firearms employed by our armed forces and law enforcement. From the various standard issue rifles, pistols, and even grenade launchers, and R.P.G's, employed by our ground forces, to the numerous and various types of fully automatic pistols and other specialty firearms employed by our special forces, the secret service or, S.W.A.T. teams etc. to even sniper rifles. All of which will not only make this country's defense forces much more efficient and effective, but will provide them, with an advanced level of control and safety providing abilities at all times. This all while performing a vast range of duties required of them from the least to the absolute most dangerous of these duties, that the performance of which have historically resulted in a tremendous number of U.S. casualties.

Applicant's present invention is a device that avails the user with the full use of the firearm, from a safe, secure position, superior to the, highly complex and extremely expensive currently available present solutions even though applicant's core device is relatively simple and inexpensive to produce, with the smart phone or tablet mount on this device having the ability to rotate and lock into various positions so that the image provided by this device can be viewed from basically any position user would place himself in relation to the firearm with the target image always remaining positioned perfectly centered in the smart phone or smart device's screen behind the reticle. This allows for extremely fast and easy target acquisition This along with the added abilities that the secondary camera that's mount is an integral part of the smart phone mount on these devices that provide the user with the ability to maintain a continuous visual of the aria behind the user at all times also to see approaching hostile combatants or other developing enemy scenarios will probably prove to save many lives as well.

Another added advantages of using a smart phone or small tablet as a viewing screen adds tremendous sighting abilities as well, in that instead of having to find the target by looking through what's usually only approximately a I inch to a 1⅓ inch viewing window in a reflex type sight or scope and then having to find and line up the target with the reticle as well as locating the target in the first place with a very small and restricted field of view is both ineffective as well as time consuming, This when time is very critical, These camera sights on the other hand operate in a completely different mode, with the target reticle always remaining perfectly. cantered in the smart devices screen not only provides the user with extremely fast and accurate target acquisition. This along with the smart devices camera providing the user with a wide field of view of the surrounding area at the same time provides the user with the ability to locate and access other potential dangers as well such as advancing hostile forces, and developing enemy scenarios. This along with the smart device's mounts' ability to employ any type or size of smart phone as well as small to medium sized tablets, that's rotatable and viewable from any position that the user could place himself in relation to the firearm while maintaining a constant visual of the area behind the user at the same. This along with the added safety providing abilities that the rotatable camera sight mount offers the user with its ability to surveil areas as well as engage targets when absolutely necessary to the survival of our troops.

Applicant's device also offers the user many additional tactical advantages as well such as the ability to also use this device in conjunction with other smart devices such as computer watches such as iWatch or computer glasses such as Google Eye, or computer goggles. As well as large computers to sigh in the device.

Applicant's device also has night vision capabilities as well, when using these devices in conjunction with an infrared illuminator, or using these inventions that have infrared illuminators incorporated into their design that work in conjunction with the infra-red viewing cameras that these camera sights employ, as well as other sight enhancing abilities, such as the application of numerous sighting apps, as well as features including the smart phone or tablet's ability to record photos and video for evidentiary use, and maintaining communications with other personnel, also using GPS, to report enemy positions or call in air strikes etc. Also, the target image can also be brought up on a regular computer screen such as a laptop to sight this device in.

SUMMARY OF THE INVENTION

This application is a continuation in part to a non-provisional patent application submitted Nov. 16, 2016, named CAMERA SIGHT DEVICE FOR A WEAPON, which is a patent application for a tactical camera sight system including various types of tactical reflex or red dot type of camera sights, as well as several tactical red dot or reflex camera sight accessories. The cameras employed in these tactical red dot or reflex type of camera sights all possess high definition imaging as well as digital image transmitting abilities, and infrared viewing, as well as far too many other abilities to mention.

This continuation application includes several modifications and improvements to these camera sight accessories, as well as to the red dot or reflex type camera sights themselves. The new material also consisting of secondary accessories that mount on and become an integral components of other camera sight accessories, and yet other camera sight accessories, that have been modified either with better engineered components, or improved mechanical composition of components. All of these engineered improvements and additions significantly improve, enhance and broaden these red dots or reflex type of camera sights and their accessories' range of use and abilities. These mechanical modifications and additions where engineered to operate in a more efficient and effective manner as well as to provide an even broader and more effective range of safety-providing abilities to the user.

Also included in this continuation application are references to various types of cameras that the applicant has recently been researching and testing that provide advanced imaging abilities as well. Also included in this continuation in part application, are engineered improvements of the two different types of smart device mounts, referred to as smart device mounts 5000 in their original patent application (CAMERA SIGHT DEVICE FOR A WEAPON). The two variations of this smart device mount possess many similarities. Both of these smart device mounts are rotatable on their own platform that make up the upper most portion of the rail mount, that secures this device to the mounting rail of the firearm, and are rotatable thereon to provide the user with a full view of the smart device screen from any position that the user could position himself in relation to the firearm to a full 360 degree radios of the firearm, and is secured in and out of its preferred angle of rotation by means of a finger pull that is simply pulled to unlock the smart device and its mount out of its particular position of rotation, and then released to lock the smart device into its mounting base into its desired position or angle of adjustment, to provide the best vantage point of the smart device's screen to the user The smart phone or tablet that mounts on this smart device mount is rotate-ably adjustable on this mount to a full radius of 360 degrees, allowing the user to position the smart phone or smart device to any viewing angle.

The first of these rotatable smart device mounts would be the smart device mount engineered to be mountable on the upper or top mounting rail of the firearm. The new material documented in this continuation in part pertaining to this embodiment of this multi-angularly adjustable smart device that mounts on the top mounting rail of the firearm, would primarily consist of both its internal components that provide this device with a much more solid and fluid operating rotatable platform, as well as a mounting base for an additional rear viewing camera, that would be made as an integral portion of the top portion of the back side of the smart device mount.

The second smart device mount, being the smart device mount that mounts on the side rail of the firearm. This smart device mount has also had similar changes of the basic engineered internal components that provide a much more solid or rigid and smooth or fluid mode of operation. This smart device mount, that mounts on the side mounting rail of the firearm, has had many other changes to its original engineered design as well. These changes consist of an additional rotatable platform that provides the user with the ability to much more easily view the smart device's screen while surveilling an area overhead, such as over a wall or vehicle, or underneath vehicles, or from any other position the user would or could position himself in relation to the firearm, as well as with the ability to rotate the smart device downward, and additionally rotate the smart device inward, to store the smart device and its mounting platform out of the way when not in use. This, in that this newly engineered smart device mount, that mounts on the side mounting rail of the firearm, is engineered in a manner that the base of both rotatable platforms is one component, that is rotatable on the upper mounting platform, that is an integral portion of the top of the side mountable rail mount. This device is engineered in a manner, that the upper platform that the smart device mount rotates on, allows the smart device and its mounting platform to just clear or rotate over the upper surface of the top mounting rail of the firearm. This allows the smart device to be rotatable to a full radius of 360 degrees, so that the smart device is viewable from any position the user would place himself in relation to the firearm. This side mountable smart device mount was primarily engineered to work in conjunction with both the parallax free type of camera sight that possess the ability to operate as a camera sight as well as a regular parallax free red dot or holographic sight at the same time as well as the type of camera sight referred to as camera sight 2000, in the original patent application, that performs like a regular red dot or reflex sight or optionally as a camera sight. This, in that the side mounted smart device would possess the ability to maintain a clear view down the center of the firearm, to either use these dual functioning red dot or holographic type of reflex camera sights in the conventional manner, as well as to view other target viewing devices on the firearm.

Both the top and the side rotatable smart device mounts provide the user with the abilities to rotate the smartphone or small tablet and lock it into any desired angle, to surveil the area by viewing the image provided by the camera sight to the smart device from any position that the user would need to position himself in relation to the firearm, while remaining totally behind protective cover while doing so. These angularly adjustable smart device mounts are additionally equipped with a rear viewing camera, that additionally provides the user with the ability to maintain a full visual of the area behind the user at the same time with the use of this rear viewing camera, that would be made as an integral component of this rotatable smart device mount with the camera portion of this device always receiving its image 180 degrees or directly behind the viewing screen of the smart device mounted in the smart device's mounting platform. This additional positionally adjustable rear viewing camera would be an integral part of a positionally adjustable armature.

These cameras are illustrated as two different types that operate and supply the image of the area behind the user in two different manners, one of which would supply its image and be viewable in a separate window or split screen of the same smart device that would be mounted in the smart device mount that is an integral part of this device. The other type of rear viewing camera illustrated in this continuation in part would be an integral part of its own small smart device that would simply be much like a very small smart phone or tablet with an infrared viewable camera, housed in an upper raised portion of the device's housing, along with one or more infrared illuminating bulbs, that would be optionally illuminated, to provide this device with night viewing abilities as well. This rear viewing camera with its own viewing screen and power source, would also possess no communication, internet or WI-FI transmitting or receiving abilities, but would simply be a tiny high resolution infrared camera with both zooming and viewing angle adjustability, as well as possibly recording abilities like any other smart device that employs a camera, except the only other differences with this small smart device would be an integral part of a position adjustable armature, that would allow the user to position the camera with its own integral viewing screen in their best operational position to both acquire the best vantage point for both its rear viewing camera to surveil the area behind the user, as well as to the user's vantage point of the rear viewing camera's viewing screen to the user.

These rear viewing cameras would provide an additional level of safety, especially to our troops, having to deal with the challenges that urban warfare presents and the ongoing threat of hostile combatants approaching from any direction.

This, along with this tactical red dot or reflex camera sight system's original abilities, which are only expanded and enhanced by means of the improvements listed by number in this continuation in part, which possess the abilities to provide a new level of safety and control to our troops that could potentially prevent a tremendous number of U.S. casualties.

Also listed in this continuation in part are optional changes in the rotatable and sight adjustable rail mount 4000, that would be made as an integral part of the various types of reflex or red dot type camera sights, listed in this continuation in part, contains changes that may or may not be implemented, such as the mounting position of the locking mechanism's mechanical components located on the bottom rather than the top of the round disc portions of the device, as well as other changes that possess a much higher probability or that possess an absolute certainty to change, such as the mechanical orientation of some of these same mechanical components. This simple change, that only changes the finger pulls' direction of actuation of the jaw type latches that engage and disengage the camera sight's rotating ability, provides a tremendous degree of operational ease, in that, by doing so, the rotational adjustment of the red dot or reflex type of camera sight, that would be made as an integral portion of this sight adjustable and rotatable rail mount, could be easily and routinely accomplished, by means of the simple grasping of the sight housing and the finger pull at the same time, and in the same motion rotating and releasing the camera sight into its desired point of rotation. This is significant not just in ease of operation, but in that of seconds saved. This, in that, quite often when this action is needed to be accomplished, time to do so is critical to the actual survival of the user.

The main objective of the modifications and improvements, as well as the additional embodiments included in this continuation in part for these red dot or reflex type camera sights described in the patent application camera sight device for a weapon, is to ever improve and enhance the overall range of function and abilities, and expand the safety providing abilities of these tactical reflex or red dot type of camera sights and camera sight accessories, to provide our troops, law enforcement and others, with the maximum level of safety and control providing abilities, not limited to the ability to surveil areas, or the ability to locate and engage hostile enemy combatants while under fire from same, to the survival of our troops, while remaining totally behind protective cover. But also, with the numerous other safety providing abilities, that it will provide not only for our armed forces but also for the other personnel such as that of law enforcement, such as S.W.A.T., the secret service and others, that put their lives on the line every day, to provide the safety and preserve the freedom, for the people of this great nation.

Another objective of the applicant of this continuation in part, is to provide additional, and improve the existing, accessory smart phone or smart device mounts, and provide superior tactical sighting abilities, by ever improving and expanding their abilities and range of function, that are adjustable and rotatable for multiple configurations, to accurately use the firearm from any position the user could position himself in relation to the firearm, with a greater degree of ease and efficiency.

It is another objective of the present invention to provide improved firearm sights, and more efficient rotatable firearm sight mounts and rotatable and multi position able smart device mounts for firearms, that improve viewing of targets provided by its own sight adjustable camera sight, with the smart phone or tablet rotated into various viewing positions relative to the firearm, thereby providing the user with a wide, unobstructed view of an area, in the screen of the smart device, providing the user with the ability to surveil an area in a theater of combat to reveal origins of incoming fire, advancing hostile combatants, developing enemy scenarios, sniper positions, etc. as well as to accurately engage same if absolutely necessary, if the threat presents an imminent danger to our troops and the decision is made to do so. This, all from a safe, secure position with the user's entire body remaining behind protective cover such as from behind walls, trees, buildings, vehicles, trenches, berms etc. without exposing the user as a target while doing so, with the maximum degree and range of safety, efficiency, and overall use.

It is yet another objective of the present invention to provide, and improve, tactical reflex or red dot or holographic type camera sights, and tactical camera sight accessories, that that maximize the range, ease, efficiency, adaptability versatility and overall use, to provide the maximum level of safety and control to our armed forces and others, that is both extremely operationally efficient, while remaining simplistic, in the mechanical composition of their engineered components and mode of function. This, providing the ability to manufacture these tactical red dot or reflex type camera sights and their accessories, that are not only dependable and very low maintenance, but also lowering manufacturing cost.

It is yet another objective of the present invention to provide a soldier with a view of his entire surroundings, including the area behind the user, to provide our troops with the ability to monitor advancing enemy troops, or other developing enemy scenarios or impending dangers, not only from in front or to either side of the user, but also while maintaining a constant visual of the area behind the user at the same time, to alert the user of approaching dangers from behind, as well even from a position of full protective cover.

It is yet another objective of the present invention to provide a soldier or law enforcement with a view of his entire surroundings, including the area behind the user, from full protective cover at night as well as during the day, with very effective night viewing abilities.

It is yet another objective of the present inventions described in this continuation in part to provide advanced tactical firearm sights and firearm sighting systems, for firearms that are small and light, yet possess a wide range of safety providing abilities that are also highly versatile, quickly and easily attachable, portable, and more importantly, applicable to any type of firearm employed by our military, both that of ground troops and special forces, as well as all types of firearms employed by our law enforcement, and secret service personnel.

Finally, it is an objective of the present invention to provide an improved tactical accessory smart phone and camera sight mounts and red dot or reflex type camera sight systems for firearms, that incorporates all of the above-mentioned functions, abilities, objects, and features.

In accordance with these and other objects which will become apparent hereafter, the instant invention will now be described with particular reference to accompanying drawings.

BRIEF DESCRIPTION OF THE DRAWINGS

Embodiments of the present application are described herein in which similar elements are given similar reference characters, and a more complete understanding of the present invention, and the attendant advantages and features thereof, will be more readily understood by reference to the following detailed description when considered in conjunction with the accompanying drawings wherein:

FIGS. 1A and 1B are a miniature block camera and its internal circuit boards applicable in camera sights, in accordance with the principles of the present embodiment.

FIG. 4 is a profile view of a reflex type camera sight with an internal sight adjustable tube, in accordance with the principles of the present embodiment.

FIG. 5 is a profile view of a reflex or holographic camera sight in accordance with the principles of the present embodiment.

FIG. 22A is the back side of a rear viewing camera that possess its own viewing screen and is mechanically attached to an armature that this device is both height and angularly adjusted on in accordance with the principles of the present embodiment.

FIG. 22B is a frontal view of a rear viewing camera that possess its own viewing screen and is mechanically attached to an armature that this device is both height and angularly adjusted on, in accordance with the principles of the present embodiment.

FIG. 23A is a profile view of a rear viewing camera that possess its own viewing screen and is mechanically attached to an armature that this device is both height and angularly adjusted on knob 5548 is provided for the attachment of and angular adjustment of the rear viewing camera itself, in accordance with the principles of the present embodiment.

FIG. 23B is a slightly off skew profile view of a rear viewing camera that possess its own viewing screen and is mechanically attached to an armature that this device is both height and angularly adjusted on knob 5548 is provided for the attachment of and angular adjustment of the rear viewing camera itself, in accordance with the principles of the present embodiment.

DETAILED DESCRIPTION OF THE INVENTION

Figure 2:
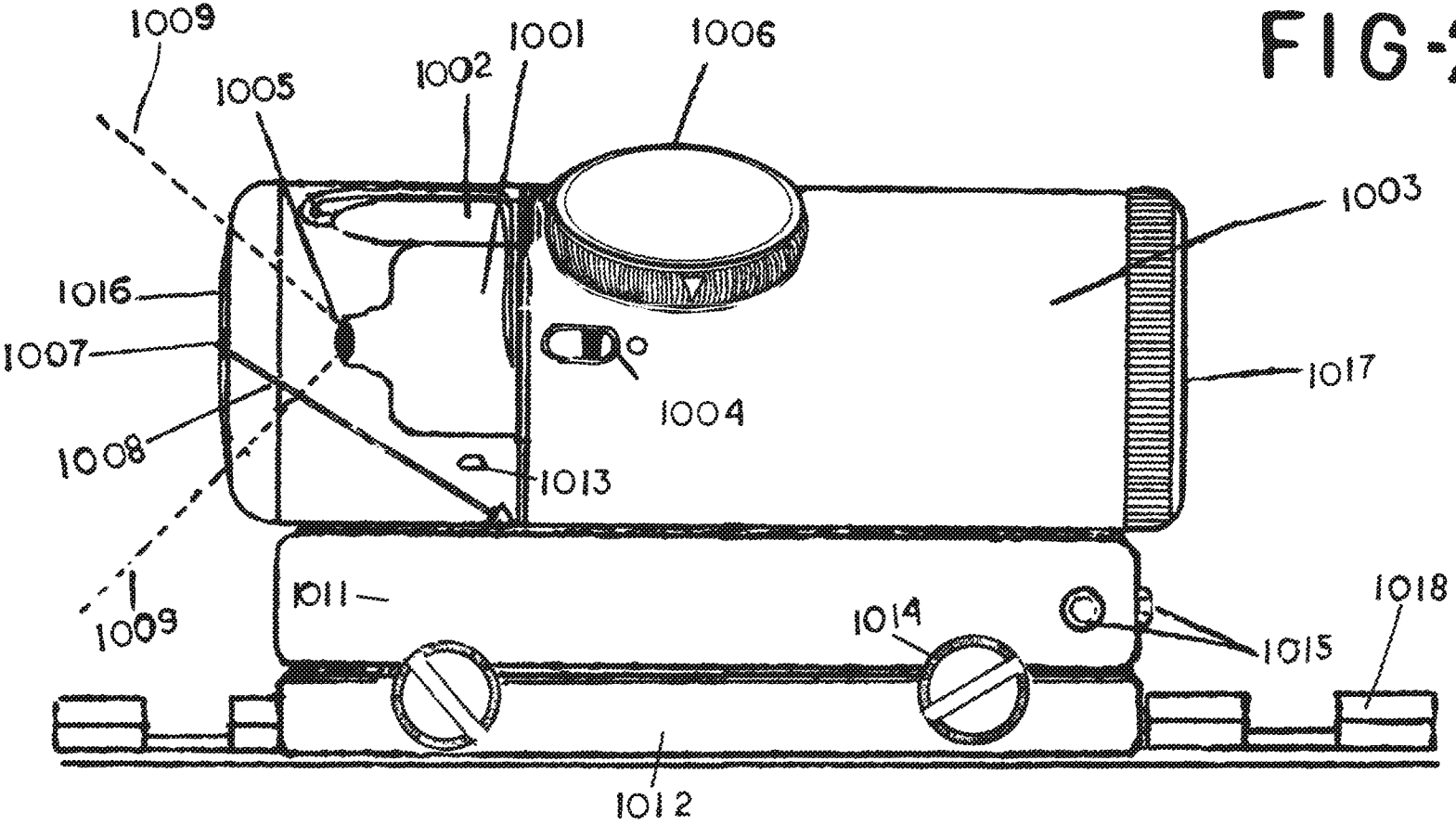
FIG. 2 is a basic reflex camera sight mounted on a firearm's mounting rail in a profile view, in accordance with the principles of the present embodiment.

The present invention advantageously provides tactical camera sighting system for attachment to a firearm for providing a tactical camera sight. The present invention contemplates various types of mounts and configurations of digitally displaying an accurate sight.

Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Referring now to the drawings figures in which like reference designators refer to like elements. FIG. 1A is a drawing of the type of camera 1001 that are also employable in the tactical red dot or reflex type camera sights These cameras would provide one of several means of providing these tactical camera sights with image enlargement, or zooming abilities. This in that a radio transmitted digital image, is presently not enlargeable by a smart device, meaning this image must be enlarged by the camera before this image is transmitted and viewable on the smart device. which this particular type of camera possess the ability to do. These cameras are presently available with resiliency ratings of 4 and 5×. and greater as well, meaning that this cameras image can be zoomed in many times while still maintaining relatively highly pixelated image. The housings of these cameras houses several tiny circuit boards containing the electronic components that give this camera its zooming ability. One down side to the zooming abilities of these cameras is that the controls for these zooming abilities would haft to be made on a separate control that present plans simply include integrating this control into the housing of the red dot or reflex type camera sight and simply be controllable there at. These compact HD cameras with digital zooming abilities are available with infrared viewing abilities as well as well providing these cameras with night viewing abilities like all of the other types of cameras employable in These red dot or reflex type camera sights.

The only setback to employing these cameras instead of the other mentioned very tiny non-image enlargement cameras, is only in applications where there would be size restrictions in that the cameras with zooming or image enlargement abilities are a bit larger physically in that the smallest of these that I had been able to locate on the market at that time were approximately one inch square which did not present an installation problem in any of the embodiments of these cameras sights. The only real setback to the employment of this type of cameras is that they require slightly more electrical draw which would either reduces run time. or would require a little bit larger battery compacity, although battery removal and replacement can be accomplished in seconds and dead batteries can be stored and recharged as well. These cameras are also more expensive as well, so the camera sights equipped with this type of camera providing its zooming capabilities would possibly be restricted to more expensive models of these camera sights. in accordance with the principles of the present embodiment.

FIG. 1-B is a drawing of the tiny circuit boards that are usually stacked one behind the other, inside the camera housing of FIG. 1-A. These circuit boards and their electronic components give this camera its zooming ability as well as other abilities These tiny circuit boards. are most commonly connected physically and electrically by tiny ribbon wires, 40, and are connected to its electrical switch or source by one tiny set of wires, 41. Then the camera is usually hard mounted and electronically connected to the circuit board, but this tiny camera, lens, and housing could be made or ordered with the electrical connection between the camera, lens, and lens housing, #43, being completed by tiny wiring loom, #42, so the camera lens, #43, could be properly positioned and mounted in the camera sight to receive the target image that would be there by received by the rest of the camera components and then transmitted to the smart phone or smart device. This camera being constructed in this manner allows for alternative mounting or housing options for the camera components as well in accordance with the principles of the present embodiment.

FIG. 2 shows an exemplary camera sight constructed in accordance with the principles of the present embodiment and designated generally as camera sight 1000. A HD infrared viewing miniature block type camera with zooming abilities, 1001, is hard mounted in a sight housing 1003 in a position such that a camera lens remains in a recitative position close enough to the forward viewing window 1016 to acquire a wide un obstructed view through this window, to provide, a wide field of view displayable in the viewing screen of the smart devise that's working in conjunction with this red dot or reflex type of camera sight. Camera lens 1005 is centered behind the reticle 1009. The reticle 1009 is reflected off the inside surface of the lens 1016 such that an image of a target behind the reticle 1009 and the surrounding area is transmitted from the camera sight 1000 to a smart phone or other viewing device that works in conjunction with camera sight 1000. In one non-limiting embodiment, the reticle 1009 that is reflected off the inside surface is perfectly centered on the screen of the viewing device. in accordance with the principles of the present embodiment.

The sight housing maintains a Wi-Fi transmitting module 1002. In one embodiment, the Wi-Fi transmitting module is separate from the camera 1001 wired to the transmitting module 1002. In another alternative and non-limiting embodiment, the HD infrared viewing camera with zooming capabilities 1001 is available with a combined Wi-Fi transmitting modules existing as a combined component of camera sight 1000. in accordance with the principles of the present embodiment.

Housing 1003 is integral with a top section of an upper rail mount 1011, the housing 1003 houses the working components of the camera sight 1000, including the camera Wi-Fi transmitting module 1002, batteries, and the like. On the outer surface of the housing 1003 is an on/off switch 1004 for turning the camera sight 1000 on and off. in accordance with the principles of the present embodiment.

Within the housing 1003 is a camera lens 1005, the camera lens 1005 is centered behind projected reticle 1007 whereby the reticle is reflected off of the inside of a window or lens such that as the user sights in the camera sight 1000 off the rail mount, the rail mount being integral to the camera sight, the user is sighting in the camera 1001. in accordance with the principles of the present embodiment.

Secured about the housing 1003 is a reticle selector 1006, the reticles selector 1006 functions as an on/off switch for sight reticle, as well as selects different types of reticles that are projected to inside of window or lens of the camera sight such as different types of dots, cross hairs in different sizes, and brightness intensities. The reticle selector is optionally powered by the batteries that are maintained within housing 1003. in accordance with the principles of the present embodiment. Projected reticle 1007 is reflected off the center of the inside window or lens. The projected reticle beam 1008 being projected onto the inside window and/or lens causing a projected reticle 1007 to be projected thereof. in accordance with the principles of the present embodiment.

The HD infrared viewing camera with zooming capabilities 1001 has a viewing angle, as exemplified by the dotted lines 1009 identifying an exemplary viewing angle of the camera 1001. The camera 1001 position relative to the forward window where this camera lens #1005 receives its target image is illustrated as being mounted far enough forward to acquire an un zoomed image with a wide field of view the maximum field of view that these zoomable miniature block cameras #1001 can initially start out at is determined by the mounting position of the camera and its lens #1005 This wide field of view provides the user with the abilities to surveille a much larger arid for potential dangers there in. This as well as to provide the user with very fast and easy target acquisition. The zooming abilities provide the user with much more accurate distant targeting as well with better surveilling abilities such as to reveal enemy combatants firing from distant roof tops etc. in accordance with the principles of the present embodiment.

The housing 1003 includes an indicator light for the on/off switch 1004 for indicating whether power is on or off for the camera sight. in accordance with the principles of the present embodiment.

The upper portion 1011 of the rail mount is part of or otherwise coupled with the housing 1003. The upper portion 1011 enables sight adjustment off of a lower section 1012 of the rail mount. The lower section 1012 of the rail mount attaches to camera sight 1000 to a rail 1018 of a weapon. in accordance with the principles of the present embodiment. A charging port 1013 is further provided about the housing for charging the camera sight 1000. A thumb screw 1014 positioned about the rail mount is operable to secure attachment of and removal of the camera sight from the rail 1018. One or more adjustment members 1015 and positioned about the upper portion 1011 for causing vertical and lateral sight adjustment, such that sight adjustments are made by rotating or otherwise interacting with the adjustment members 1015. When the adjustment members 1015 are twistable members, the adjustment members are turned clockwise or counter clockwise wither with an Allan wrench, screwdriver, or a person's fingers. in accordance with the principles of the present embodiment.

The camera sight 1000 includes a viewing window 1016 that the camera positioned within the housing 1003 receives image there through. The window 1016 would possess no magnification. in accordance with the principles of the present embodiment.

The housing further includes door 1017 or lid to a battery compartment for storing batteries capable of powering the camera sight 1000.

The rail 1018 is configured to mount to a rail of a weapon, including a handgun, assault weapon, or other like projectile based weapons as well as specialty weapons such as grenade launchers R.P.G.'s or the like.

Figure 3A:
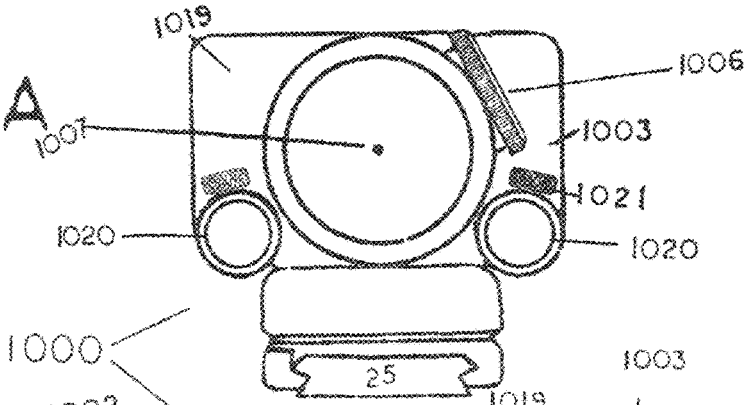
FIG. 3A is a forward view of a reflex camera sight with two infrared illuminators, in accordance with the principles of the present embodiment.
Figure 3B:
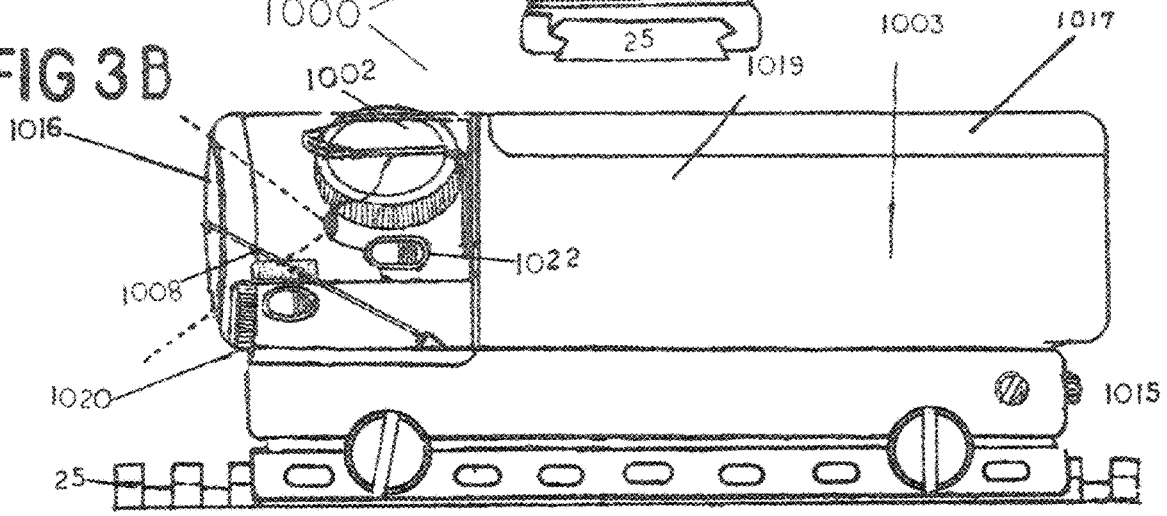
FIG. 3B is a profile view of a reflex type camera sight with two infrared illuminators, in accordance with the principles of the present embodiment.

FIG. 3A is an illustration depicting the front view of an alternative camera sight 1000, and FIG. 3B is depicting the side view of an alternative camera sight 1000 with two infrared illuminators 1020, an extra-large battery compartment 1019 for extra battery capacity incorporated into the sight housing 1003. The camera sight 1000 can be formed having one or more infrared illuminators capable of enhancing night viewing capabilities. The front section of the camera housing 1003 is illustrated as a forward part of the housing's internal components of the camera sight 1000. A HD infrared viewing miniature block camera with zooming capabilities 1001 is hard mounted in a sight housing 1003 in a position such that a camera lens 1005 is centered behind the reticle 1009. The reticle 1009 is reflected off the inside surface of the lens 1016 such that an image of a target behind the reticle 1009 and the surrounding area is transmitted from the camera sight 1000 to a smart phone or other viewing device that works in conjunction with camera sight 1000. In one non-limiting embodiment, the reticle 1009 that is reflected off the inside surface is perfectly centered on the screen of the viewing device. The sight housing maintains a Wi-Fi transmitting module 1002. In one embodiment, the Wi-Fi transmitting module is separate from the camera 1001 wired to the transmitting module 1002. In another alternative and non-limiting embodiment, the HD infrared viewing miniature block camera would have zooming capabilities. The beam controller 1021 may be rotated to control the beam width and/or the beam intensity.

FIG. 4 is an illustration of embodiment of camera sight 1000, the sight adjustments 1027 to sight adjust the camera sight 1000 to target by positioning the tube inside of the housing. A sight tube 1028 inside the housing houses the miniature block camera 1001, with infrared viewing and zooming capabilities that contains its own internal Wi-Fi transmitting module, and with reticle selector unit mounted to or made as an integral part of the housing of camera 1001. in accordance with the principles of the present embodiment.

FIG. 5 is an illustration of an embodiment of camera sight 1000 having a parallax free type camera sight, the camera 1001 does not have to be mounted directly behind the reticle and can be positioned anywhere where it can attain a clear view of the sight window without obstructing the view to the user when the sight is used in a conventional manner in that the reticle provided by the sight stays true to the target because of the parallax free sight design allowing for accurate targeting regardless of the angle or line of the sight that the target is being viewed in the sight window. The camera sight 1000 includes the housing 1003, vertical sight adjustments 1015, rail mount 1011, projected reticle beam 1008, lens and small bodied camera with infrared and zooming capabilities part of lens 1005, and rest of camera components 1001, a water tight lid 1017 to the battery component, an on/off switch for camera sight 1004, reticle selector 1006, and Wi-Fi transmitting module 1002. The viewing angle is depicted by dotted lines 1009. in accordance with the principles of the present embodiment.

Figure 6A:
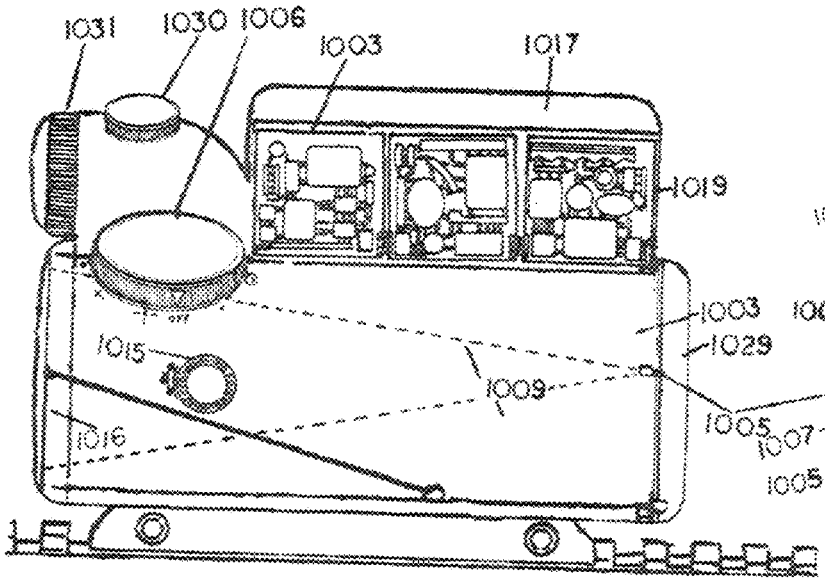
FIG. 6A is a profile view of a parallax free reflex camera sight equipped with a mini block camera in accordance with the principles of the present embodiment.
Figure 6B:
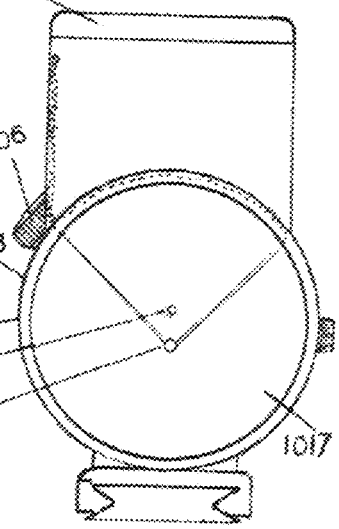
FIG. 6B is a frontal view of a reflex type parallax free camera sight camera sight, in accordance with the principles of the present embodiment.

FIG. 6 is an illustration of an embodiment of camera sight 1000 having a design of a low profile parallax free tube type reflex sight and works similar to the embodiment shown in FIG. 5, however, this design has an infrared or LED illuminator that has been incorporated into the design of this sight, which means that this sight would not have to work in conjunction with other infrared illuminators to have night viewing abilities but rather would work as a complete unit that works during both day and night conditions, the extra battery capacity located in the compartment 1019 behind the infrared illuminator would be used to supply power to both the infrared illuminator as well as the components of the miniature block camera with zooming capabilities in that the camera components that give the camera 1001 its zooming capabilities consisting of several tiny circuit boards and their electronic components housed between the outer wall of the camera housing 1003 and the internal wall of battery compartment 1019 are relatively low power consumption components. These tiny circuit boards could basically be housed anywhere inside the housing of this camera sight that would not obstruct or inhibit the normal function of the sight in that the tiny camera and lens housing 1005 of this camera can be wired separately into the rest of its components enabling this type of camera to be employed in these various types of parallax free camera sights. The cameras lens #1005 must remain hard wired to the rest of the electronic components as well. This illustration shows the wiring to this cameras lens # 1005 being housed in a very tiny channel or simply laminated behind a fine black line extending up from the bottom of the viewing window up to a slightly larger dot this would be the zoomable miniature block cameras lens the upper fine lines that make up a V and the very fine horizontal lines simply are there as references to help the user calculate targeting variables, such as for windage and drop. This, as well as to camouflage the camera lens and its wires of the embodiment of FIG. 6, includes a beam intensity control knob 1030, a projected beam angle of infrared illuminator 1031, water tight lid 1017, a battery compartment 1019, reticle selector 1006, camera components 1001, and Wi-Fi transmitting module 1002, adjustment members 1015, capable of horizontal and vertical adjustment, in accordance with the principles of the present embodiment.

Figure 7:
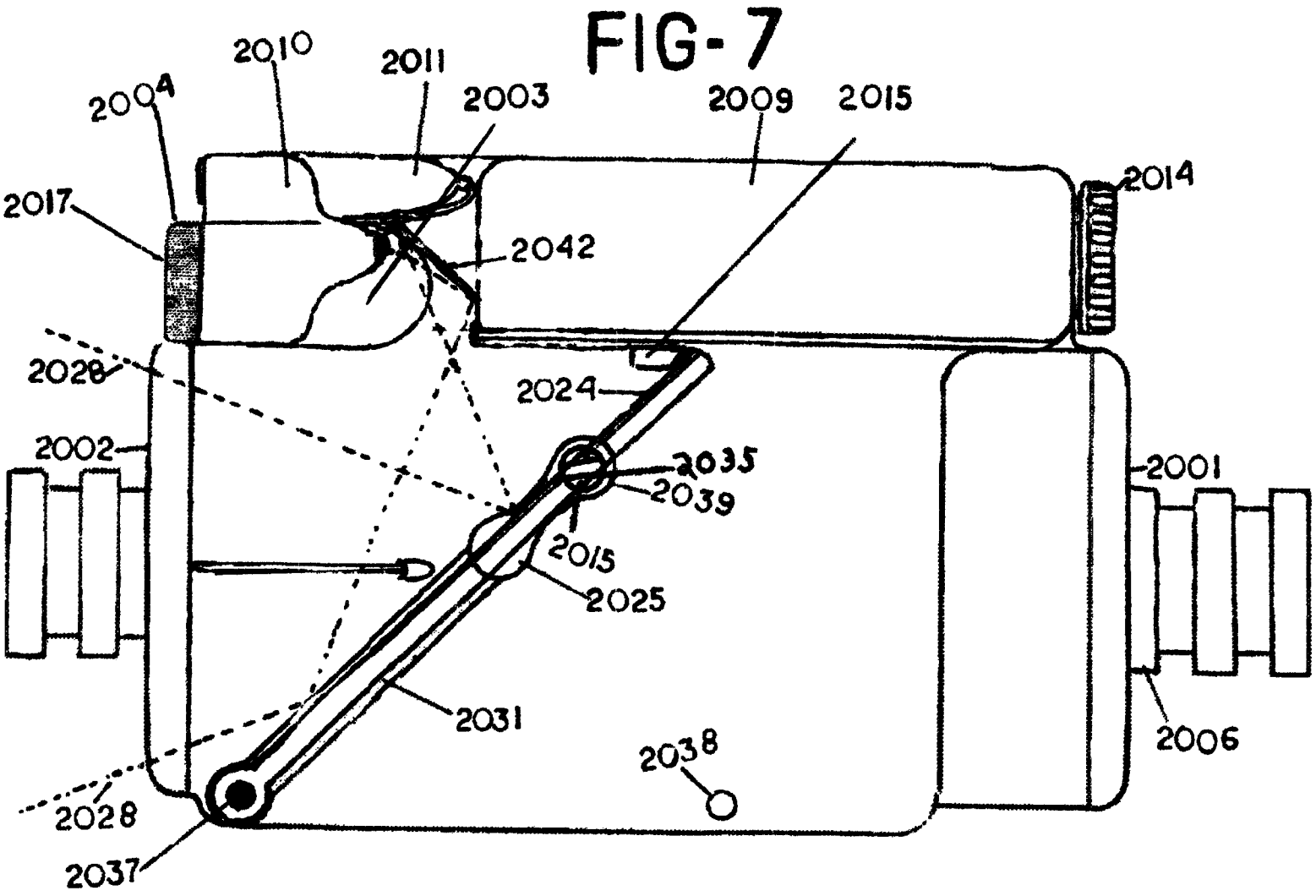
FIG. 7 is an overhead view of a reflex camera sight, with internal mirrors, that works in two modes, in accordance with the principles of the present embodiment.
Figures 8A, 8B:
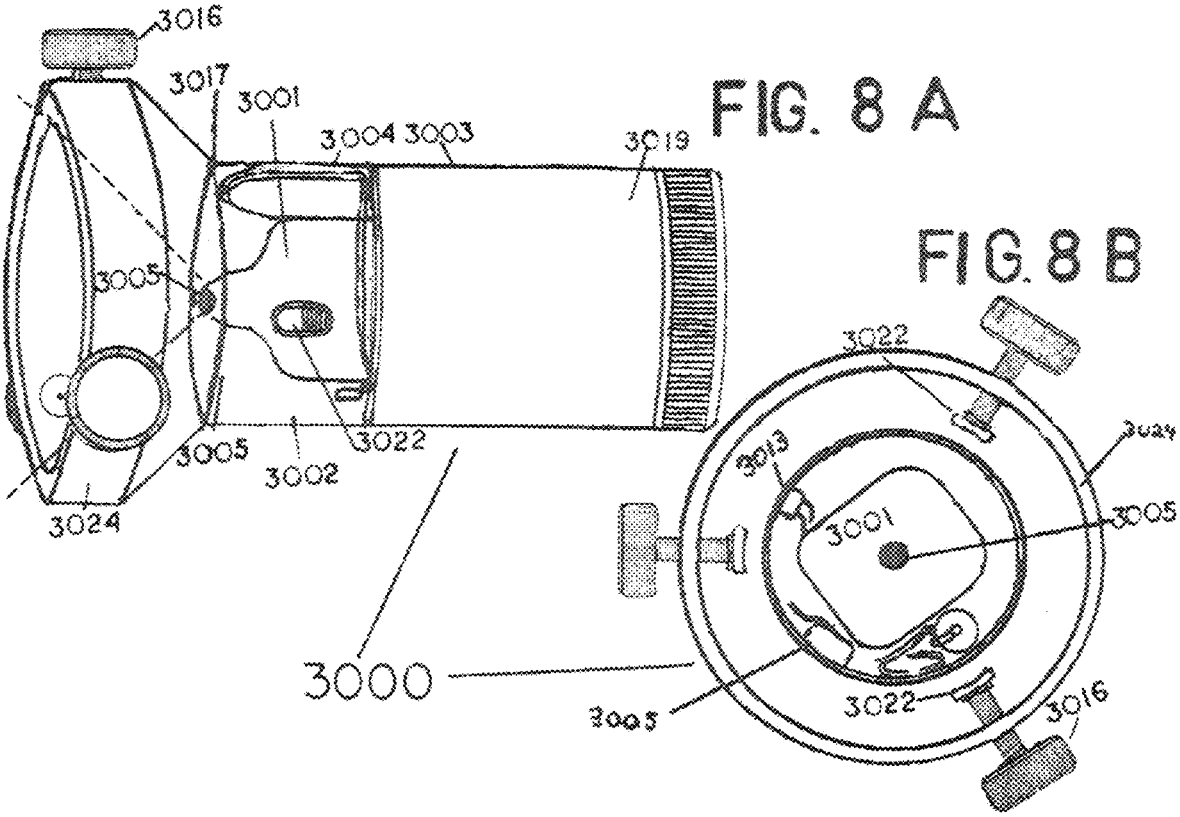
FIG. 8A is camera sight that attaches to a camera sight, in accordance with the principles of the present embodiment.
FIG. 8B is a frontal view of a camera housed in an attachable housing that receives its image from other sights in accordance with the principles of the present embodiment.

Now referring to FIG. 7 an embodiment of a sight device 2000 is shown as if housing of camera sight 2000 was transparent in order to view internal components. Camera sight 2000 employs two internal mirrors of the camera sight system that includes a zoomable miniature block camera 2010 mounted parallel to the sight housing. This camera sight operates both in a conventional manner as a regular reflex type sight as well as a camera sight. The front window 2002 of camera sight 2000 for the capturing a target therein, and a rear window 2001, allows the user to look through the sight device 2000 to view the target image supplied by front window 2002 of camera sight 2000 to locate and aim at target when using camera sight 2000 as a conventional reflex sight. Camera sight 2000 also has two internal mirrors that image entering front window 2002 as indicated by dotted lines 2028, reflects off of to be captured by camera, and in so doing, the image is first reflected off of mirror 2024, the image is reversed. But when the image is reflected off the second mirror 2042 the image is reversed once again back to its original state, or as it would be normally viewed, so that the image wirelessly transmitted to sight screen is viewed as a non-reversed image. Large mirror 2024 in main body of camera sight 2000 that initially capture image received entering into front window 2002 and reflects image to smaller mirror 2042, also turns camera sight on by engaging switch 2015, which is simply a momentary switch that is engaged by mirror 2024, when mirror 2024 is clicked into position of use. This is achieved with a spring-loaded ball located in housing of finger pull 2025. Which pops into an indent 2039 located in the proper position of upper housing of camera sight 2000. Mirror assembly pivots on main axle or pin 2037 which is connected to main mirror 2024, which is also an integral part of lever arm 2031. FIG. 7 is illustrated as if camera sight 2000 was in its position of use as a camera sight and is put back into operation as a regular reflex type sight by repositioning mirror 2024 by pulling mirror over and locking mirror 1024 into its position of nonuse. With mirror arm 2031 and mirror popped into second indent on top of mirror housing 2038. And in so doing, momentary switch 2015 turns off camera unit, Wi-Fi transmitting module, and camera sight 2000. Camera sight 2000 is used as regular red dot type sight by viewing image of target and surrounding area entering through front window 2002, from rear window 2001. Number 2003 is infra-red illuminator. Number 2025 is the handle that houses spring loaded ball 2015 which positions large mirror 2024 both in positions of use turning on miniature block camera 2010 with infrared viewing and zooming capabilities by engaging switch 2015 as well as positioning mirror 2024 into its position of non-use, and by doing so, enabling camera sight 2000 to be used as a regular reflex type sight in a conventional manner. in accordance with the principles of the present embodiment Referring now to FIG. 8A, a scope, red dot type sight, or other target viewing type device attachment 3000 is shown. In FIG. 8A, a side or profile view of target viewing device attachment 3000 is shown as if camera housing for attachment device and camera was transparent so inner components could be viewed. in accordance with the principles of the present embodiment FIG. 8B is a front view of target viewing device attachment 3000. Target viewing device 3000 includes a body 3003 which includes a battery compartment 3019 with a battery door 3017 access point for replacing the unit's batteries, and switch indication light 3022, and an on/off switch 3004 for controlling power to the unit, a charging indication light 3013, and a charging port 3015, the body 3003 includes a front portion 3024, and the front portion 3024 includes a plurality of securement members 3016, such as thumbscrews. The thumbscrews 3016 are adjustably screwed for clamping with a target viewing device such as scope, red dot sight, or other. These thumb screws 3016 pass through the housing 3024 for clamping down against the viewing side of a target viewing device. These thumb screws 3016 include a small pad with rotatable joint 3022 to aid in securing target viewing device attachment 3000 to sight, scope or the like. The body 3003 maintains a central camera lens 3005 constructed and arranged to provide video feedback with wireless transmission to a smart device, the wireless transmission may include Wi-Fi transmission via a Wi-Fi module either built inside the camera or mounted separately inside the body 3003. Target viewing device attachment 3000 has an internal small HD infrared viewing miniature block camera 3001 with zooming capabilities and adapted to a Wi-Fi transmitting module provided for attachment about a scope 3021, or a red dot sight 3018, or other target viewing device is attachable to a target viewing device attachment 3000 optionally used in conjunction with infrared illuminators mounted separately on firearm rail system to provide night vision abilities to target viewing device, such as red dot sights and scopes, that target viewing device attachment 3000 is secured to and receiving image from and is removed from target viewing device via tightening or loosening the thumb screws 3016. Other shapes and physical configurations of the housing 3003 and attachment may be implemented within the spirit and scope of the instant invention. in accordance with the principles of the present embodiment.

Figure 9:
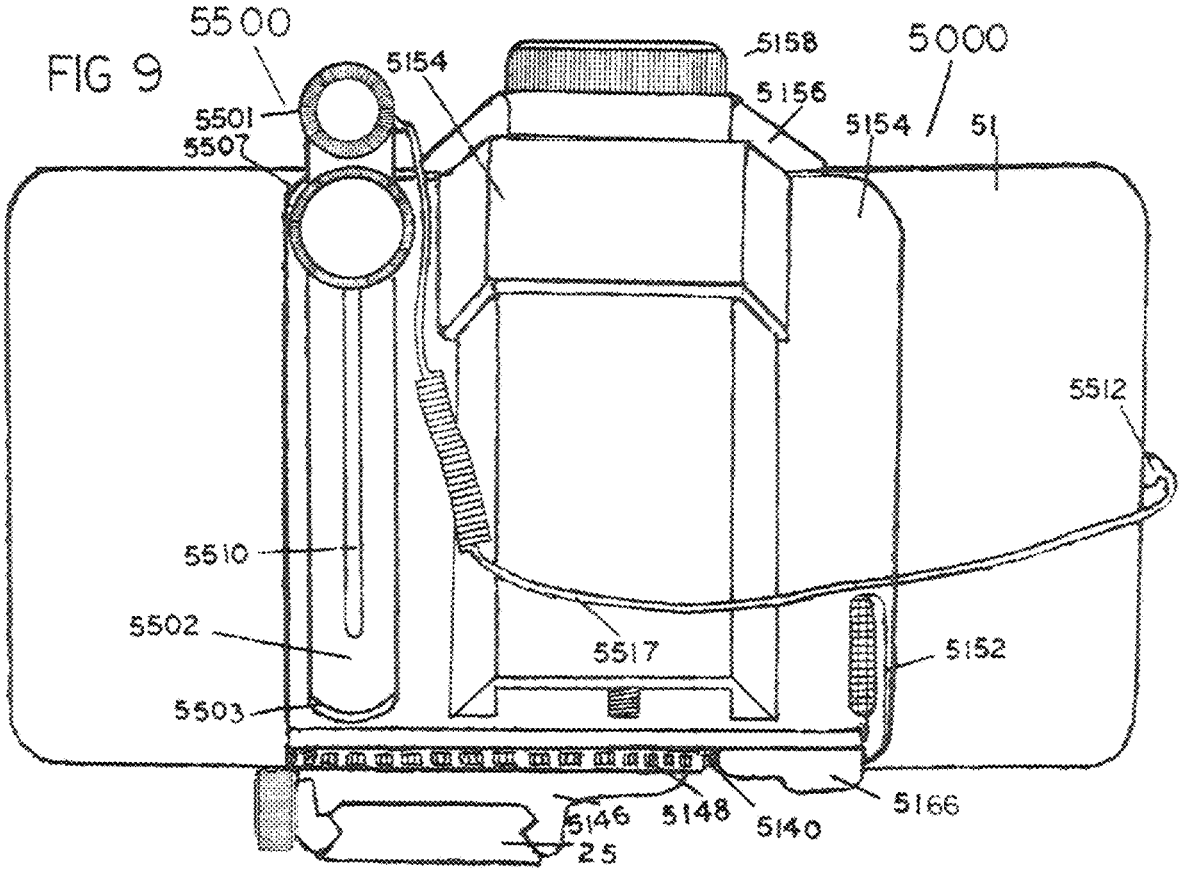
FIG. 9 is a backside view of a smart phone mounted in a rotatable mount with a rear viewing camera, in accordance with the principles of the present embodiment.

Referring to FIG. 9, other embodiments of the camera sight system would be rotatable smart phone mount 5000 and adjustable camera mount 5500 which when working in conjunction with one another provide the user with the ability to view the target image provided by either camera sights while using the screen of a smart phone or small tablet as a target screen from any position that the user could place himself in relationship to the firearm while maintaining full lineal view of the area behind himself at the same time while doing so, in accordance with the principles of the present embodiment.

Referring now to smart phone mount or smart device mount 5000 of FIG. 9 in an embodiment taught herein. Smart phone or small tablet mount 5000 provides the user with the ability to use the smart phone or tablet screen as a sight screen for camera sights and solidly attaches a smart phone or small tablet to the rail system of a firearm and provides the user with the ability to rotate the smart phone or small tablet a full 360 degrees to allow targets to be viewed from basically any position that the user would place himself in relation to the firearm both to locate targets of potential danger, such as advancing hostile forces, as well as to accurately engage same if the decision is made to do so, from a safe secure position, such as from behind a wall, building, tree, armored vehicle or the like, in accordance with the principles of the present embodiment.

FIG. 9 illustrates a backside view of a rotatable smart phone rail mount device 5000 for maintaining a smartphone 51 in an embodiment taught herein about a weapons rail 25. The rail mount device 5000 releasably secures to the weapons rail 25 of a firearm via a rail mount type assemblage which acts as a platform 5146 for rotatable smart phone mount 5000. The platform 5146 includes a plurality of holes or notches 5148 located around the perimeter of the upper fascia section thereof. An upper base 5154 is rotatably secured about the platform 5146. A latch housing 5150 is provided about a bottom portion of the upper base 5154 for maintaining at least a portion of the finger pull latch 5152 thereof. Latch housing 5150 containing a rod or pin integral to finger pull 5152 actuated by an internal spring housed inside the outboard section of latch housing 5150 that maintains tension to rod or pin 5140 into one of the plurality of notches 5148 located in the perimeter of the upper fascia section just below the upper platform 5146 of rail mount that the upper portion of smart phone or tablet mount 5000 is rotatably secured at various angles or positions of 360 degrees thereon.

The finger pull latch 5152 configured to lock into any of the plurality of notches 5148 for maintaining the upper base 5154 in a rotated position about the platform 5146 operatively positioning and securing a smartphone 51 display in a particular position about the rotating smart phone or tablet mount 5000. A tensioning member 5156 is disposed about the upper base 5154 for retaining a smartphone 51 about the upper base 5154. The tensioning member 5156, provided with a tensioning knob 5158, for rotatably securing the smartphone or small tablet 51 into a smart phone cradle, not shown, on the front side, about the lower portion of the upper base 5154 thereof. in accordance with the principles of the present embodiment.

FIGS. 9 through 24 illustrate position adjustable rear viewing camera mount 5500 which mounts to and works in conjunction with angle adjustable rotating smart phone mount 5000, enabling the user to maintain a clear lineal view behind himself as well as the target image provided by the camera sight that rotating angle adjustable smart phone mount 5000 is working in conjunction with, with both images viewable in same screen being viewed separately or simultaneously at the same time in real time on the smart phone or tablet screen mounted on angle adjustable smart phone mount 5000.

The types of cameras employed in these rear view adjustable cameras are of two basic different types. The cameras illustrated in FIGS. 9, 10, 13, and 15 as well as 20, 21, 22, 23, and 24 are of the same type found in devices such as bore scopes or endoscopes as well as a couple types of spy cameras as well as other. Their cameras transfer the image either by being hard wired or by connecting the camera to the smart phone smart device that it is working in conjunction with by cable and connections being made usually via a micro USB connector. These cameras are presently available in very high resolution models of 1080 pixels and greater and are available with infrared viewing capabilities as well and are of the type used in some of my earlier camera sight designs.

The differences between these cameras and the cameras found in camera sights as seen in FIGS. 1 through 8B as well as cameras deployed in some of my other camera sights that simply employ tiny spy cameras with WiFi transmitting modules is basically in their mode of image transfer and the components employed by these cameras allowing them to transmit or transfer the image, both of which have certain advantages and disadvantages to each other, such as the ability to enhance or enlarge images that are transmitted or transferred to the device that the image is being viewed on and whether this function is achieved by the type of camera that is being employed or by the device it is being viewed on as well as other considering factors such as these camera sights being used in military applications, the better choice could be that the type of camera that transmits its image by wire, in that, there could be no possibility of radio transmission being intercepted by enemy combatants, although, with the ability to secure the signal and only being able to access the signal by code or other, it would open up other advantages in a theater of combat, such as enabling others in their party to view the same target images in emerging combat scenarios as well as communications between others in their group. Of course all these factors would have to be further considered for the final designs of these devices for military applications. Other factors are those such as energy consumption which relates to battery run time as well as cost and availability of these cameras and their components that achieve the same results, but when all these things are considered in most applications, the better choice has almost always been those that transmit their image by WiFi and is the main reason that type of cameras that transmit their image by radio transmission was chosen in my other camera sight inventions. Another factor for WiFi being the better choice as far as image transmission between the camera sight and the target viewing device, is that in most applications, the cable itself radically restricts the range of use, adaptability, and overall function, in that not only does the cable itself restrict the overall range of viewing devices that these target sights work in conjunction with such as computer glasses, Google Eye, or computer watches or basically any other device that can be connected by Bluetooth but also this cabling gets in the way, restricts the ability of the target image being viewed on more than one device at once, as well as many other restrictions and inconveniences that the cabling causes which is why all of my other camera sights up to this point have been used in conjunction with their viewing devices by means of radio transmission, but, these type of cameras used in rear viewing camera 5500, seen in FIGS. 13, 15, 20, 21, 22, and 23 are of the type that transfer their image by cable and these would lend themselves well in this particular application. in accordance with the principles of the present embodiment FIGS. 16, 17, 18, and 19 are illustrations of position adjustable rear viewing camera and mount 5500 employing the same type of camera with a WiFi transmitting module employed by my other types of camera sights, with no sighting abilities in that this device is simply used for surveillance purposes. This camera would have its own battery supply and transmit its image by a different WiFi signal than the signal that the camera sight is transmitting its target image to the smart phone or smart device, when received by the smart device, the user can simply alternate between the two images on by means of programmed applications on smart phone or smart device or both signal can be viewed at the same time on the smart phone or smart device screen by use of other available downloaded applications. in accordance with the principles of the present embodiment.

Now referring to adjustable camera mount 5500 also illustrated in FIG. 9 consisting of a camera integral to a sliding height adjustable armature that both vertically and rotatably adjusts camera in a position to acquire a clear lineal view or to surveil the area behind the user at all times that rotating smart phone or tablet mount 5000 is being employed by user with this position adjustable rear viewing camera 5500 consisting of a video camera 5501 integral to an armature 5502. This armature 5502 being of a box beam type of configuration with a lineally cut out slot, extending from a point thereof, where the where the bottom of slot 5501, seen in FIG. 13 would abut the threaded rod 5505 and when armature 5502 is extended to its highest or maximum point of extension and this slot in armature 5502 would extend to a point in the other end thereof where the top of slot 5511 would abut threaded rod when armature 5502 is at its lowest point of adjustment knob 5507 used to rotatably secure box beam shaped armature 5502 being an integral working component or part thereof. Height adjustable rear viewing camera 5500 enables the user to maintain a clear lineal view of the area behind the user viewable also in the same smart phone or small tablet screen that is being used as the target screen, mountable in rotatable smart phone or tablet mount 5000, thus providing the user with the ability to maintain an even higher level of safety while locating, or returning fire from hostile combatants, from a safe, secure position such as from behind a wall, building, armored vehicle, tree or the like. The camera 5501, the housing of which being an integral part of the top of armature 5202 would be of a different type than employed in camera sights 1000, 2000, and 3000 or one of the other types employed in my other various types of camera sights, although the difference being a tiny HD infrared viewing video camera. This video camera employs or contains no Wi-Fi transmitting module but instead, the image from this camera would be provided by wire transference received via a wire cable from the camera and received by the smart phone or other smart device via a micro USB connector if going to a Droid or most smart phones or with the supply cable either being with or equipped with a plug adapter to an iPhone or other with the image from the camera 5501 being transferred by 5501 receivable to the smart phone via a free downloadable application and with this application, screen image is simply switched back and forth between each. There are also other available applications that both video images can be viewed in real time on a split screen. in accordance with the principles of the present embodiment.

Figure 10:
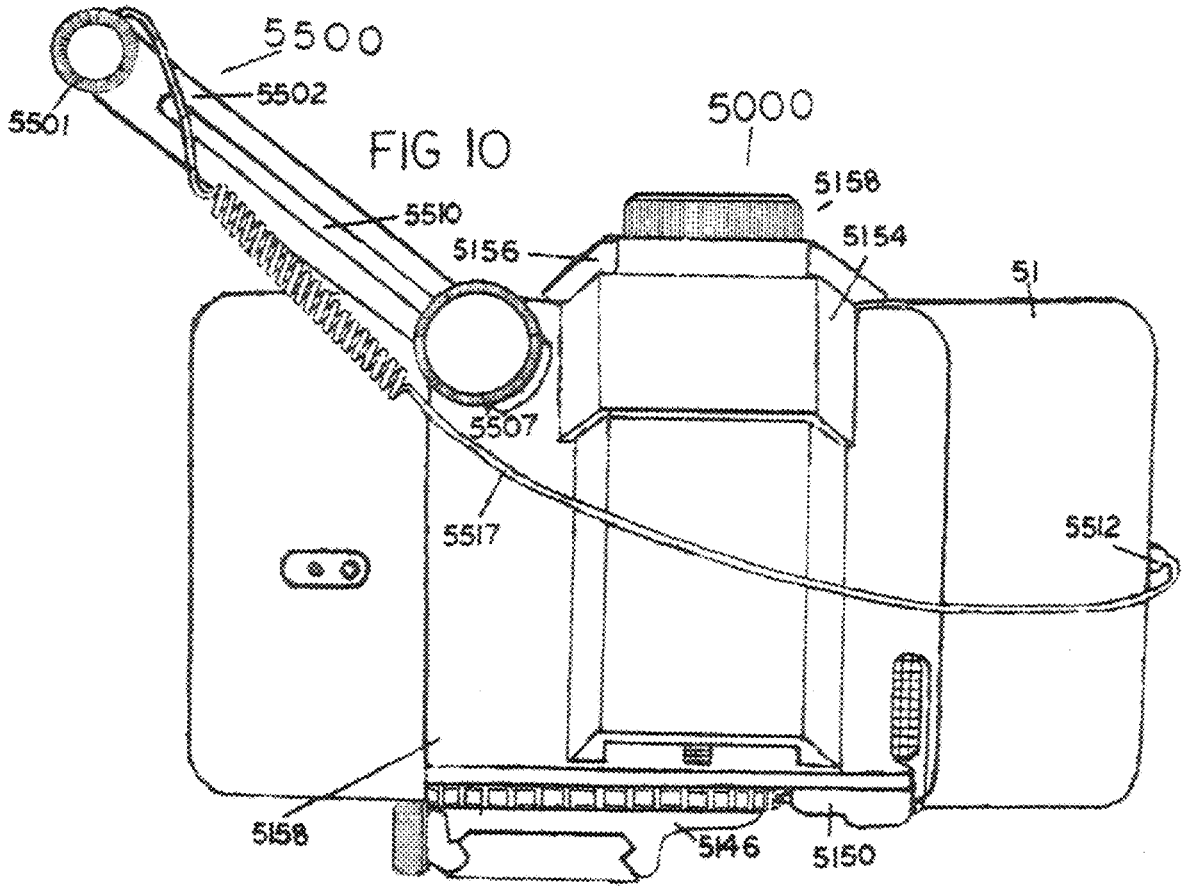
FIG. 10 is a backside view of a smart phone mounted in a rotatable mount with a rear viewing camera, in accordance with the principles of the present embodiment.

Now referring to FIG. 10 showing the front side of rotatable smart phone mount 5000 mounted on a weapons rail 25 in an embodiment taught herein with position adjustable camera mount 5500 illustrated as an integral component of rotatable smart phone or tablet mount 5000 in an embodiment taught herein with the armature 5502 of camera mount 5500 extended and rotationally adjusted to a desired position of adjustment and the armature of camera mount extended and locked into its maximum point of adjustment, in accordance with the principles of the present embodiment.

Figure 11:
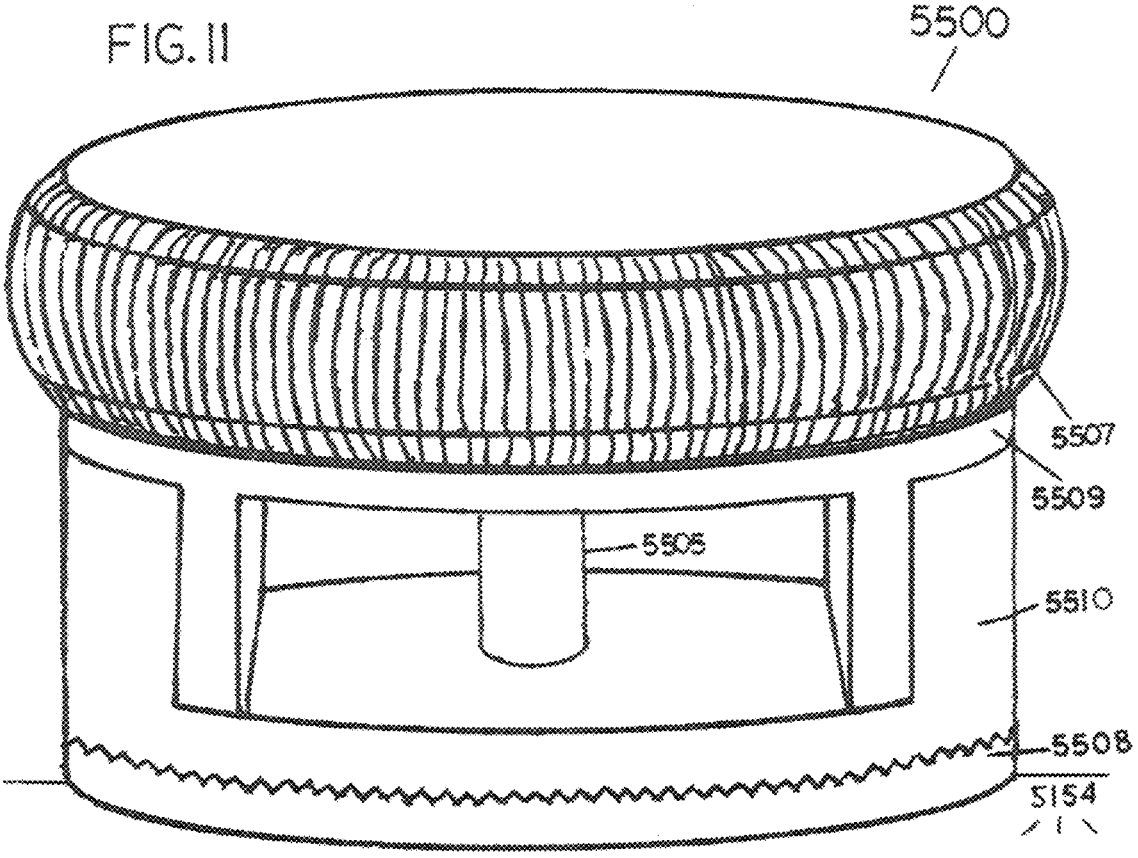
FIG. 11 is a height and angular mounting base for a position adjustable rear viewing camera in accordance with the principles of the present embodiment.

Now referring to FIG. 11, an embodiment of rear viewing position adjustable camera mount 5500 in an embodiment taught herein as if the position adjustable camera 5501 and camera armature 5502, were removed from position adjustable rear viewing camera mount leaving only the mount for same. This mount for position adjustable rear viewing camera 5500 consists of a base or platform 5508 which would be made as integral part of the back upper portion of rotating smart phone mount 5154. This base 5508 is cylindrical in shape with a plurality of teeth or ridges progressively reducing in size towards the center of base or platform 5508 which also contains a threaded hole located in the center of platform 5508 that match up and thread to threaded end of the shaft 5505, an integral part of tension adjusting knob 5507 threaded rod would be inserted through a hole located at the platform of tensioning jaw or clamp of 5509 where rod 5505, could turn freely therein and would continue through parallel slot or cut out 5511 located in the center of rectangular box beam type armature 5502 and this threaded rod 5505 additionally extend through tensioning jaw housing 5510 and thusly is rotatably threaded into the threaded hole 5516 located in the center of base or platform 5508, in accordance with the principles of the present embodiment.

Figure 12:
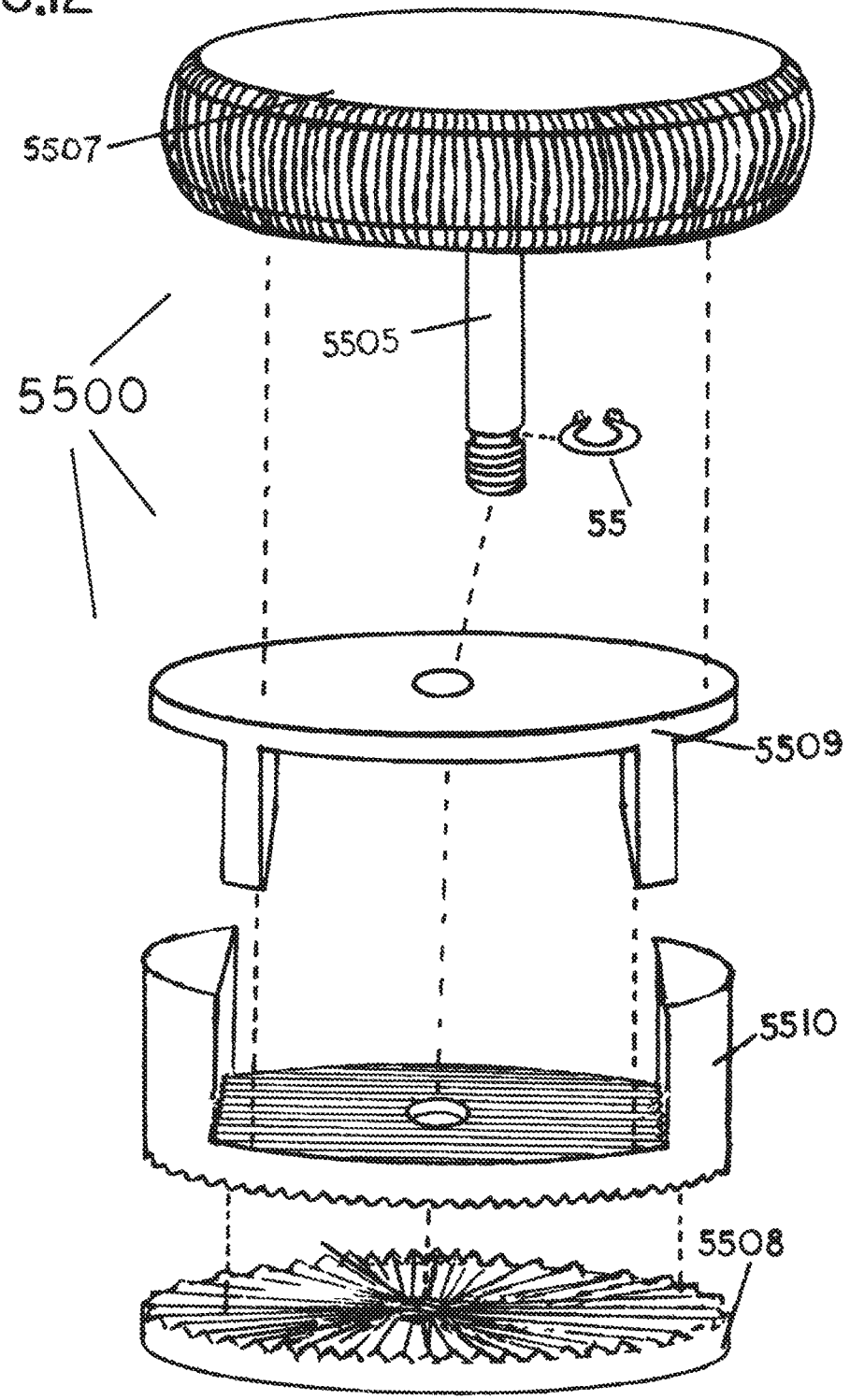
FIG. 12 is a blown-up view height and angularly adjustable mounting base for a position adjustable rear viewing camera, in accordance with the principles of the present embodiment.

Now referring to FIG. 12 showing a blown-up view of rear viewing position adjustable camera mount previously seen in assembled form in FIG. 11. Threaded rod 5505 includes a smooth upper section that turns freely through 5509 and 5510 with an inset groove located and centered between the smooth upper section and threaded end of rod 5505 where C clip #5514 is to be inserted therein after assemblage rod 5505 is then inserted through hole in the center of the upper section of the platform of jaw or clamp 5509, then through center cut out or slot 5511 as seen in FIGS. 9 and 10, and thusly passed through the hole and centrally positioned in the rotatably-positionable lower section or part of jaw or clamp 5510. Then clip 5514 is inserted into the groove located between the smooth part of the upper section of threaded rod 5510 and the bottom threaded section of rod 5510, locking all of these parts together. This C clip is housed in an inset section that extends around the outer perimeter of the bottom of hole located in the center of lower rotationally positionable jaw 5510. This inset C clip allows the loosening of the mount as the C clip can travel inside inset area while loosening or tightening while maintaining the assemblage of the rotationally adjustable mount to the camera and armature 5502 so that this device 5500 can be removed from rotationally adjustable smart phone mount 5000 and stored when not in use, then simply attached as a complete unit for deployment. Then the threaded end of rod 5505, an integral part of knob 5507 is threaded into base 5508, an integral part of rotatably adjustable smart phone mount 5000, so that as knob 5507 is rotatably threaded into base 5508, camera armature 5502 can be extended and rotated to its desired position and as knob is continuously rotated, the raised ridges or teeth located on the upper platform of the base 5508 are locked into their corresponding lower grooves or notches between the raised teeth or ridges located on the lower platform surface of rotatably adjustable lower jaw 5510. While at the same time in a similar manner the raised ridges or teeth located on the upper platform portion of the lower jaw are locked into their corresponding lower grooves or notches between the raised teeth or ridges 5547 viewable in FIGS. 22-B 23-A 23-B located on the inner flat surface of the armature 5510 and thusly as tension adjustable knob 5507 is rotatably tightened, rear viewing position able camera armature is compress ably secured between upper platform section of lower jaw 5510 and lower housed platform section of lower jaw or clamp 5509 that armature 5502, seen in FIGS. 9 and 10 are housed there in camera 5510 housing of which being an integral part of armature 5502 can be repositioned or returned to its position of non-use in the same manner by simply loosening knob 5507. Then returning the armature and infrared viewable camera there-on, to its desired position and re-tightening knob 5507; note the teeth located both on the upper platform portion of the lower jaw 5510, as well as the inside flat surface of the armature 5502, are illustrated as an alternate engineered design that would be applicable and may be implemented on all of the rear viewing camera armatures. The reason that some of the illustrations do not include these teeth or ridges and grooves on the inner portions of the armature, or on the upper surface of the lower jaw, this is in as being that they would probably not prove necessary, and would require loosening of the knob 5507 more and intern inadvertently loosening the rotatably position able base at the same time and has simply been added as a viable option that may or may not be incorporated into the device, in accordance with the principles of the present embodiment.

Figures 13, 14, 15:
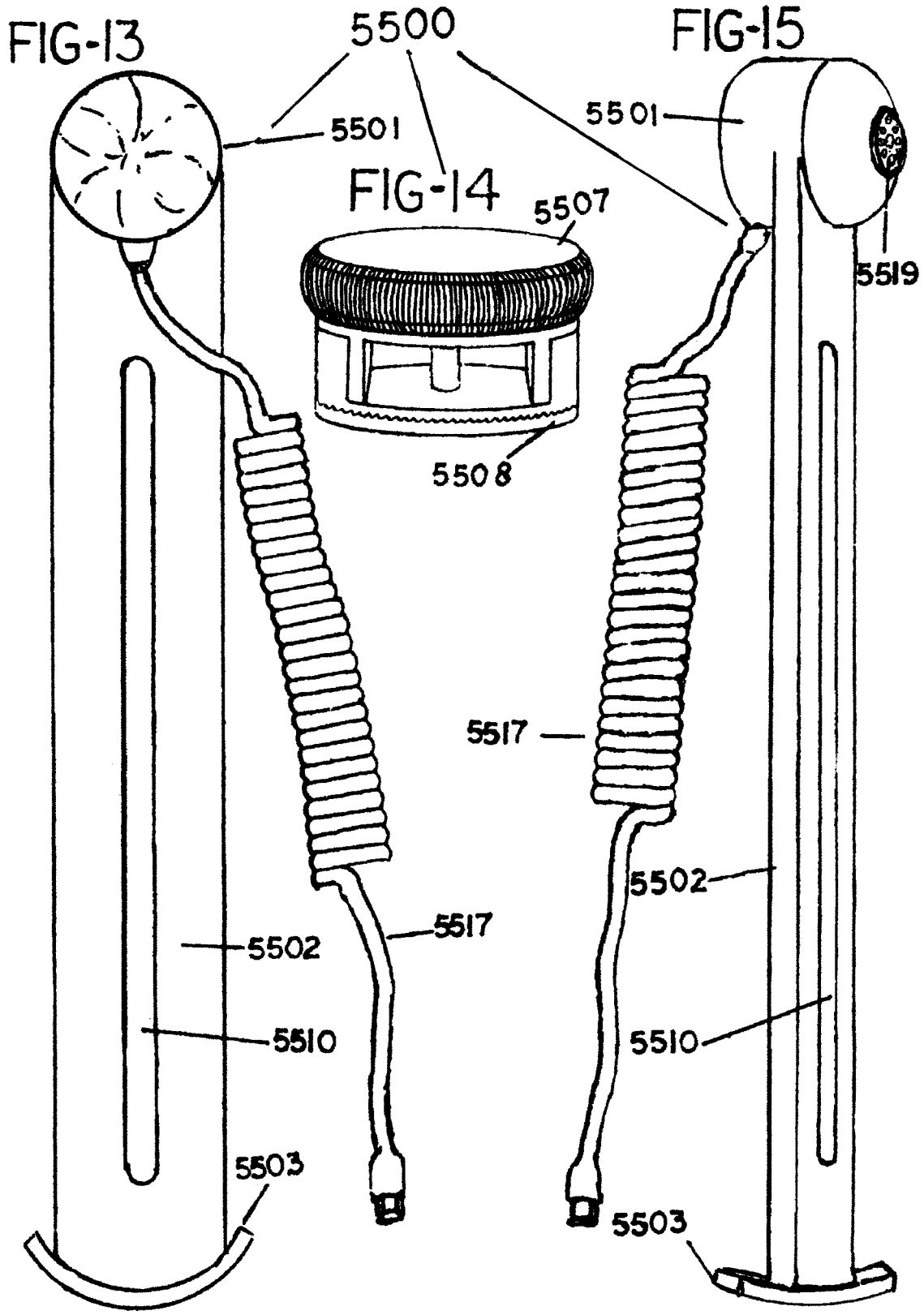
FIG. 13 is a backside view of a rear viewing camera with an integral height adjustable armature, in accordance with the principles of the present embodiment.
FIG. 14 is an armature mounting base, same as FIGS. 12 and 13, in accordance with the principles of the present embodiment.
FIG. 15 is a profile view of a rear viewing camera with an integral height adjustable armature, in accordance with the principles of the present embodiment.

Now referring to FIG. 13, the backside view of miniature HD infrared viewing camera with housing of same integral to camera armature 5502. A slot or cut-out 5510 is provided for the insertion and passing through of threaded rod 5505 allowing an entire span of adjustability thereof. A slide and stop 5503 is provided. This part of armature 5502 extends inward and rides or slides on the flat surface of the upper rotatable plate or main body of rotatably adjustable smart phone mount 5000 located on the backside of the plate that compress ably secures smart phone 51 into its cradle on the bottom center section of smart phone mount. This extruding plate that is integral to the bottom of armature 5502 provides compressible support to the armature and reduces stress on the rotatable camera armature mount but this plate also abuts the outside perimeter of tensioning base 5508 when armature 5502 is fully extended. in accordance with the principles of the present embodiment.

Referring now to FIG. 15, an embodiment taught herein is simply a partially rotated view of camera armature 5502 and front side of camera 5501 and camera lens inside viewing window with tiny LED infrared lights making up the infrared illuminator digitally spaced around the outer periphery of the inside portion of the cameras viewing window 5519. FIGS. 13 and 15 also show micro or USB connector 5512 which could be substituted or adapted for use with iPhone or other. Both FIGS. 13 and 15 show extendable cord 5517 where the rear viewing image received by camera 5501 and transferred to smart phone or small tablet. in accordance with the principles of the present embodiment.

Now referring to FIG. 14, an additional illustration of positionally adjustable camera armature mount seen in FIGS. 11 and 12, that camera armature 5502 is both positionally adjusted and secured both in positions of use and non-use therein and is simply illustrated to be proportionally relatable to the camera armature 5502 seen in FIGS. 13 and 15 that this camera armature 5502 are mountable into, in accordance with the principles of the present embodiment.

Figure 16:
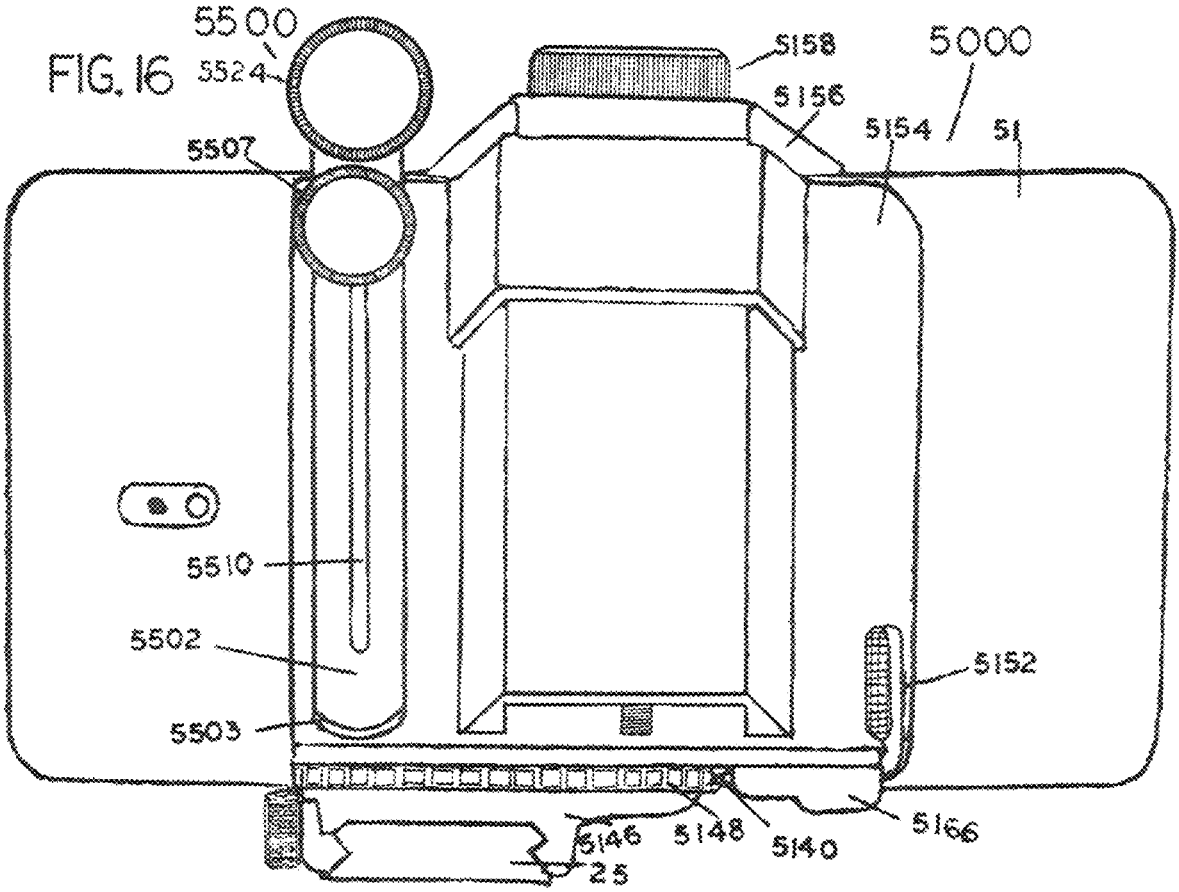
FIG. 16 is backside view of a smart phone mounted in a rotatable mount with a rear viewing camera mounted into a lower position, that transmits its digital image of an area behind the user to be viewed in said smartphone, in accordance with the principles of the present embodiment.

Now referring to FIG. 16, an illustration of rotating angle adjustable smart phone mount or tablet mount 5000 that any various sizes of smart phones can be mounted horizontally or vertically as well as small tablets therein with position adjustable camera mount 5500 in an embodiment taught herein. Camera with infrared illuminator of position adjustable camera mount 5500 adjusted and locked into its position of either non-use or non-raised position in this embodiment is of the same type of camera employed in camera sights viewed in FIGS. 8A and 8B being a small HD infrared viewing camera with no sighting abilities, in that it is being used solely for surveillance purposes, with a WiFi transmitting module that transmits its image to the smart phone or tablet that is mounted to rotating angle adjustable smart phone or small tablet mount 5000. This camera would have its own battery supply and transmit its image by a WiFi signal as well in the same manner the camera sight is transmitting its target image to the smart phone or smart device, when received by the smart device, the user can simply alternate between the two images by means of programmed applications on smart phone or smart device or both signal can be viewed at the same time on the smart phone or smart device screen by use of other available downloaded applications. Number 5527 is camera housing. Number 5525 is the water tight lid to battery compartment where batteries are housed to supply power to camera and WiFi transmitting module housed in the forward section therein. in accordance with the principles of the present embodiment.

Figure 17:
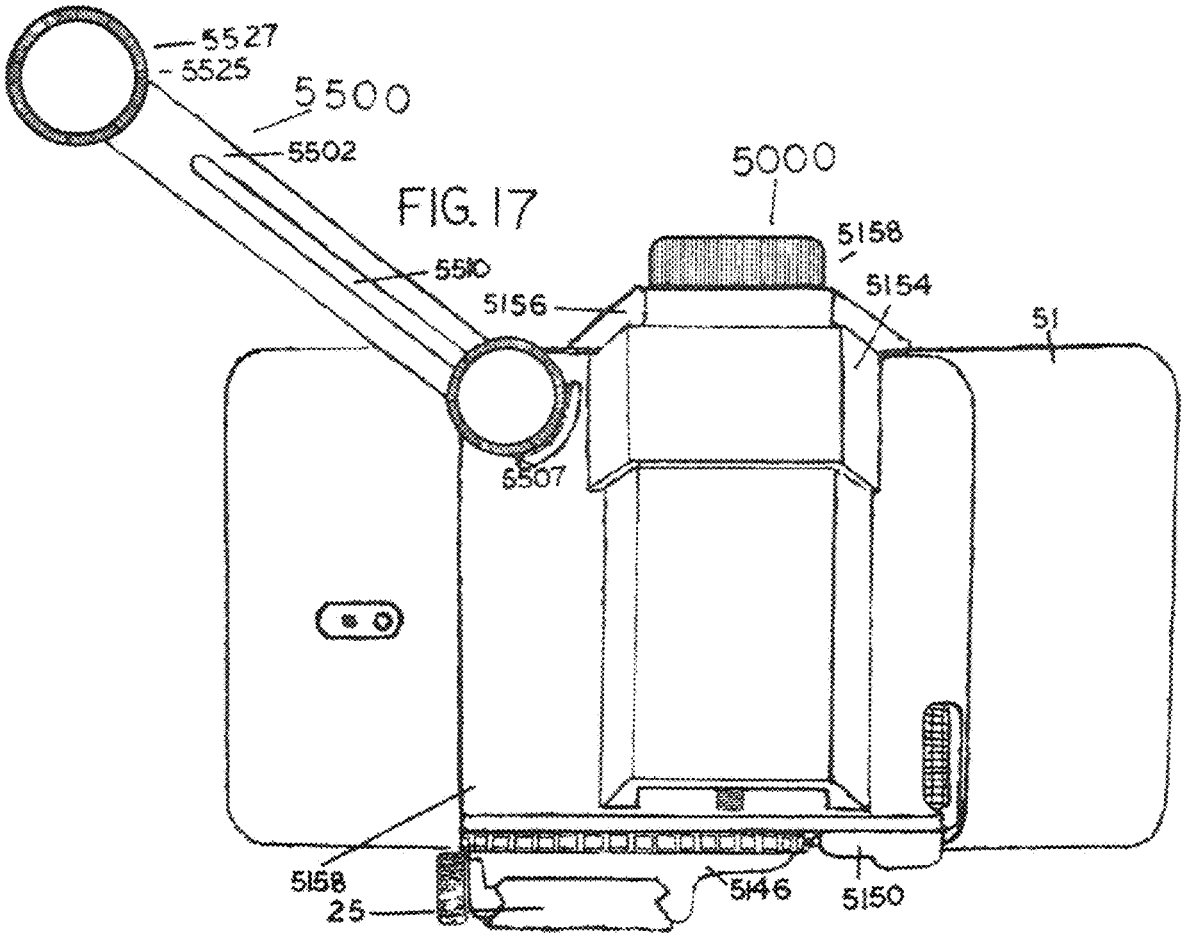
FIG. 17 is backside view of a smart phone mounted in a rotatable mount with a rear viewing camera height and angularly adjusted to its maximum point of adjustment, that transmits its digital image of an area behind the user to be viewed in said smartphone, in accordance with the principles of the present embodiment.

Now referring to FIG. 17, an illustration of rotating angle adjustable smart phone mount or tablet mount 5000 that any various sizes of smart phones can be mounted horizontally or vertically as well as small tablets therein with position adjustable camera mount 5500 in an embodiment taught herein. Camera of position adjustable camera mount 5500 adjusted and locked into its a desired position of height and angle of use with armature 5502 extended to its maximum length of adjustment with camera mounted in camera housing 5527 of the same type as viewed in FIG. 16 which is of the same type of camera employed in camera sights viewed in FIGS. 8A and 8B being a small HD infrared viewing camera with no sighting abilities, in that it is being used solely for surveillance purposes, with a WiFi transmitting module that transmits its image to the smart phone or tablet that is mounted to rotating angle adjustable smart phone or small tablet mount 5000. This camera would have its own battery supply and also transmit its image by WiFi in the same manner that the target image is transmitted to the smart phone or smart device, when received by the smart device, the user can simply alternate between the two images on by means of programmed applications on smart phone or smart device or both images can be viewed at the same time on the smart phone or smart device screen by use of other available download able applications. Number 5527 is camera housing. Number 5525 is the water tight lid to battery compartment where batteries are housed to supply power to camera and WiFi transmitting module housed in the forward section therein. in accordance with the principles of the present embodiment.

Figure 18:
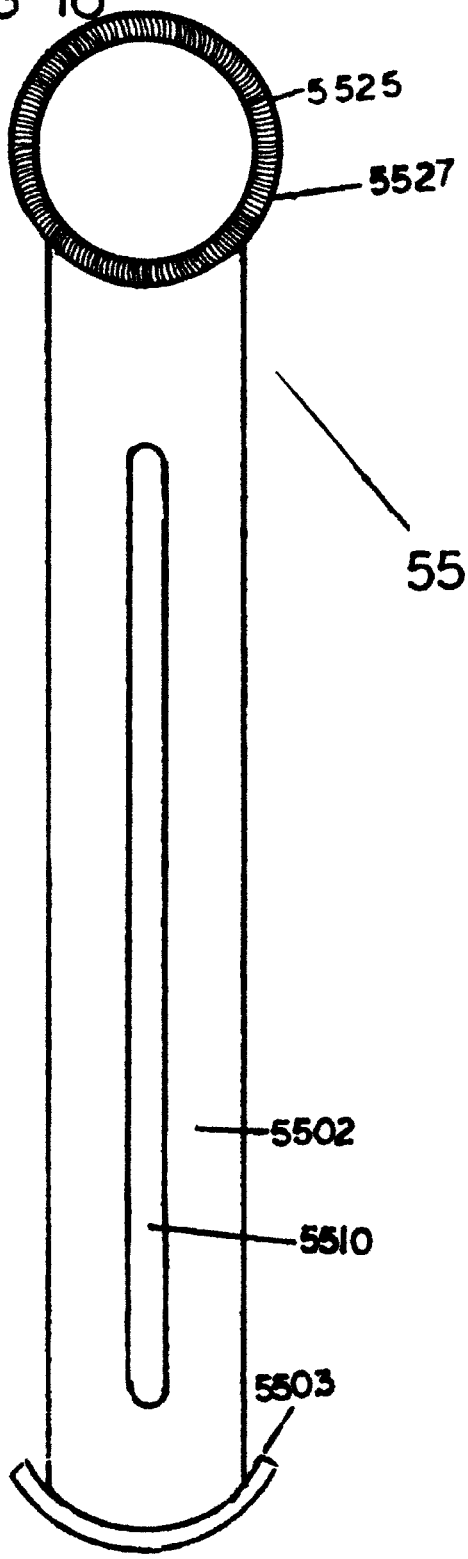
FIG. 18 is rear view of a rear viewing camera that transmits its digital image of an area behind the user to be viewed in said smartphone, in accordance with the principles of the present embodiment.

Now referring to FIG. 18, an illustration of the rear view of the rear viewing camera and camera housing 5527, as well as armature 5502 that would be an integral\ part of each other of FIGS. 16 and 17 with the camera housed therein of the type of camera with its own WiFi transmitting module that transmits its image to the smart phone or tablet that it is working in conjunction with by WiFi transmission, in accordance with the principles of the present embodiment.

Figure 19:
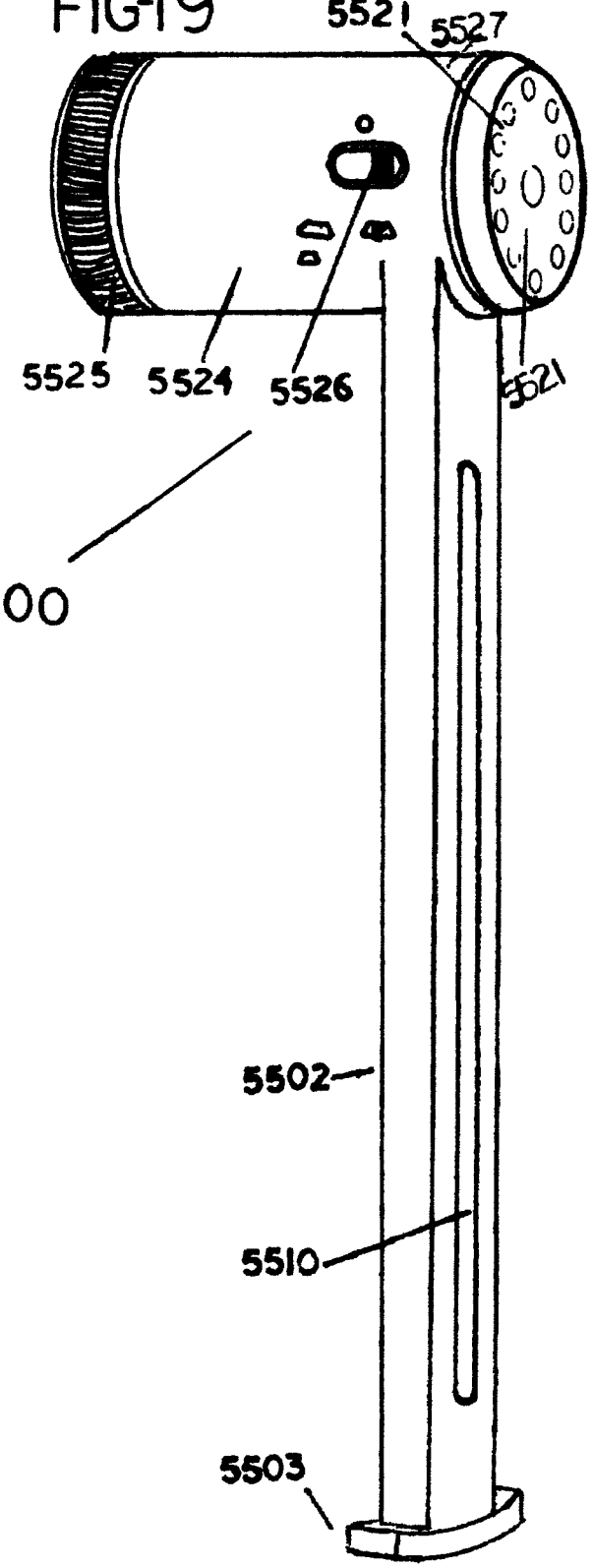
FIG. 19 is a profile view of a rear viewing camera mounted in a rotatable rail mount that transmits its digital image of an area behind the user to be viewed in a smart device, in accordance with the principles of the present embodiment.

Now referring to FIG. 19, an illustration of the slightly off-skew profile view of the rear viewing camera and infrared illuminator 5521 located inside of the inside viewing window. The tiny LED infrared lights making up the infrared illuminator digitally spaced around the outer periphery of the inside portion of the camera's viewing window and camera housing 5527, as well as armature 5502 that would be an integral part of each other of FIGS. 16 and 17, with the camera housed therein of the type of camera with its own WiFi transmitting module that transmits its image to the smart phone or tablet that it is working in conjunction with by WiFi transmission. This infrared view able camera housed inside camera housing 5527, receives its surveilled image through window 5521, located in the very forward part of camera housing 5527. A battery compartment 5524, an integral part of camera housing 5527, houses batteries supplying power both to camera and WiFi transmitter housed in the forward section of camera housing 5527. A watertight lid 5525 to battery compartment creates access to power supply housed therein and provided for removal and reinstallation of new or recharged batteries A charging port 5528 is also illustrated to optionally recharge the batteries therein. A switch and indicator light 5526, is supplied to turn on camera and WiFi transmitting module therein, in accordance with the principles of the present embodiment.

Figure 20:
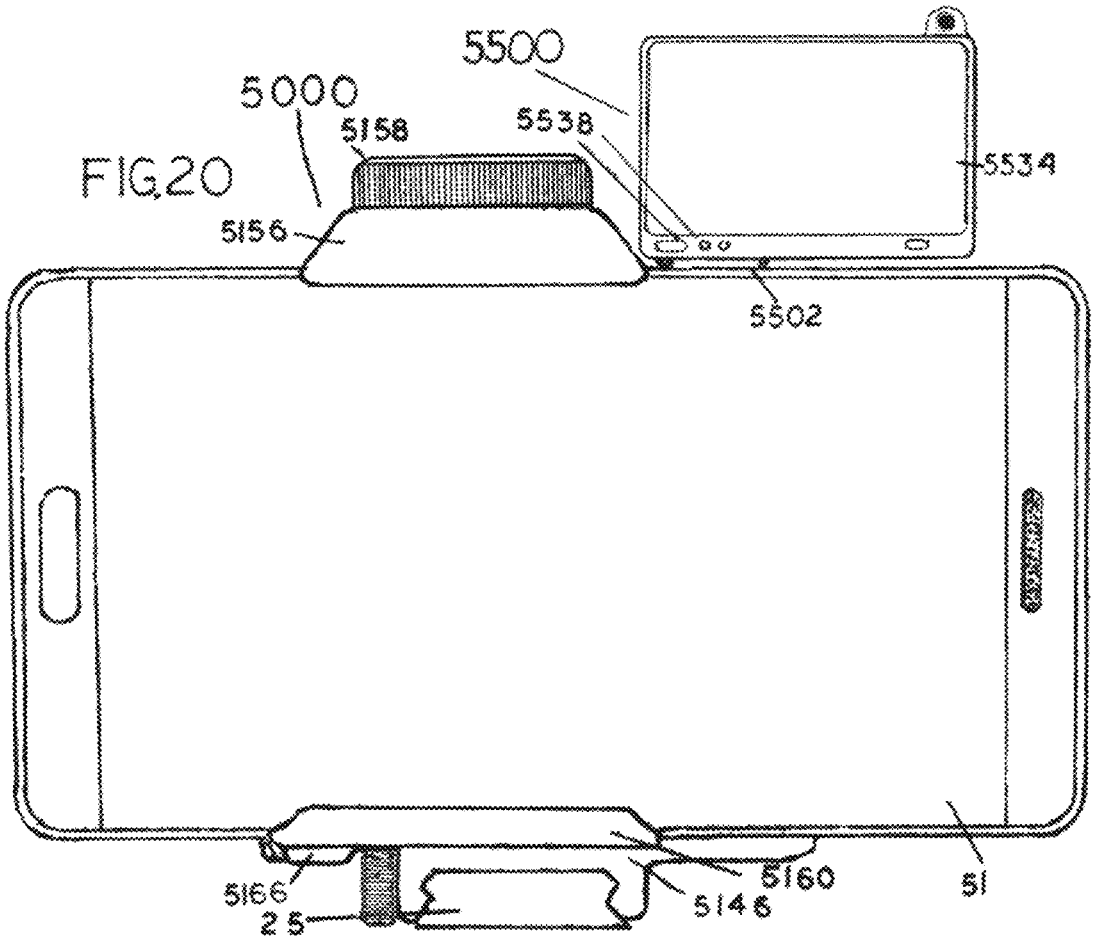
FIG. 20 is a frontal view of a smart phone mounted in a rotatable mount with a rear viewing camera mounted into a lower position that displays its own camera's image of an area behind the user to be viewed in said smartphone, in accordance with the principles of the present embodiment.

Now referring to FIG. 20, an illustration of the rear view of rotating angle adjustable smart phone mount 5000 and position adjustable camera mount 5500 in an alternate embodiment taught herein. This illustration shows rear viewing camera and infrared illuminator located inside of the viewing window with tiny LED infrared lights making up the infrared illuminator, digitally spaced around the outer periphery of the inside portion of the cameras viewing window. This camera 5531, being an integral part of this complete unit with its of its own tiny viewing screen 5532, and power supply. The camera employed in this embodiment of position adjustable camera mount 5500, is of the same type employed in the rear viewing camera illustrated in FIGS. 9, 10, 13, and 15; the difference being that instead of the surveilled image received by camera 5531, being transferred by wire to the smart phone or tablet that it is working in conjunction with, this camera with an integral infrared illuminator 5531, is hardwired directly to the rest of its components as well as the tiny screen, 5532, that this image is viewed on. So, in other words, when using this device in conjunction with rotating angle adjustable smart phone or tablet mount 5000, the target image can be viewed on the smart phone or tablet screen from any position that user would position himself in relation to the firearm, while being able to surveil the area behind him on the tiny screen 5532, that is an integral part of camera infrared illuminator 5531. This rear viewing camera is supplied with controls 5538, that would allow user to control other screen functions such as screen's light intensity, infrared illuminator, as well as other image enhancing features. Smart phone 51 is compress ably secured into smart phone cradle 5160, with tensioning member 5156, by tensioning knob 5158, in accordance with the principles of the present embodiment.

Figure 21:
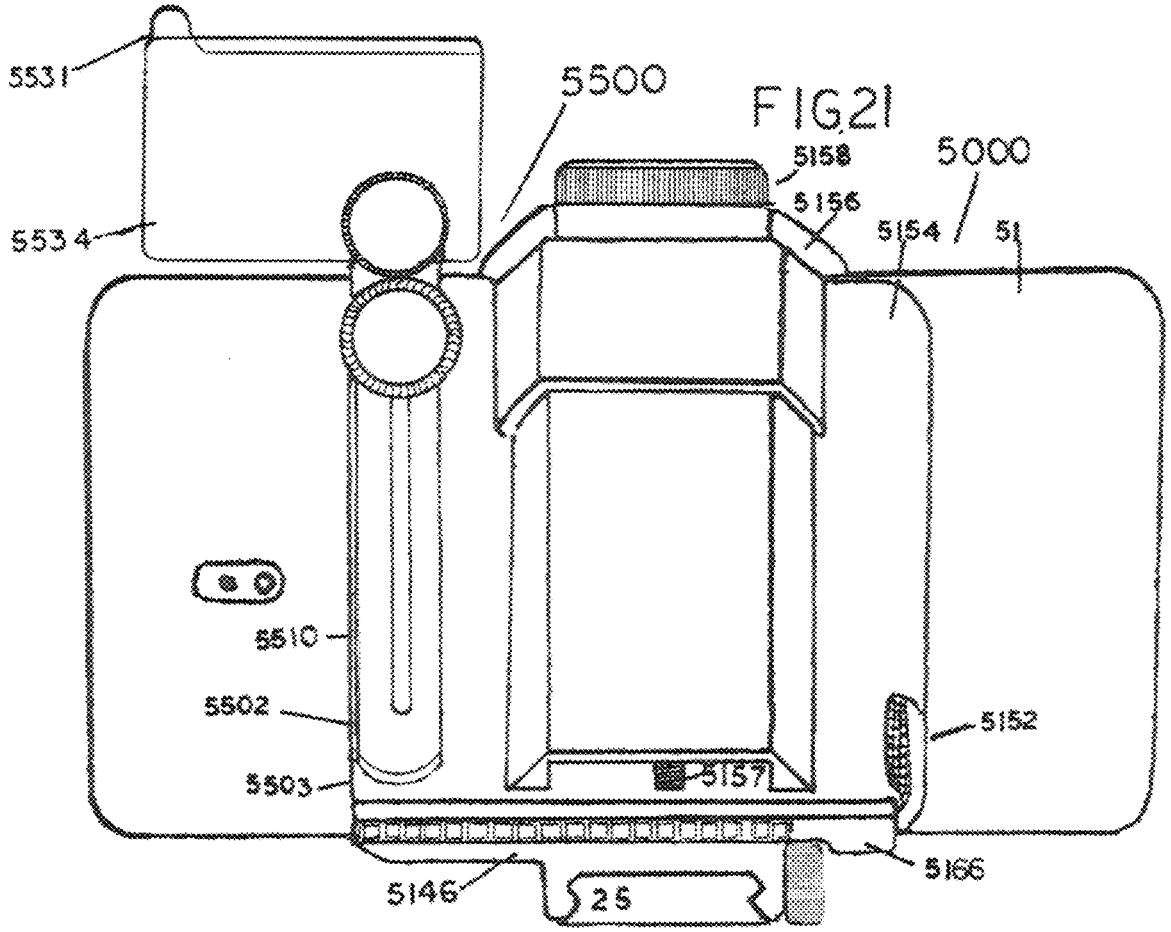
FIG. 21 is a rear view of a smart phone mounted in a rotatable mount with a rear viewing camera mounted into a lower position that displays its own camera's image of an area behind the user to be viewed in said smartphone, in accordance with the principles of the present embodiment.

Now referring to FIG. 21, an illustration of the front view of rotating angle adjustable smart phone mount 5000 and position adjustable camera mount 5500 in an alternate embodiment taught herein. This illustration shows a rear view of rear viewing camera and infrared illuminator 5531, being an integral component of its own tiny viewing screen as seen in FIG. 20. The camera employed in this embodiment of position adjustable camera mount 5500, is of the same type employed in the rear viewing camera illustrated in FIGS. 9, 10, 13, and 15, the difference being that instead of the surveilled image received by camera 5531 being transferred by wire to the smart phone or tablet that it is working in conjunction with, this camera 5531, is hardwired directly to the rest of its components as well as the tiny screen, 5532, that this image is viewed on. This rear viewing camera is supplied with controls 5538 (not shown) that would allow user to control other screen functions such as screen's light intensity, as well as other image enhancing features. Smart phone 51 is compressably secured into smart phone cradle 5160 with tensioning member 5156 by tensioning knob 5158, which is an integral part of threaded rod 5157, which is threaded through threaded collet, not seen, an integral part of the back side of smart phone mounting plate 5154 located on the upper portion thereof, underneath tensioning member 5156. This camera contains a battery compartment 5534 as well as a watertight battery compartment lid 5535. Also employs camera housing 5537, integral to the rest of the camera housing. in accordance with the principles of the present embodiment.

Now referring to FIG. 22 A is an illustration of the back side of rear viewing camera 5531, seen in FIGS. 20 and 21 in an embodiment taught herein. Camera armature 5502 is an integral part of camera 5531, camera housing and battery compartment 5534, with its own viewing screen 5532, integral to battery housing in accordance with the principles of the present embodiment.

Now referring to FIG. 22B an illustration of the front side of rear viewing camera 5531 seen in FIGS. 20 and 21, in an embodiment taught herein. Camera armature 5502 is an integral part of camera 5531, camera housing and battery compartment 5534, with its own viewing screen 5532, integral to battery housing.

in accordance with the principles of the present embodiment.

FIG. 23A is a drawing of a side view of the rear combination, rear viewing camera equipped with infrared illuminator 5531 and housing 5534, that houses the viewing screen, 5532 camera, and battery that powers this tiny self-contained unit. The armature 5502, is what this tiny self-contained unit mounts to, and angle adjusts on. in accordance with the principles of the present embodiment.

FIG. 23B is a slightly angled inward, side view drawing, of the rear viewing camera armature, with the tiny self-contained rear viewing camera and camera screen unit removed from the armature 5502 The threaded end of rod, which is an integral part of knob 5548 is inserted through a hole, centered in the end portion of the armature 62, and is then threaded into base 5546, which is an integral part of the camera viewing screen 5532 and battery housing 5534, as with this threaded rod loosened, by means of counterclockwise rotation of knob 5548 the self-contained camera viewing screen can be rotated into its desired angle of use, and then re-secured by means of clockwise rotation of the knob 5548, so that the threaded portion of the rod, that is an integral end portion of knob, 5548, is threaded base 5546 and securely tightened therein. The raised ridges or teeth located on the upper platform of the base 5546, are locked into their corresponding lower grooves or notches, between the raised teeth or ridges, located on the lower platform surface of 5545 of the inside portion of the armature #5502. Note this armature and mounting base design, with the raised ridges or teeth and corresponding groves or notches would be applicable to all of the camera armatures. Knob #5548 is rotatably tightened, securing this self-contained unit into its desired angle of use, in accordance with the principles of the present embodiment.

Now referring to FIG. 24 through FIG. 42, which are drawings of a re-engineered smart device mount that mounts on the side mounting rail of the firearm This newly engineered side mountable smart device mount, provides. a far greater range of abilities than its original engineered design (viewable in illustrations 37 through 39 referred to as side mountable smart device mount 5000 of the original patent application CAMERA SIGHT DEVICE FOR A WEAPON). This newly engineered design of this firearm angle adjustable side mount for a smart device such as a smart phone or small tablet, possess abilities that provide the user with a far greater range of versatility and use, such as the ability to rotate and lock the smart device mounting portion of this device into a choice of a plurality of different viewing angles of a full 360 degree radius of both vertical and horizontal rotation providing the user with the ability to fast and easily orient the screen of the smart device mounted in this smart device mount into a position to provide the best vantage point to the user, no matter what position the user would have to position himself in in relation to the firearm or to the smart device from either side, over, or under. This is achieved by means of this devices two new points of rotational adjustability, in accordance with the principles of the present embodiment.

Figures 24, 25, 26:
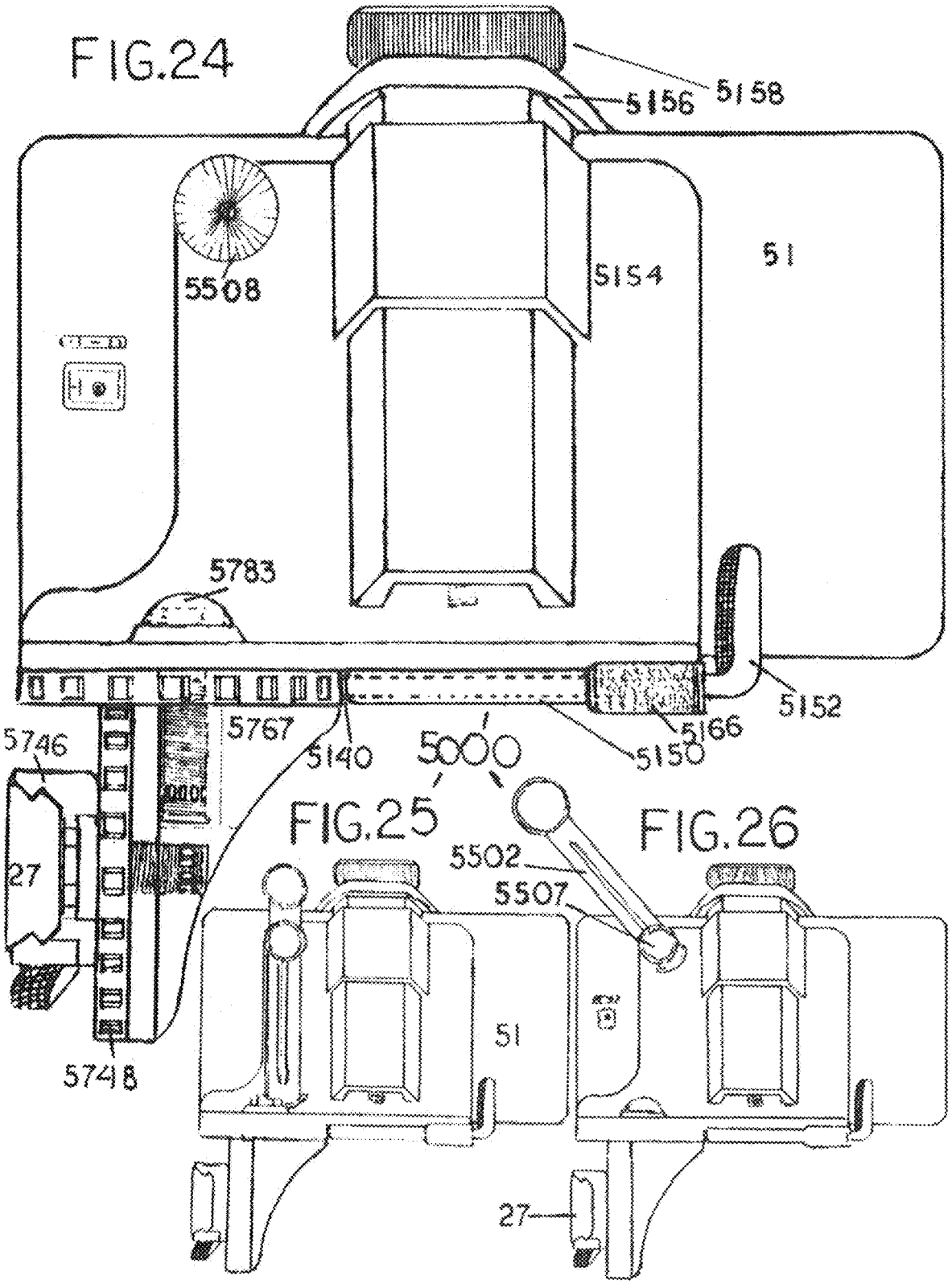
FIG. 24 is a back sided view of side mountable smart device mount that possess both vertical and horizontal rotating abilities with the rear viewing camera removed from its mounting base 5508, in accordance with the principles of the present embodiment.
FIG. 25 is a back sided view of side mountable smart device mount that possess both vertical and horizontal rotating abilities with its rear viewing camera in a position of either low adjustment or of nonuse, in accordance with the principles of the present embodiment.
FIG. 26 is a back sided view of side mountable smart device mount that possess both vertical and horizontal rotating abilities with its rear viewing camera in a position of maximum extension and adjustment low adjustment, in accordance with the principles of the present embodiment.

Now referring to FIG. 24 Some of the main engineered changes of this new model of side mountable multi position able smart device mount 5000 would be in this device's additional point of rotation providing this smart device mount with vertical rotatability. This is achieved by means of an upper disc shaped portion of this side mountable, rail mount, for this device. This upper disc shaped portion of the rail mount is the mounting platform for an additional, or a second disk shaped portion of this device that its rotatably coupled to. The disc shaped upper portion of the rail mount 5781-B This rotatable joint provides this device with vertical rotate ability. Which in turn, provides the user with a greater range of mobility and ease of use especially surveilling areas or engaging targets either from overhead or underneath obstacles, or to maintain a greater range of accurate use of the firearm from various positions of protective cover such as from under, or over, an armored vehicle or over a wall, berm or other. This added vertical rotating ability along with this smart device mounts newly engineered rotatable joint for the smart device that provides this newly engineered design of this device with other abilities as well. Probably the greatest of which being this smart devices new horizontal point of rotation being just higher than the top mounting rail of the firearm, that is rotatable and lockable into various points of rotation of 360 degrees providing the user with the ability to view the smart device screen, this being the target screen from any position, from either side of the firearm. another difference with this newly engineered design of side mountable smart device mount would be mounting base 5508 for the rear viewing camera 5500, invented and engineered to expand and enhance the safety providing abilities of this reflex or red dot type of camera sight system. This rear viewing camera is illustrated and described in detail in the description and drawings of FIG. 9 through FIG. 23 and are illustrated as being mountable on the version of this rotatable smart device mount that's mountable on the top rail of the firearm as well. The first of the two points of rotation of this newly engineered version of this side mountable smart device mount is located between the top disk shaped surface of the rail mount 5746 and a second disc portion of a gusset or a right angled brace that possess a third disc shaped portion, so that the second and third disc shaped portions of this devices surfaces are 90 degrees in relation to each other. The upper or outer surface portion of this third disc shaped portion of this brace or gusset 5767 provides the mounting platform for an additional disc shaped inner bottom portion of the smart devices mounting platform 5154 that is rotatably coupled there on. The top or third, disc shaped portion of this gusset, or brace portion of this device, as well as the top disc portion of the rail mount, possess a plurality of inset holes that are located. and digitally positioned around the outer periphery of the flat outer or facia portion of these discs. This drawing shows these inset holes 5781-A and 5781-B as being viewable as if the skirting or dust cover portions of both the lower portion of the smart device mount as well as the skirting or the dust cover portion of the second disc where removed so that the plurality of inset holes located around the outer periphery of the flat outer or facia portion of these discs can be viewed, that an end portion of rods or pins 5140 and 5740 are engineered in a way and shape as are the holes that they solidly lock into so that they are easily inserted into but lock solidly into these inset holes. These rods or pins outer surface is square or rectangular in shape, and extend through square or rectangular tube portions of both the outer gusset or brace portion of the second disc, and the lower portion of the smart device mounting portion of this device 5150. These rods or pins 5140 and 5740 are both integral portions of finger pulls 5152 and 5752, which the end portions thereof extend through the outer skirt or dust cover 5768-A being a lower bottom portion of the rotatable smart device mount 5154, and lock solidly into the inset hole portions of the upper or the third disc 5781-A, as well as 5768-B, being a lower skirt or dust cover portion of the second disc that the end portion of the pin or rod 5740 extends through a hole therein, and solidly locked into the inset holes located in the outer facia portion of the upper disc portion of the rail mount 5746, with these pins remaining solidly locked into these inset holes by means of springs 5166 and 5766, much of which are also and perhaps better viewed in FIGS. 29 and 30A, in accordance with the principles of the present embodiment.

Now referring to FIG. 25 and FIG. 26 which are backside views of the side mountable smart device mount 5000 equipped with rear viewing cameras the image of which being viewable in a window or split screen on the smart device this rear viewing camera is the same device as is described in detail and illustrated in FIGS. 18 and 19.

Figures 27, 28A, 28B:
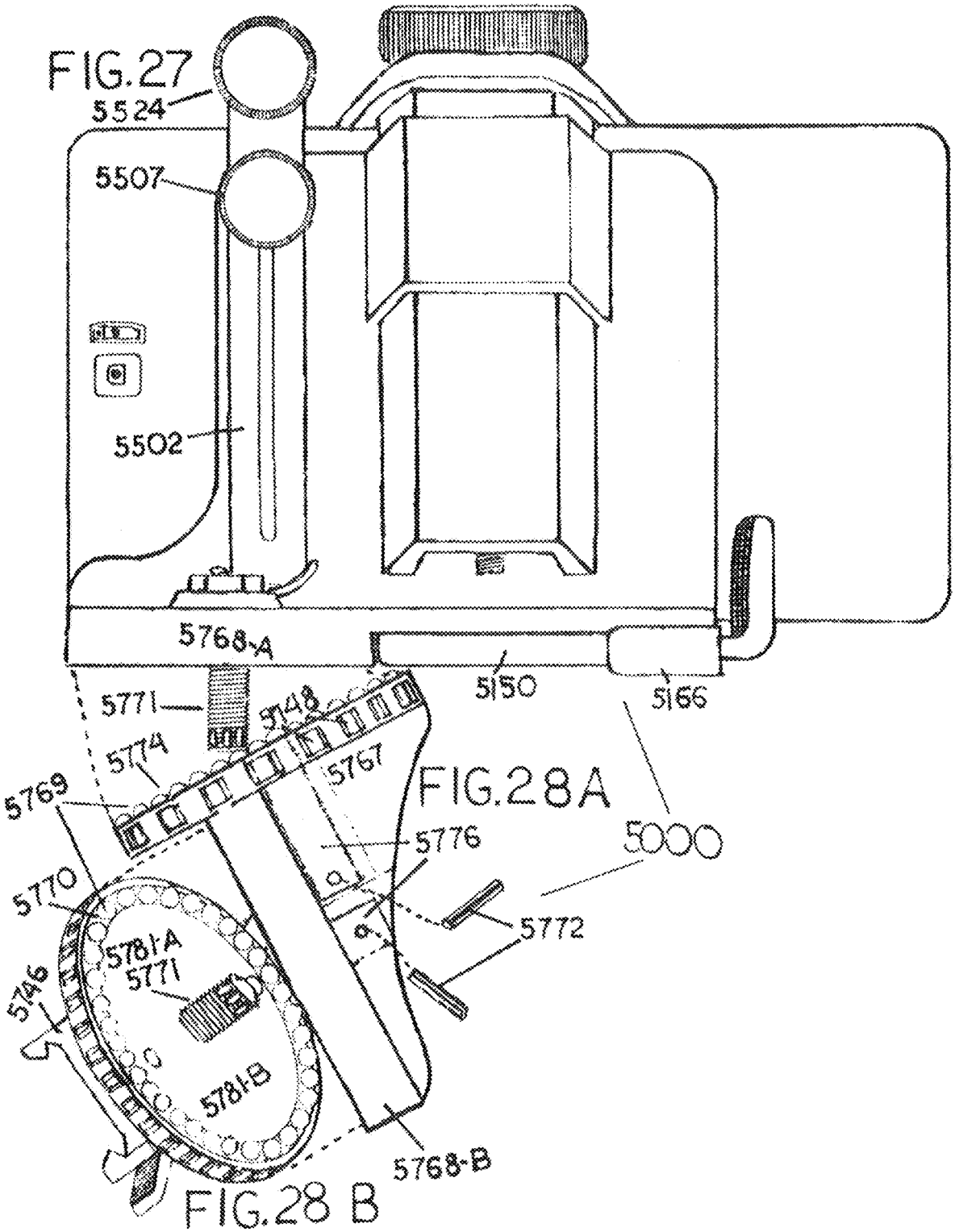
FIG. 27 is a back sided view of side mountable smart device mount that possess both vertical and horizontal rotating abilities with its rear viewing camera in a position of either low adjustment or of nonuse with the lower mechanical components thereof removed for inspection thereof, in accordance with the principles of the present embodiment.
FIG. 28A is a partially blown up view of the rotatable gusset and disks portion of the mechanical components that is rotatable on both the rail mount 5746 as well as the smart device mounting base portion of this device, in accordance with the principles of the present embodiment.
FIG. 28B is the rail mount portion removed from the rest of the mechanical components of this device of this side mountable smart device mount 5000 in accordance with the principles of the present embodiment.

Now referring to FIG. 27 being drawing of the newly engineered side mountable smart device mount 5000 which is illustrated as a blown up partially disassembled device so many of the internal components thereof can be viewed in their operational positions so that the workings there of can be better understood. This drawing also shows a larger view of the rear viewing cameras and the positionable armature thereof, mounted onto its mounting base 5508, viewable in FIGS. 24 and 25. This drawing also shows the skirt or dust cover portions 5768-A and 5768-B, of the upper inset disc that is an integral portion of the smart device mounting base 5154, and the other being the skirt or dust cover that's an integral potion of the disc that rotateably connected to the upper disc portion of rail mount 5746 of FIG. 28-B. These are mechanically fastened to, and through the upper and lower disk portions, as well as into a drilled and tapped out portion of the raised portion of the gusset of FIG. 28-B, that is made as an integral portion of these two discs, the surface of which being 90 degrees in relation to each other, in accordance with the principles of the present embodiment.

Figures 29, 30A, 30B:
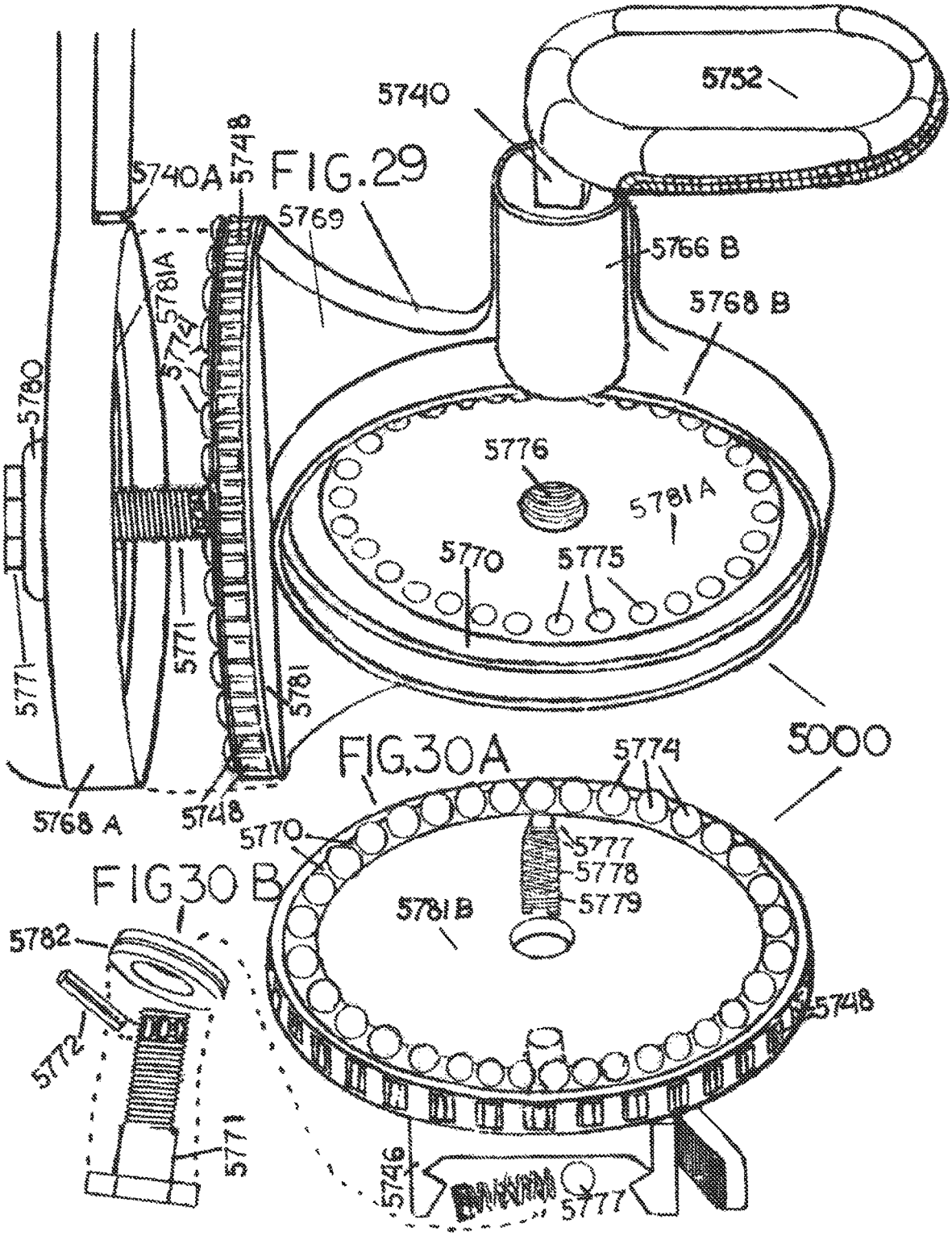
FIG. 29 is an exploded view of the mechanical components of the discs and gusset as well as the lower portion of the smart device mounting base that is rotate able and angularly adjustable on the upper disc portion 5781-A, thereof and mechanically fast enable thereto by means of bolt or machine screw 5771, in accordance with the principles of the present embodiment.
FIG. 30A is a drawing of the rail mount of side mountable smart device 5000, in accordance with the principles of the present embodiment.
FIG. 30B is the machine screw or bolt 5771 that mechanically fastens the rail mount 5746 to the vertical disc portion of the disks and gusset portion of side mountable smart device mount 5000, and a small thrust bearing the head of machine screw or bolt 5771 freely turns on during vertical rotation of the smart device mount 5000, in accordance with the principles of the present embodiment.

Now referring to FIGS. 29, 30-A and 30B; FIG. 29 shows a blown-up view of the lower inset disc portion, of the smart device mounting portion of this device, with a full view of the inside of the inset portion of the combination upper and lower discs, and integral smaller gusset portions 5769. The only portion of this center and connection portion of this embodiment of this device, would be the larger outer gusset portion of this embodiment, that possesses the raised portions, that are drilled and tapped to receive the machine screws 5771, that once properly tightened, are kept from turning back out, by means of press pins 5772, that are pressed through pre-drilled holes, located in the center lower portion of the raised portions of the larger gusset, where these press pins would pass through elongated holes, located in the lower portions of the machine screws, and back into the drilled out holes, located in lower portions of the drilled out and tapped portions of the outer gusset. This could also be achieved by means of an easier and more cost-effective manner, simply by means of thread locker or by means of locking threads.

This device is also illustrated as possessing four sets of thrust bearings, two of which being thrust bearings 5782. These are very small thrust bearings, that would look like an extra thick washer, that these machine screws would extend through, before being extended through the drilled out and counter sunk portions, of the center of the bottom of the rail mount, with this countersunk portion of the bottom of the rail mount, being counter sunk deep enough to house both the thrust bearing 5782, and the head of the machine screw 5771, without extending above the surface of the bottom of the rail mount 5746. The rotatable smart device mount portion of this device would be mechanically fastened to the upper disk and gusset portion of this device, in basically the same manner, except with the thrust bearing being housed in a countersunk raised portion 5780, of the base of the smart device mount 5154. The other two thrust bearings, would be located both between the inset disc portion of the smart device portion of this device, and the top of the upper disc portion of the disc and gusset portion of this device, as well as between the upper surface portion of disc 5781-B, of the rail mount 5746, and the inner surface portion of the disc and gusset portion of this device. These would either include ball bearings 5774, that use a dished-out ring-shaped portion of the connecting disk surfaces 5770, as a bearing race, and ride therein, or simply include ring-shaped thrust bearings that the upper and lower bearing race portions thereof, would be housed in rectangular ring-shaped, machined-out grooves that would-be position-able in the same location of the dished-out grooves 5770, that make up the bearing races in FIGS. 29 and 30-A. These ball bearings could be replaced in a less expensive model of this device, with inset fibered or another type of friction reducing discs, but not without reducing the functional strength and rigidity of the device, in that, these thrust bearings, as well as the thrust bearings 5782, that the machine screws or bolts 5771 extend through, are compressably housed in the countersunk portions of the rail mount, and the lower base portion of the smart device portion of this device. This device, as well as the top mountable smart device mount, would be engineered in this same manner. This device would also be optionally manufactured with a ball catch type system as illustrated in FIGS. 29 and 30-A, or other that would lightly maintain, which may prove as beneficial, simply due to the offset, or unbalanced weight distribution of the device, when making the vertically rotational adjustment of the rest of the device, in its rotational positioning of the smart device, that would possibly provide the user with a certain greater degree of speed and ease of use, when performing vertical rotational angle adjustments. In that, when making these adjustments, time can be extremely critical. The components providing this functional ability are illustrated in FIGS. 29 and 30-A, and are illustrated as an inner ball catch type of system, consisting of two small metal balls 5777, housed inside of a cylindrical tube which would simply be machined out in the upper portion of rail mount 5746, with a threaded inner portion on one end thereof and a tapered, of smaller diameter hole, on the other end thereof, that restricts the ball portion of this ball catch from completely exiting the tube. This tube portion of this ball catch, also houses a small but fairly rigid spring, as well as a threaded set screw, that threads into the bottom portion of the ball and spring housing, and adjustable tensioning ability is provided, by means of the tightening or loosening of set screw 5779, but would also allow the outer portion of the ball 5777 to extend above the upper surface of the disc portion of rail mount 5746, to engage, or pop in and out of the indents 5775. This function, in turn would provide the user with the ability to more quickly and easily rotationally adjust, the vertical angular adjustment, of the smart device, quickly and easily with one hand. The upper horizontal angular adjustability of this device may prove to benefit from this ability as well, and may be equipped with these abilities in the same manner if proven to be of benefit, in accordance with the principles of the present embodiment.

Figure 31:
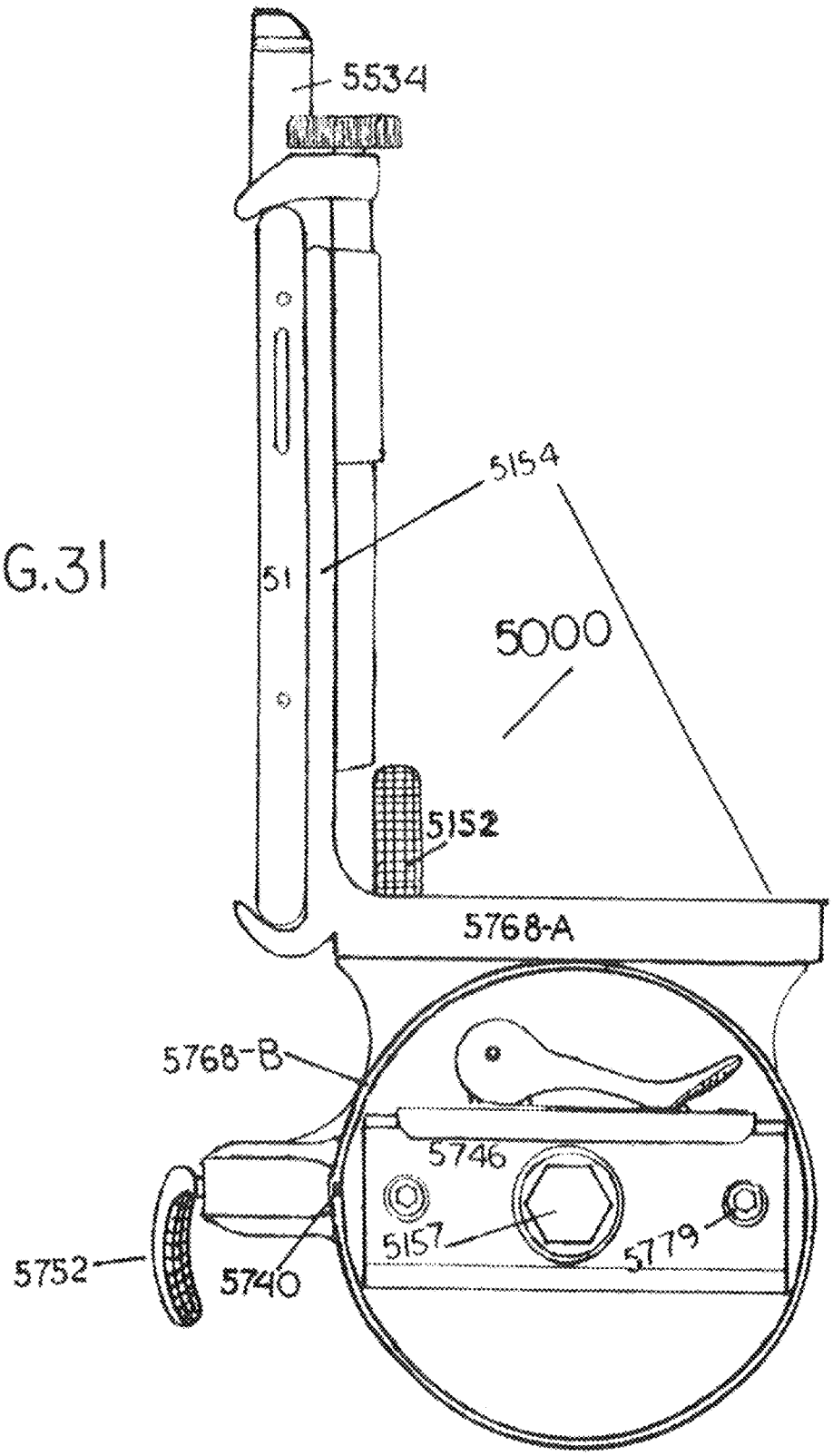
FIG. 31 is a side or profile view of side mountable smart device removed from its mounting rail with the bottom portion attachment portion of the rail mount viewable and as it would appear as vertically adjusted at 90 degrees to mounting rail, in accordance with the principles of the present embodiment.

Now referring to FIG. 31, this being a drawing of the back sideview, of the side mountable smart device mount 5000, as if this device was removed from the firearm's mounting rail, so that the inside or bottom portion of the rail mount, as well as a profile view of the device, could be acquired, to view its basic mechanical components and their positional orientation to each other. This, as well as to understand some of the benefits of this device's vertical angle adjustability. This drawing shows this device mounted in its vertical or upright position, which would be a position of further horizontal or lateral adjustability. With this device mounted in this position of vertical rotation, the smart device and its mounting base 5154, as well as the smart device 51, as well as all of the other horizontally or laterally rotatable components of this device, are mounted and rotate at an elevated level, that just clears the top mounting rail of the firearm, thus providing the user with the ability to rotate the smart device, providing a full view of the area being surveilled, from any position the user could position himself in relation to the firearm, from a full radius of 360 degrees. The added abilities provided by the positionally adjustable rear viewing camera 5534, that it is engineered to work in conjunction with these angle adjustable smart device mounts, provides the user, primarily our military, with an all new level of safety providing abilities. These are only further enhanced when used in conjunction with the rotatable camera sights viewable in FIGS. 43 through 46. This drawing's view of the bottom of the rail mount 5746, also provides a view of the counter sunk portion of the rail mount, that houses one of the tiny thrust bearings, that provide the machine screw or bolt 5157, with the ability to freely turn along with the rest of the vertically rotatable components of this device, even though this machine screw or bolt 5157, would be very tightly secured into these components. This drawing also provides a view of the backside of the adjustable set screws 5779, that adjust the spring tension of the springs 5778 and balls 5777, in accordance with the principles of the present embodiment.

Figures 32, 33:
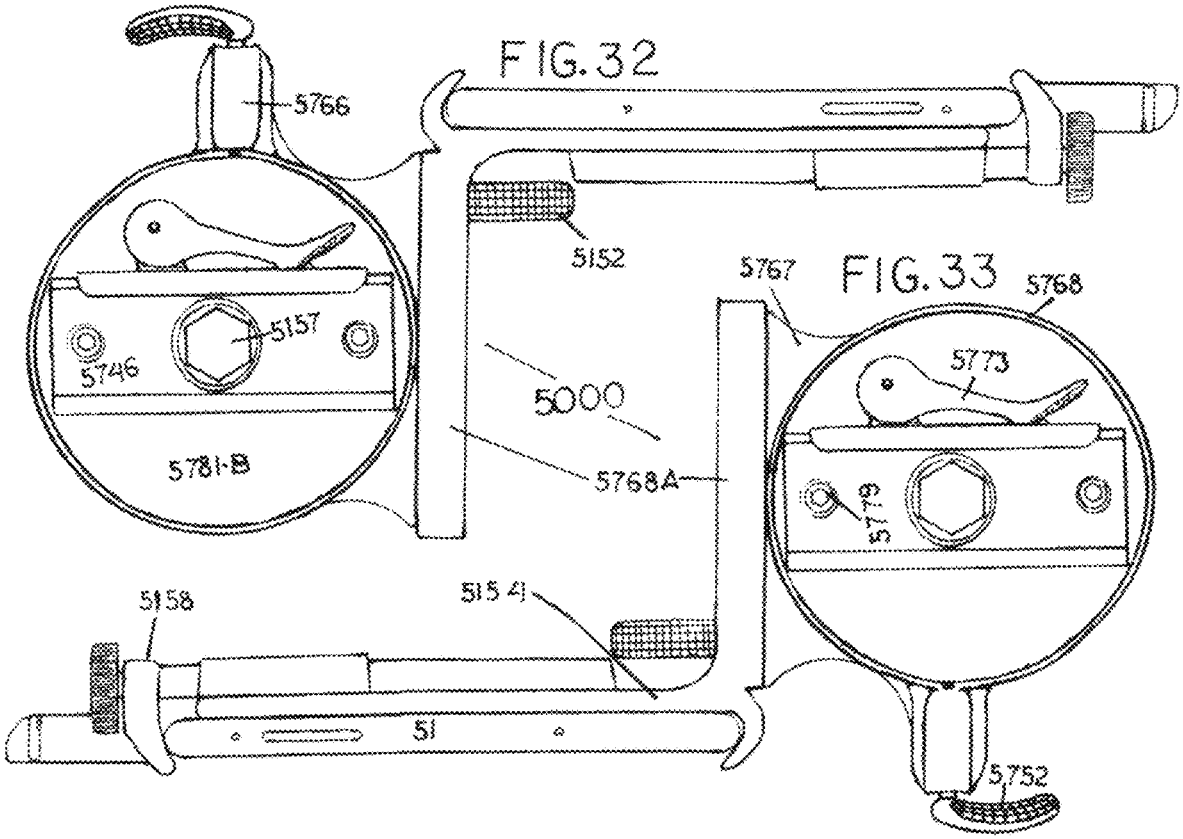
FIG. 32 is a side or profile view of side mountable smart device removed from its mounting rail and rotated forward as in the position if mounted on the rail mount the smart device screen would be viewable from above the firearm, in accordance with the principles of the present embodiment.
FIG. 33 is a side or profile view of side mountable smart device, and side mountable mount. Removed from its mounting rail and rotated aft, in the position if mounted on the rail mount the smart device screen would be viewable from under the firearm, in accordance with the principles of the present embodiment.

Now referring to FIG. 32, this being a drawing of a bottom view of the rotatable and side mountable smart device mount 5000, and smart device rotated and locked into a position, that enables the user with the ability to surveil an area of potential danger, from an overhead position, viewing an area from under an armored vehicle, or the many other positions the solder would find himself, looking under and around obstacles, such as when clearing a building or other. The vertical angular adjustability of this device is enabled by means of the rotational unlocking and locking ability of the finger pull 5752, that is an integral portion of rod or pin 5740, that extends through the skirt or dust cover 5768, and is compress-ably secured into one of the inset holes, located around the periphery of the upper portion of rail mount 5746, which provides the user with the ability to adjust the smart device 51, and its mount 5154, into any desired angle of rotation desired, in accordance with the principles of the present embodiment.

Now referring to drawing 33, this being a drawing of a bottom view of the rotatable and side mountable smart device mount 5000, and smart device rotated and locked into a position parallel to the firearm, by means of the rotational unlocking and locking ability of the finger pull 5752, into a position for the screen of the smart device to be positioned downward in relation to the firearm, in order to view targets from a position underneath the firearm, such as a position a soldier would find himself having to surveil an area or engage targets over a wall, armored vehicle, from in a trench or over a berm etc., in accordance with the principles of the present embodiment.

Figure 34:
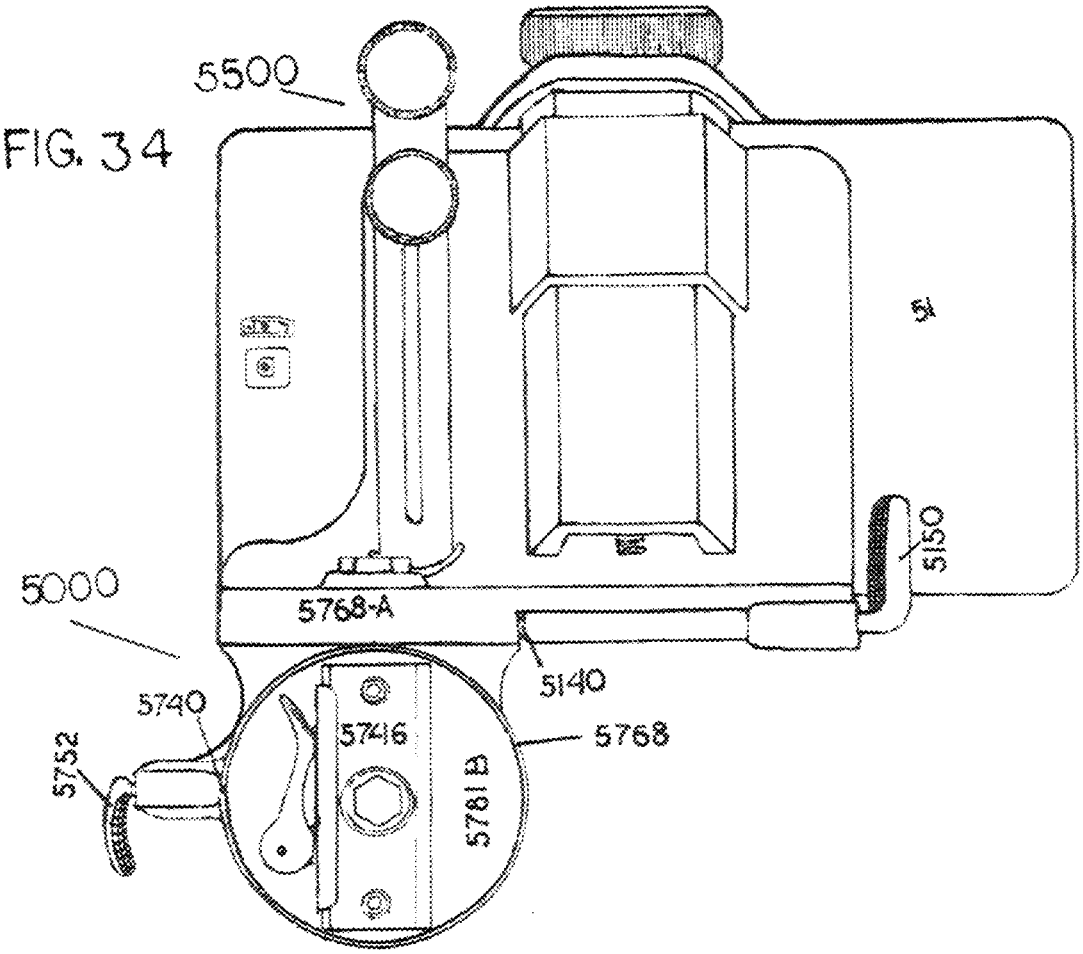
FIG. 34 is a side or profile view of side mountable smart device, mount removed from its mounting rail and rotated forward vertically and 90 degrees downward and in an optional viewing position, that if mounted on the rail the smart device screen would be viewable from the right side of the firearm, in accordance with the principles of the present embodiment.

Now referring to FIG. 34, this being a drawing of a bottom view of the rotatable and side mountable smart device mount 5000, and smart device rotated and locked into a position with the smart device's screen locked into a vertical position, to surveil an area and or engage targets, with this viewing angle providing a little better vantage point of the smart device's screen, from lower position, from the left side of the firearm. This, as well as many other optional viewing positions, that this smart device mount is capable of providing the user, with far too many of these secondary positional options to mention, in accordance with the principles of the present embodiment.

Figure 35:
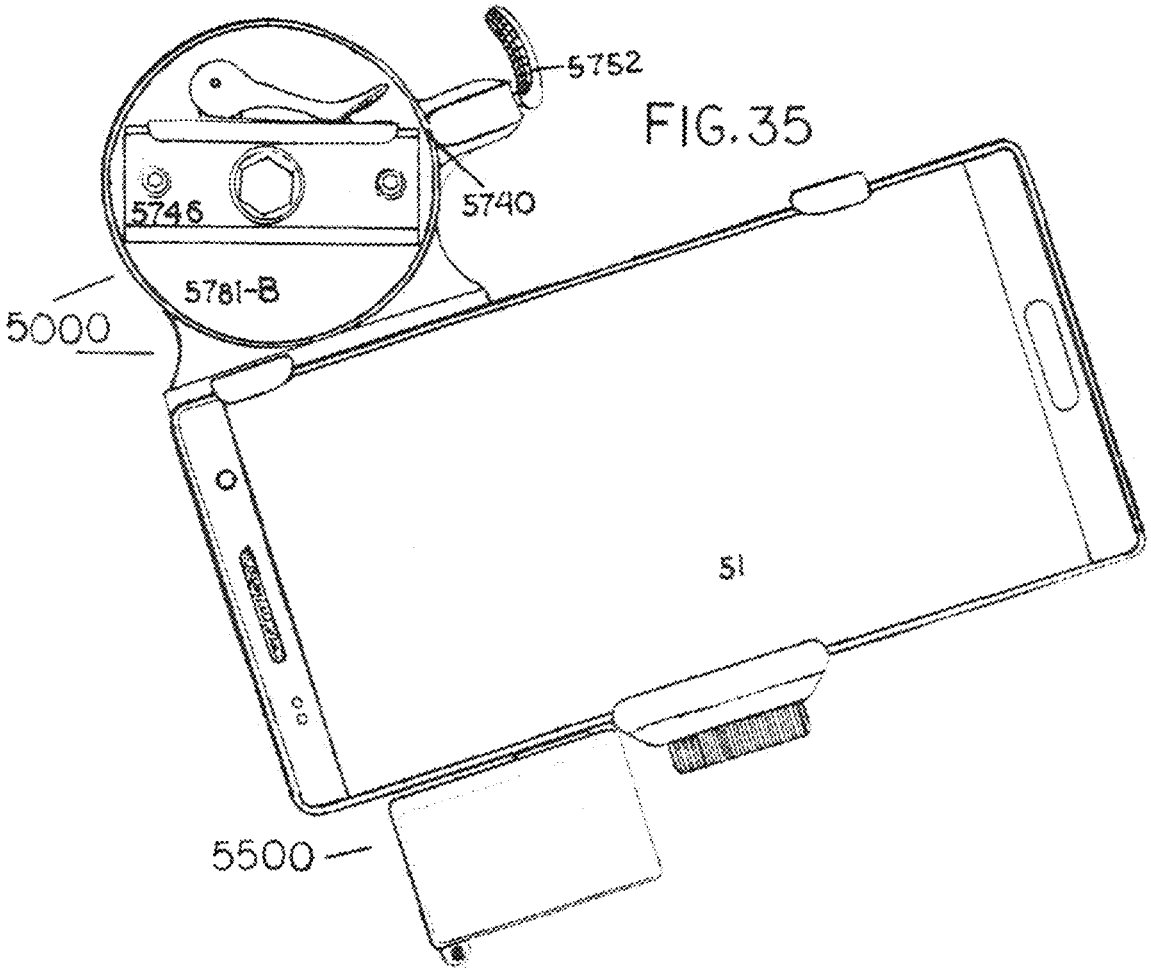
FIG. 35 is a side or profile view of side mountable smart device mount, removed from its mounting rail and rotated forward vertically and approximately 140 degrees downward and stored out of the way into a position of temporary non-use, that if mounted on the rail, the smart device screen would be towards the firearm, in accordance with the principles of the present embodiment.

Now referring to FIG. 35, this being a drawing of a bottom view of the rotatable and side mountable smart device mount 5000, and smart device rotated and locked into a position, with the smart device's screen rotated inward, locked into an upside down, off-skew, vertical position, with the screen of the smart device facing inward, facing the firearm, and locked into an optional position of nonuse, in accordance with the principles of the present embodiment.

Drawings 36 through drawing 42 simply show many of the more common optional viewing angles provided by this device's horizontal rotatable position-ability. It is noteworthy to mention that this device provides the user with the ability to position and lock the smart device into any vertical or horizontal rotational position or combination thereof, of 360 degrees in relation to the firearm, in accordance with the principles of the present embodiment.

Figures 36, 37:
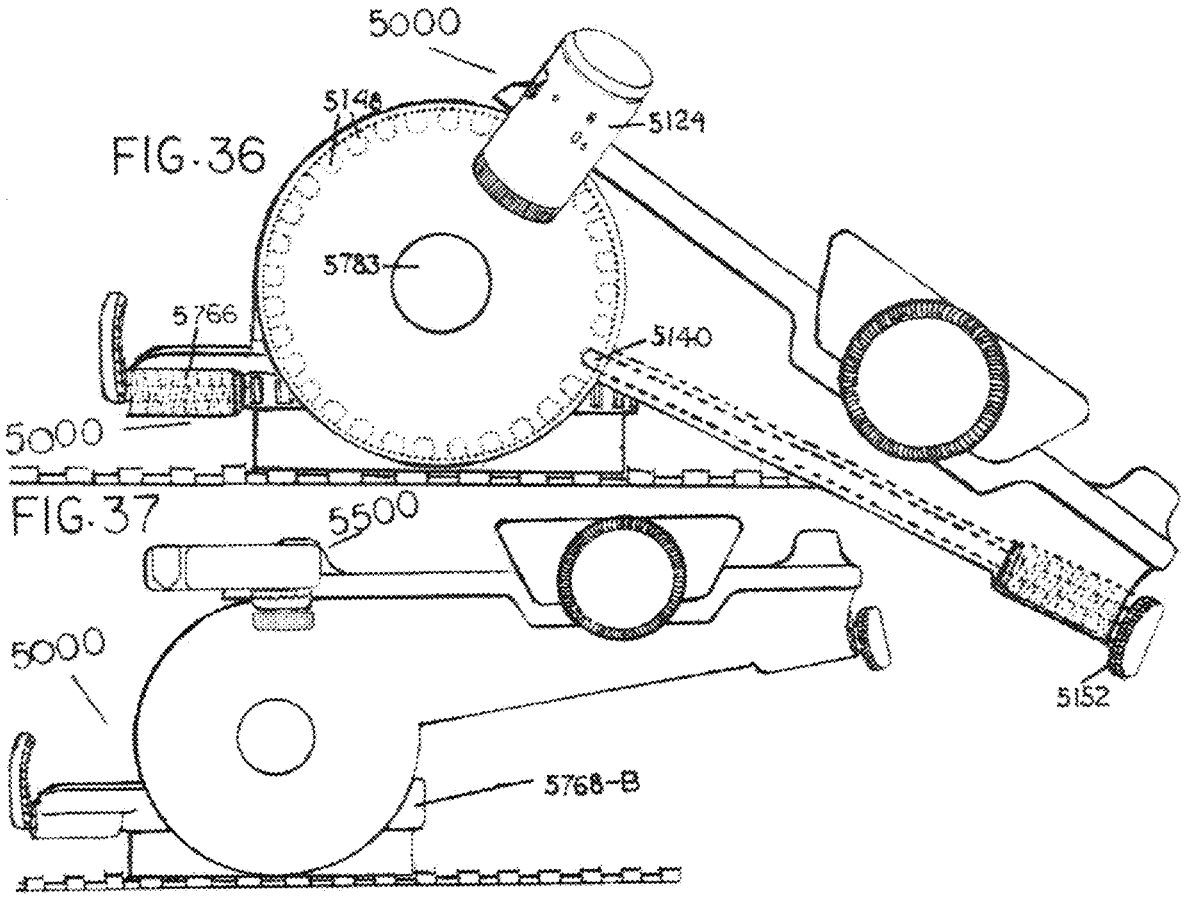
FIG. 36 is an overhead view of a side mountable rail mount 5000, that if it was in service with a smart device mounted therein, the target image and the surrounding area would be best viewable from a position partially forward and to the left side of the firearm, in accordance with the principles of the present embodiment.
FIG. 37 is an overhead view of a side mountable rail mount 5000, that if it was in service with a smart device mounted therein, the target image and the surrounding area would be best viewable from a position partially aft and to the left side of the firearm, in accordance with the principles of the present embodiment.

Now referring to FIG. 36, being a drawing of rotatable and side-mountable smart device mount 5000, equipped with rear viewing camera 5124, best viewed and described in the drawings and definitions of FIGS. 18 and 19. Side rail-mountable smart device mount 5000, is illustrated as to view some of the internal components, that lock this device into its various optional angles of horizontal rotation, with the smart device mountable therein, in a position of 90 degrees, in relation to the firearm, and rotated and locked into a horizontally rotated position, to surveil an area of potential danger or engage hostile combatants, if deemed necessary to the survival of the soldier, from a protective position, with the soldier positioned partly forward and to the left side of the firearm. Number 5783 is a domed-cap, that pops into a recessed ridge, located on the upper inside periphery of the raised countersunk portion of the lower portion of the thrust bearing housing 5780, best viewed in FIG. 29, in accordance with the principles of the present embodiment.

Now referring to FIG. 37, being a drawing of rotatable and side mountable smart device mount 5000, equipped with rear viewing camera, with its own viewing screen. This rear viewing camera is best viewed in FIGS. 22A and B, as well as FIGS. 23A and B. This drawing of device mount 5000, with the smart device mountable therein, is mounted in a position of 90 degrees in relation to the firearm, and rotated and locked into a horizontally rotated position, to surveil an area of potential danger, or engage hostile combatants, if deemed necessary to the survival of the soldier, from a protective position, with the soldier positioned at approximately 90 degrees, to the left side of the firearm, in accordance with the principles of the present embodiment.

Figures 38, 39:
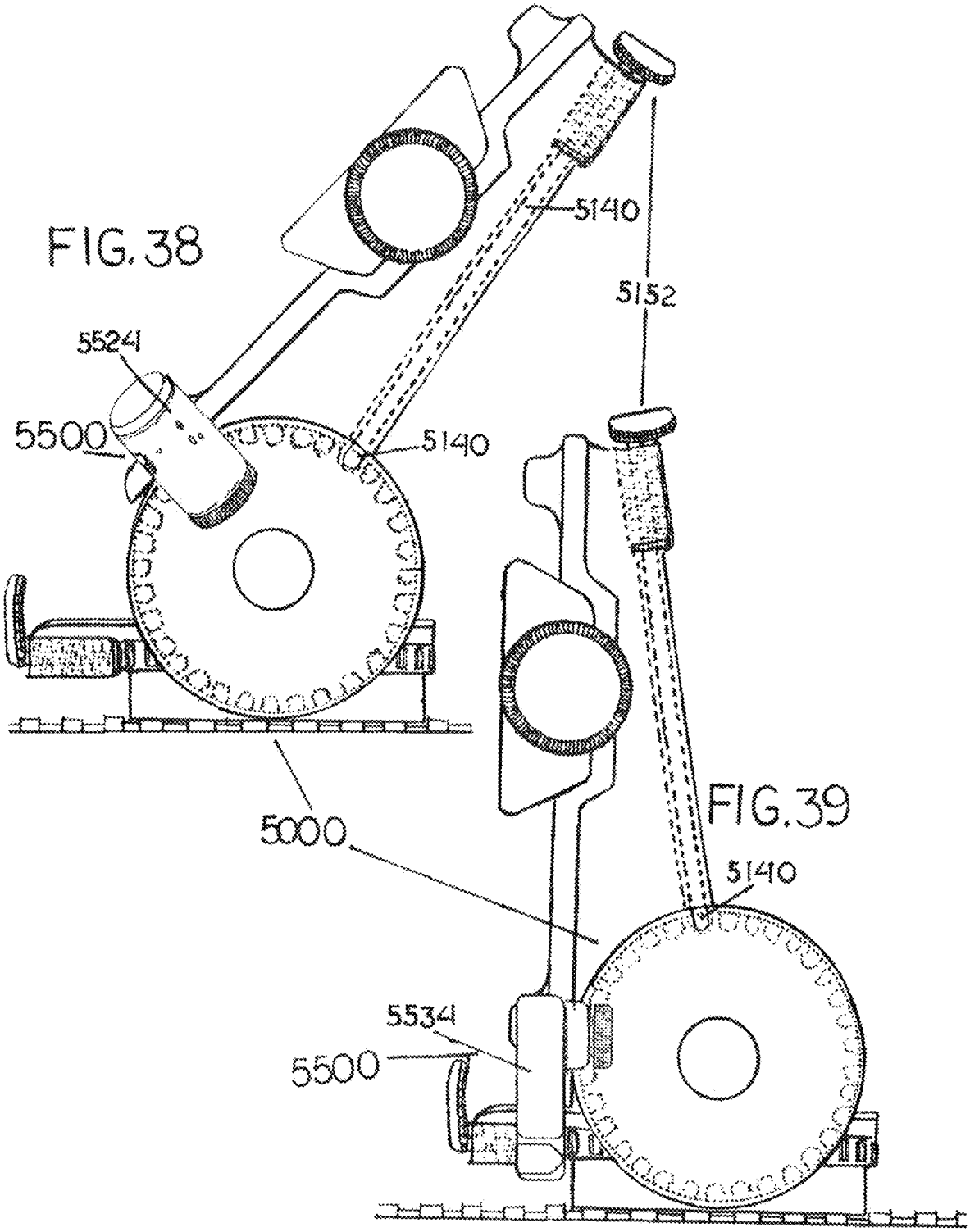
FIG. 38 is an overhead view of a side mountable rail mount 5000, that if it was in service with a smart device mounted therein, the target image and the surrounding area would be best viewable from a position partially aft and to the left side of the firearm, in accordance with the principles of the present embodiment.
FIG. 39 is an overhead view of a side mountable rail mount 5000, that if it was in service with a smart device mounted therein, this would be a position the user would have this mount mounted in, to use the firearm in the conventional manner from behind the firearm, in accordance with the principles of the present embodiment.

Now referring to FIG. 38, being a drawing of rotatable and side mountable smart device mount 5000, and illustrated as to view some of the internal components that lock this device into its various optional angles of horizontal rotation, with the smart device mountable therein, in a position of 90 degrees, in relation to the firearm and rotated and locked into a horizontally rotated position, to surveil an area of potential danger, or engage hostile combatants, if deemed necessary to the survival of the soldier, from a protective position with the soldier positioned partly aft, and to the left side of the firearm, in accordance with the principles of the present embodiment.

Now referring to FIG. 39, being a drawing of rotatable and side mountable smart device mount 5000, and illustrated as to view some of the internal components that lock this device into its various optional angles of horizontal rotation, with the smart device mountable therein, in a vertical position of 90 degrees in relation to the firearm, and rotated and locked into a horizontal position of 90 degrees in relation to the muzzle of the firearm, to simply use the firearm in a non-necessarily tactical manner, but to simply take advantage of this reflex or red dot type of camera sight system's advanced targeting abilities, in the conventional manner from behind the firearm, in accordance with the principles of the present embodiment.

Figure 40:
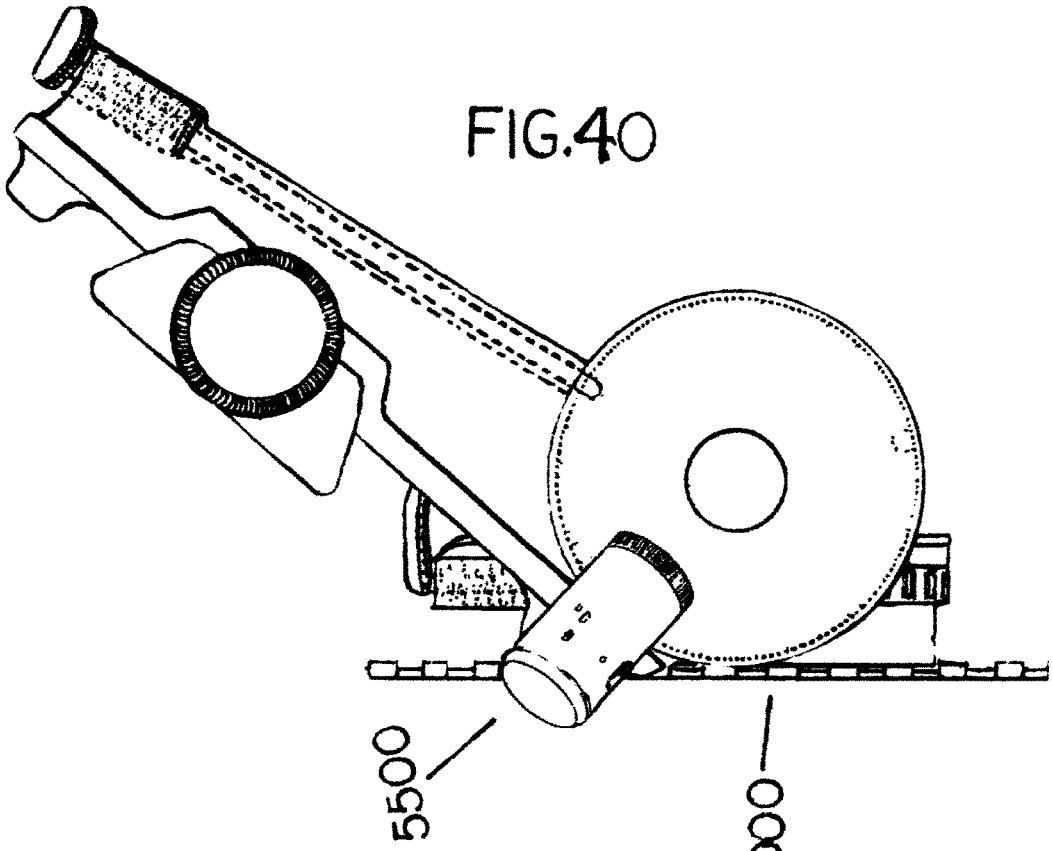
FIG. 40 is an overhead view of a side mountable rail mount 5000, that if it was in service with a smart device mounted therein, the target image and the surrounding area would be best viewable from a position partially aft and to the right side of the firearm, in accordance with the principles of the present embodiment.

Now referring to FIG. 40, being a drawing of rotatable and side mountable smart device mount 5000, and illustrated as to view some of the internal components that lock this device into its various optional angles of horizontal rotation, with the smart device mountable therein, in a position of 90 degrees in relation to the firearm, and rotated and locked into a horizontally rotated position to surveil an area of potential danger, or engage hostile combatants if deemed necessary to the survival of the soldier, from a protective position with the soldier positioned partly aft and to the right side of the firearm, in accordance with the principles of the present embodiment.

Figure 41:
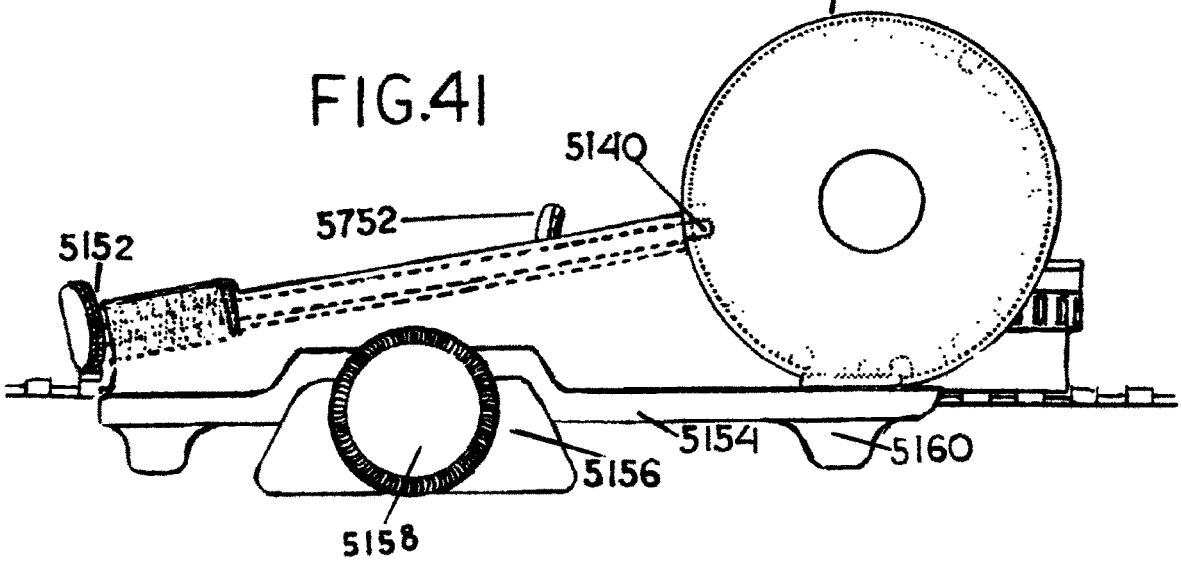
FIG. 41 is an overhead view of a side mountable rail mount 5000, that if it was in service with a smart device mounted therein, the target image and the surrounding area would be best viewable from a position to the right side of the firearm, in accordance with the principles of the present embodiment.

Now referring to FIG. 41, being a drawing of rotatable and side mountable smart device mount 5000, with the smart device mounted therein in a position of 90 degrees in relation to the firearm, and rotated and locked into a horizontally rotated position to surveil an area of potential danger, or engage hostile combatants if deemed necessary to the survival of the soldier, from a protective position, with the soldier positioned at approximately 90 degree, to the right side of the firearm, in accordance with the principles of the present embodiment.

Figure 42:
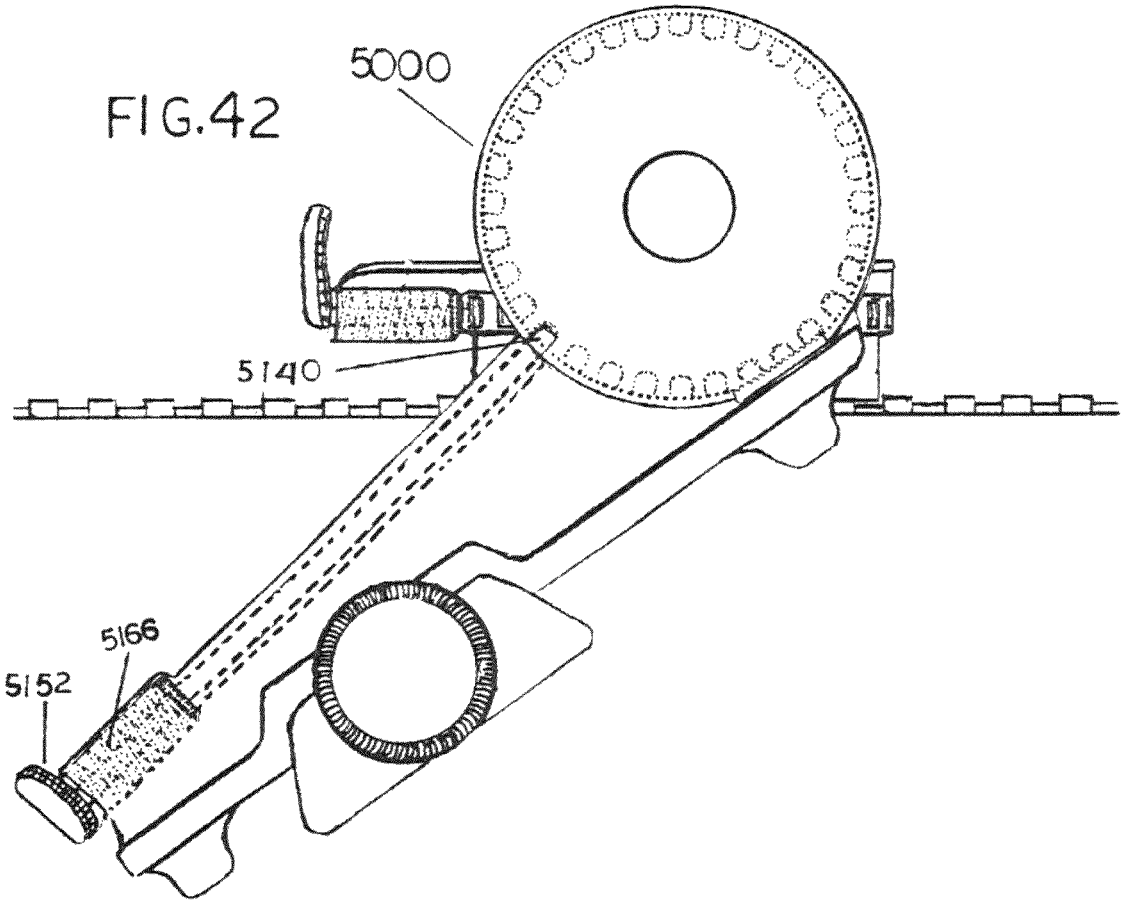
FIG. 42 is an overhead view of a side mountable rail mount 5000, that if it was in service with a smart device mounted therein, the target image and the surrounding area would be best viewable from a position partially forward and to the right side of the firearm, in accordance with the principles of the present embodiment.

Now referring to FIG. 42, being a drawing of rotatable and side mountable smart device mount 5000, and illustrated as to view some of the internal components that lock this device into its various optional angles of horizontal rotation, with the smart device mountable therein, in a position of 90 degrees in relation to the firearm, and rotated and locked into a horizontally rotated position, to surveil an area of potential danger, or engage hostile combatants if deemed necessary to the survival of the soldier, from a protective position, with the soldier positioned partly forward and to the left side of the firearm, in accordance with the principles of the present embodiment.

FIGS. 43 through 46 contain new material pertaining to optional changes in the rotatable camera sight 4000, that would be made as an integral part of the various types of reflex or red dot type camera sights. The changes to this device listed in this continuation in part, contain changes that may or may not be implemented, such as the mounting positioning of the locking mechanism's mechanical components being located on the bottom, rather than the top of the round disc portions of the device, as well as other changes that possess a much higher probity for change, such as the mechanical orientation of some of these same mechanical components. This change, only changing the finger pull's direction of actuation of the jaw-type latches that engage and disengage the camera sight's rotating ability. This simple change in directional finger pull of disengagement of the jaw type latches, provides a tremendous degree of operational ease, in that, by doing so, the rotational adjustment of the red dot or reflex type of camera sight, that would be made as an integral portion of this sight adjustable and rotatable rail mount, could be easily and routinely be accomplished by means of the simple grasping of the sight housing and the finger pull at the same time, and in the same motion, rotating and releasing the camera sight into its desired point of rotation. This is significant not just in ease of operation, but in that of seconds saved, in that, quite often when this action is needed to be accomplished, time to do so is critical to the actual survival of the user, in accordance with the principles of the present embodiment.

Figure 43:
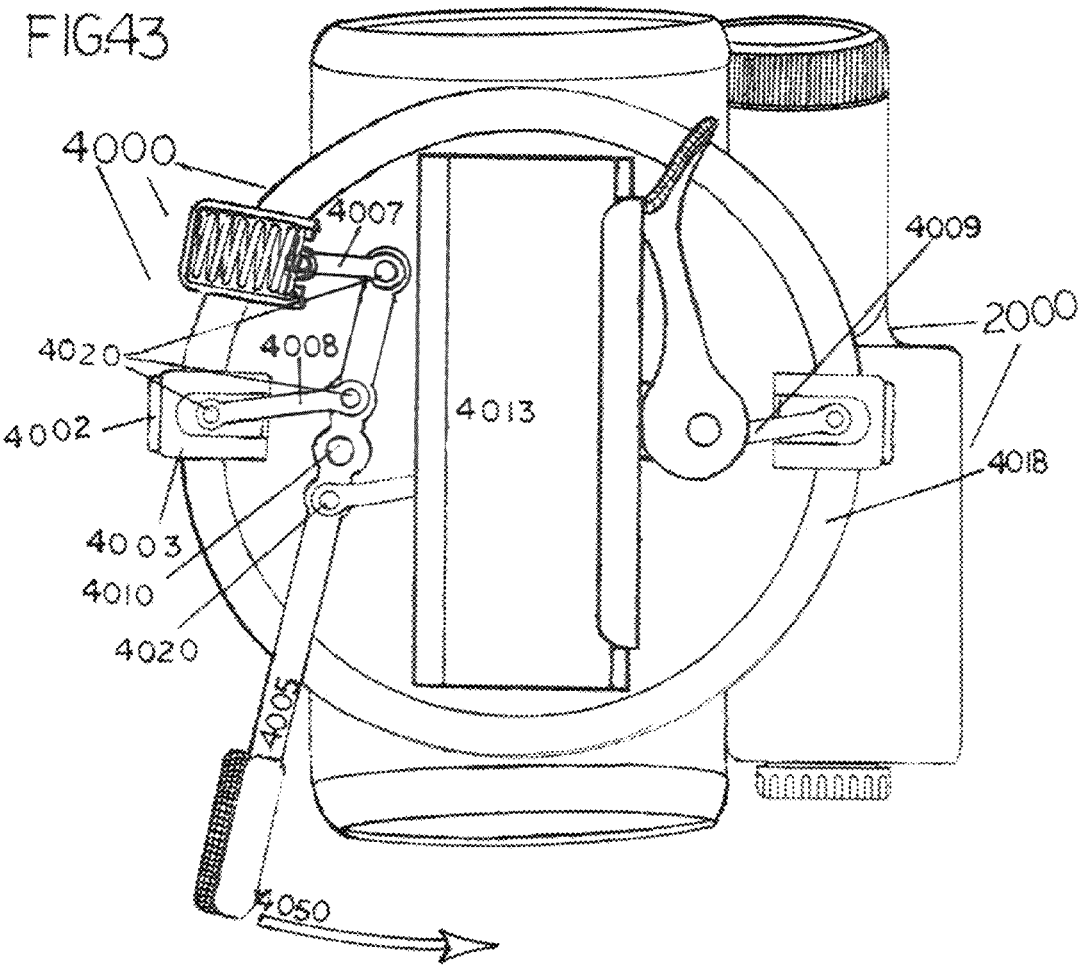
FIG. 43 is a view of rotateable rail mount 4000, as if turned upside down, with the bottom of the rail attachment portion 4013, thereof viewable, as well with all of the mechanical components, that lock the upper rotatable portion integral to camera sight 2000, into the bottom portion integral to the rail mount, can be viewed, in accordance with the principles of the present embodiment.

FIG. 43 is a view of rotatable rail mount 4000, as if turned upside down, with the bottom of the rail attachment portion 4013, thereof viewable, as well with all of the mechanical components, that lock the upper rotatable portion integral to camera sight 2000, into the bottom portion integral to the rail mount, can be viewed. The mechanical components, as well as their mode of operation, being changed only by the positional orientation of spring 4004, and armature, 4007, being on the opposite side of pivot point, 4010, as well as armatures 4008 and 4009, being connected to each other's point of connection on armature 4005, which the orientation of these components simply made the engagement process or directional pull of finger pull 4050, engage and disengage jaw clamps in opposite direction, in accordance with the principles of the present embodiment.

Figure 44:
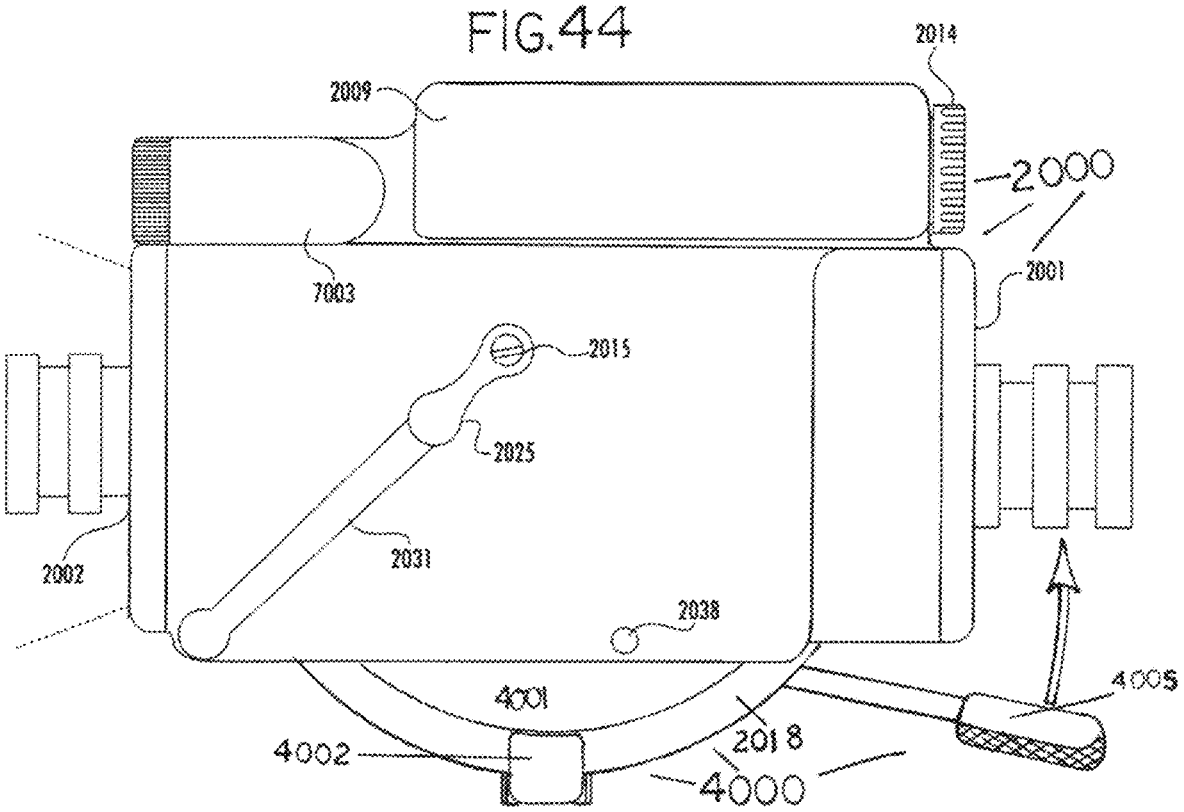
FIG. 44 is an overhead view of rotatable rail mount 4000, made as an integral portion of camera sight 2000, with a lower portion of one of the locking jaws of the mechanism that locks the upper plate #4001, that would most commonly be made as a portion of the camera sight housing to the bottom plate, made as a portion of the upper portion of the sight adjustable portion of the rail mount, in accordance with the principles of the present embodiment.

FIG. 44 is an overhead view of rotatable rail mount 4000, made as an integral portion of camera sight 2000, with a lower portion of one of the locking jaws of the mechanism that locks the upper plate #4001, that would most commonly be made as a portion of the camera sight housing to the bottom plate, made as a portion of the upper portion of the sight adjustable portion of the rail mount, in accordance with the principles of the present embodiment.

Figure 45:
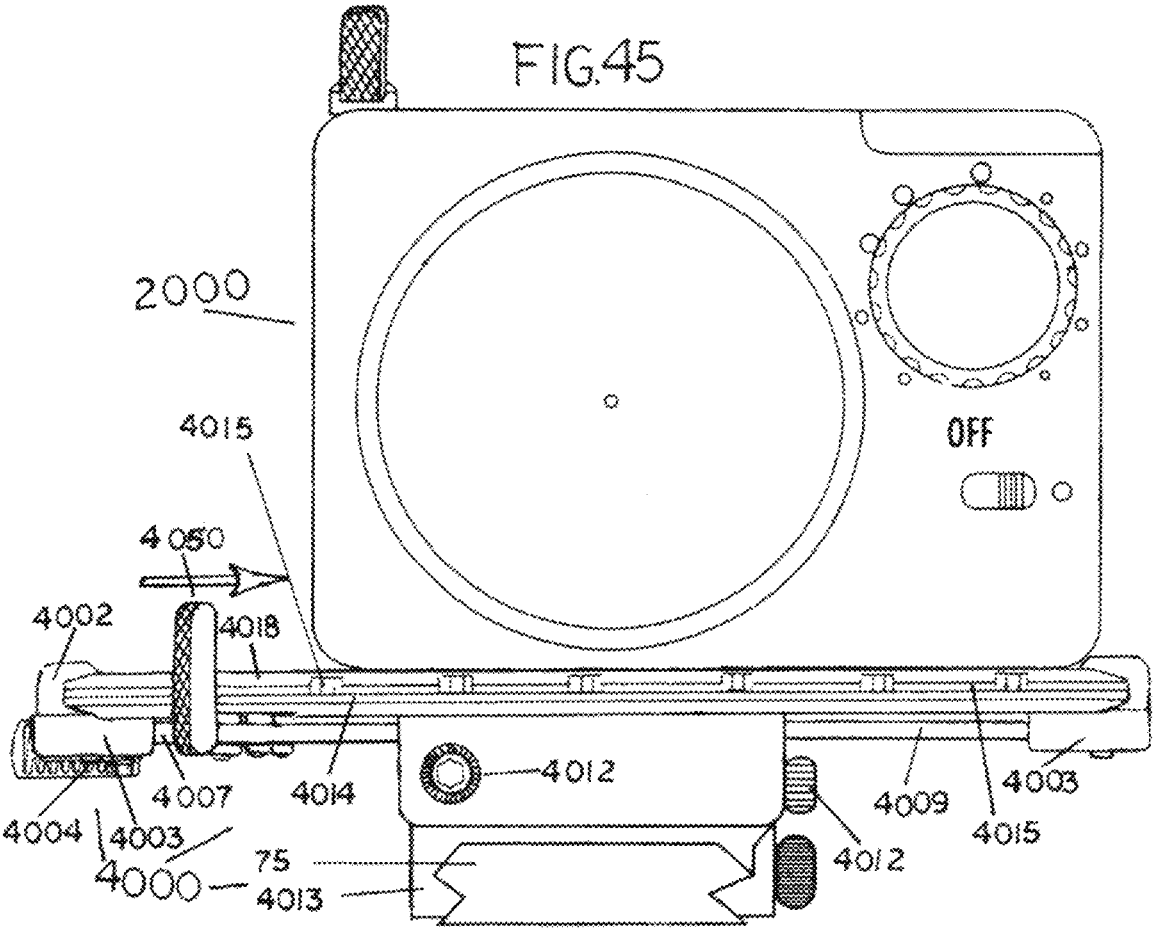
FIG. 45 is an rear view of rotatable rail mount 4000, made as an integral portion of camera sight 2000, with a clear profile view of the locking jaws that solidly lock the upper camera sight portion of sight adjustable rail mount 4000, to the bottom plate made as a portion of the upper sight adjustable portion of the sight adjustable portion of the rail mount, in accordance with the principles of the present embodiment.

FIG. 45 is a rear view of rotatable rail mount 4000, made as an integral portion of camera sight 2000, with a clear profile view of the locking jaws that solidly lock the upper camera sight portion of sight adjustable rail mount 4000, to the bottom plate made as a portion of the upper sight adjustable portion of the sight adjustable portion of the rail mount, in accordance with the principles of the present embodiment.

Figure 46:
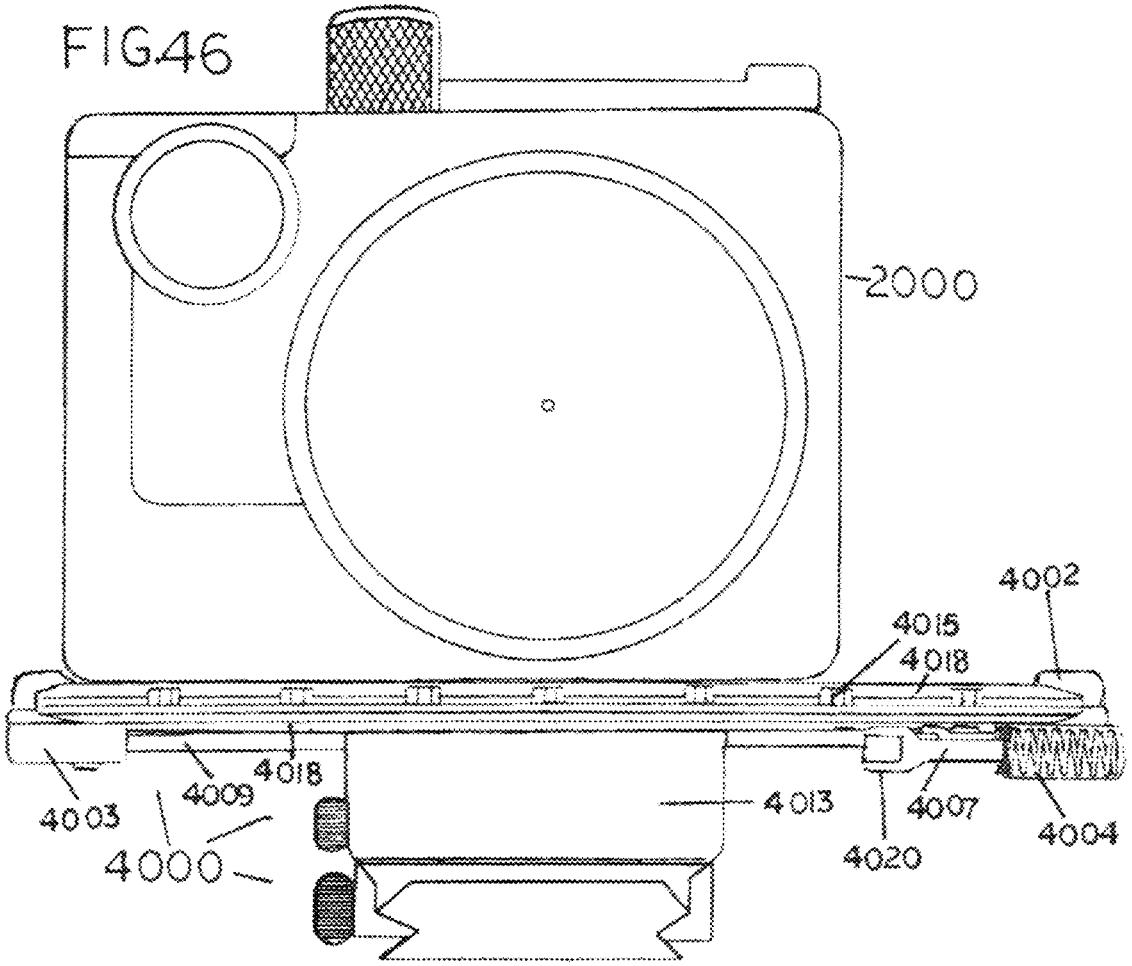
FIG. 46 is a frontal view of rotatable rail mount 4000, made as an integral portion of camera sight 2000, with a clear profile view of the locking jaws that solidly lock the upper camera sight portion of sight adjustable rail mount 4000 to the bottom plate made as a portion of the upper sight adjustable portion of the sight adjustable portion of the rail mount, in accordance with the principles of the present embodiment.

FIG. 46 is a frontal view of rotatable rail mount 4000, made as an integral portion of camera sight 2000, with a clear profile view of the locking jaws that solidly lock the upper camera sight portion of sight adjustable rail mount 4000 to the bottom plate made as a portion of the upper sight adjustable portion of the sight adjustable portion of the rail mount, in accordance with the principles of the present embodiment.

What is claimed is:

1. A tactical display mount comprising:

a rail mount capable of releasably securing to a rail of a firearm, the rail mount comprising a platform;

an upper base, rotatably secured to the platform; and and a camera mount secured to the upper base, and capable of securing a camera, wherein the camera mount comprises an armature;

wherein the platform further comprises an a plurality of holes or notches around the perimeter of the platform.

2. The tactical display mount of claim 1 further comprising a latch housing provided on a bottom portion of the upper base, the latch housing provided with a protrusion capable of engaging a first receptacle of the plurality of receptacles in order to secure the upper base in a first position relative to the platform and to prevent the upper base from rotating relative to the platform.

3. The tactical display mount of claim 2 further wherein the latch housing further comprises a spring maintaining tension on the rod or pin to help secure the protrusion within the first hole or notch of the plurality of holes or notches.

4. The tactical display mount of claim 2 wherein the latch housing further comprises a finger pull connected to the rod or pin such that when the finger pull is pulled, the protrusion can be disengaged from the first receptacle.

5. The tactical display mount of claim 4, wherein the platform further comprises a second receptacle of the plurality of receptacles, such that when the protrusion is disengaged from the first receptacle, the upper base may be rotated relative to the platform such that when the finger pull is released, the protrusion is capable of engaging the second receptacle of the plurality of receptacles in order to secure the upper base in a second position relative to the platform and to prevent the upper base from rotating relative to the platform.

6. The tactical display mount of claim 1 wherein the upper base further comprises a tensioning knob and a tensioning member, and the tensioning knob is capable of adjusting the tensioning member in order to secure a display device to the upper base.

7. The tactical display mount of claim 6 wherein the display device is a smart device.

8. A tactical display mount comprising:

a rail mount capable of releasably securing to a rail of a firearm, the rail mount comprising a platform;

an upper base, rotatably secured to the platform; and and a camera mount secured to the upper base, and capable of securing a camera, wherein the camera mount comprises an armature;

wherein the armature is adjustable, and capable of being slidably adjusted in a vertical and a horizontal direction relative to the upper base.

9. The tactical display mount of claim 6 wherein the armature comprises a slot and a an adjustment knob having a rod disposed in the slot such that the adjustment knob can be loosened to allow the rod to be movably positioned within the slot, and the adjustment knob can be tightened to secure the position of rod within the slot, and thereby secure the position of the armature relative to the upper base.

10. The tactical display mount of claim 1, wherein the camera mount further comprises a camera housing capable of receiving and securing a camera.

11. A tactical display mount comprising:

a rail mount capable of releasably securing to a rail of a firearm, the rail mount comprising a platform;

an upper base, rotatably secured to the platform; and and a camera mount secured to the upper base, and capable of securing a camera, wherein the camera mount comprises an armature;

a camera, the camera comprising a housing that is integral to the armature.

12. The tactical display mount of claim 11 wherein the camera further comprises a connector capable connecting the camera in electronic communication with a display device when the display device is secured to the upper base.

13. The tactical display mount of claim 12 wherein the connector is disposed at the end of an extendable cord.

14. The tactical display mount of claim 12 wherein the upper base further comprises a tensioning knob and a tensioning member, and the tensioning knob is capable of adjusting the tensioning member in order to secure the display device to the upper base.

15. The tactical display mount of claim 11 wherein the camera further comprises a viewing screen.

16. The tactical display mount of claim 1 further comprising

A camera secured to the camera mount, and a display device secured to the upper base, wherein the camera and the display device are in communication with the camera, such that an image captured by the camera can be displayed in a window of the display device.

17. A tactical display mount comprising:

a rail mount capable of releasably securing to a rail of a firearm, the rail mount comprising a platform;

an upper base, rotatably secured to the platform;

a camera mount secured to the upper base, and capable of securing a camera, wherein the camera mount comprises an armature;

a camera secured to the camera mount, and a display device secured to the upper base, wherein the camera and the display device is in communication with the camera, such that an image captured by the camera can be displayed in a window of the display device;

wherein the display device is in wireless communication with the camera.

18. A tactical sight system comprising:

a display mount comprising a rail mount capable of releasably securing to a rail of a firearm, the rail mount comprising a platform;

an upper base, rotatably secured to the platform;

a camera mount secured to the upper base, and capable of securing a camera;

a rear-facing camera secured to the camera mount; and a display device secured to the upper base, wherein the rear-facing camera and the display device is in communication with the camera, such that an image captured by the camera can be displayed in a first window of the display device; and a sight mount comprising a camera sight capable of being mounted on the rail of the firearm, wherein the camera sight is in communication with the display device such that an image captured by the camera sight can be displayed in a second window of the display device.

* * * * *